US007170462B2

(12) United States Patent
Ihara et al.

(10) Patent No.: US 7,170,462 B2
(45) Date of Patent: Jan. 30, 2007

(54) ANTENNA STRUCTURE AND RADIO CONTROLLED TIMEPIECE

(75) Inventors: Takashi Ihara, Tokyo (JP); Shigeyuki Takahashi, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 24 days.

(21) Appl. No.: 10/511,912

(22) PCT Filed: Sep. 11, 2003

(86) PCT No.: PCT/JP03/11650

§ 371 (c)(1),
(2), (4) Date: Oct. 20, 2004

(87) PCT Pub. No.: WO2004/025782

PCT Pub. Date: Mar. 25, 2004

(65) Prior Publication Data

US 2005/0146472 A1 Jul. 7, 2005

(30) Foreign Application Priority Data

Sep. 11, 2002 (JP) ..... 2002-264985
Oct. 10, 2002 (JP) ..... 2002-297095
Nov. 29, 2002 (JP) ..... 2002-347040

(51) Int. Cl.
*H01Q 7/08* (2006.01)
*H01Q 1/12* (2006.01)

(52) U.S. Cl. ..... 343/788; 343/718; 343/895

(58) Field of Classification Search ..... 343/718, 343/741, 788, 866, 895; 368/88, 278
See application file for complete search history.

(56) References Cited

U.S. PATENT DOCUMENTS 4,884,252 A * 11/1989 Teodoridis et al. ..... 368/10
4,947,179 A * 8/1990 Ganter et al. ..... 343/718
5,625,370 A * 4/1997 D'Hont ..... 343/788
5,768,217 A * 6/1998 Sonoda et al. ..... 368/10
5,796,324 A * 8/1998 Ross et al. ..... 336/192
5,963,181 A * 10/1999 Abe ..... 343/895
6,134,188 A 10/2000 Ganter et al. ..... 368/47
6,163,305 A * 12/2000 Murakami et al. ..... 343/788
6,400,330 B1 * 6/2002 Maruyama et al. ..... 343/788

FOREIGN PATENT DOCUMENTS

DE 44 07 116 9/1995
JP 55-082505 6/1980
JP 57-131042 8/1982
JP 61-203516 12/1986

(Continued)

*Primary Examiner*—Tan Ho
(74) *Attorney, Agent, or Firm*—Greer, Burns & Crain, Ltd

(57) ABSTRACT

An object of the present invention is to provide an antenna structure having high reception performance and having neither material limitations nor design limitations, and to provide a radio controlled wristwatch utilizing the antenna structure as mentioned above, and further wherein the present invention relates to an antenna structure to be used inside a metal outer casing and having a configuration which receives radio wave, the antenna structure being characterized by having a structure wherein a coil is wound about a magnetic core and being able to receive a magnetic flux from outside the metal outer casing.

57 Claims, 24 Drawing Sheets

FOREIGN PATENT DOCUMENTS

| | | |
|---|---|---|
| JP | 6-215942 | 8/1994 |
| JP | 11-074138 | 3/1999 |
| JP | 2000-105285 | 4/2000 |
| JP | 2001-208875 | 8/2001 |
| JP | 2001-264463 | 9/2001 |
| JP | 2002-184637 | 6/2002 |

* cited by examiner

Antenna-Sample Distance

Antenna-Metal plate distance:0mm (A) Antenna Gain-Winding Resistance (B) Number of turns: 500 T (Winding resistance 6.4 Ω)

ANTENNA STRUCTURE AND RADIO CONTROLLED TIMEPIECE

TECHNICAL FIELD

The present invention relates to an antenna structure and a radio controlled timepiece using the antenna structure, more particularly, to an antenna structure constructed not to reduce radio-wave reception performance of the antenna structure even when the antenna structure is disposed near a metal object, and also relates to a radio controlled timepiece using the antenna structure.

BACKGROUND THE RELATED ARTS

In recent years, wristwatches of various types using a radio wave have been commercialized.

Specifically, there are known radio-equipped wristwatches formed such that radio functionality is added into a wristwatch to receive a broadcast radio wave and to acquire predetermined information, and radio controlled timepieces or remote controlled wristwatches in which a standard radio wave carrying time code is received to self-adjust the time of the wristwatch in use to the standard time.

However, for such a wristwatch to use a radio wave, it is necessary that a timepiece component configuration or design should be completely different from a timepiece component configuration or design of the conventional time pieces, and also consideration not to impair the reception performance is necessary.

More specifically, with the wristwatch, there exists a problem in which how to improve the reception performance of the antenna, in one aspect and further there exists design limitations regarding the size and design since the antenna is disposed in the wristwatch or in a portion of an outer casing, in other aspect.

In particular, the antenna greatly influencing the radio-wave reception performance has a relatively large size as compared with other components of a conventional wristwatch, and layout limitations are imposed in relation to the reception performance. As such, conventionally, antennas of various types such as an internally mounted type, an externally mounted type, an extendable type, and a code type are employed.

As the internally mounted type, a bar antenna formed of a magnetic core and winding is mainly used in the past.

In the case, however, when the antenna is mounted inside the wristwatch, engineering needs to be carried out for a case-body material, structure, design, or the like so as not to reduce the reception performance of the antenna.

In the case of the code type concurrently using, for example, the externally mounted type and the extendable type used with radio cassette units, earphones, and the like, engineering needs to be carried out providing considerations regarding the design of the overall timepiece and storability and durability thereof.

Under these circumstances, in order to further improve the wristwatch in terms of ornamental design in addition to further minimization and portability, considerations need to be provided, of course, not to introduce reduction in the reception performance of the antenna device and also to introduce the portability and ornamental design thereof.

Regarding the radio controlled timepiece, what determines the reception performance are antenna characteristics and reception circuit characteristics.

In a present stage, a lower limit of an input signal of a reception circuit or a reception IC is a signal amplitude of about 1 μV. To obtain practical reception performance, a reception antenna is required to have a capablity of obtaining an output having the signal amplitude of about 1 μV at an electrofield intensity (signal intensity) of 40 to 50 dB μV/m.

As such, with size limitations being imposed, it is a general practice to use a reception antenna of a resonance type allowing the signal output to be increased.

As the type of the reception antenna, since the wavelength of the radio wave is long, it is a general practice to use a bar antenna formed with a conductor wire wounded around a magnetic core.

In this kind of antenna, the output of the reception antenna thus formed is substantially proportional to the size of the reception antenna, so that a size of the antenna cannot be reduced to be so small to acquire practical reception performance. In the case of a small one such as a wristwatch, factors such as reception performance and layout are problems.

In addition, the output of the reception antenna is substantially reduced when the antenna is provided inside a metal outer case.

For this reason, for the wristwatch, to utilize radio waves, a component configuration and design being completely different from a component configuration and design of a conventional timepiece are required, and in addition, consideration not to impair the reception performance is also necessary.

For wristwatches, the compactness, thinness, portability, degree of design freedom, and massive feeling (high class feeling) are important factors, and a configuration in which an antenna is built-in inside a metal outer casing of a wristwatch is demanded.

Conventional radio controlled timepieces primarily use the technique in that the antenna is externally mounted on the timepiece or the technique in that the antenna is internally mounted inside the timepiece.

For a wristwatch with a bottom cover section and a side section each being made of a metal material, it is a general practice to mount the reception antenna on an external surface of the watch.

An outer casing of the reception antenna is formed by using non-metallic material such as a plastic material or the like so as not to reduce the reception performance, whereby it has a shape greatly protruding out of periphery of the watch. This impairs the compactness, thinness, and portability, and particularly reduces the degree of design freedom.

In the system in which the reception antenna is internally mounted inside he watch, the material such as a ceramic or plastic material for the outer casing (the bottom cover section and the side section) is used not to reduce the reception performance. However, since the strength of the material is low, the thickness of the timepiece becomes thick, thereby impairing the storability and portability, and increasing design limitations.

Further, the timepiece is formed with a low massive feeling in appearance.

As such, conventionally, as disclosed in Japanese Unexamined Patent publication Laid-open No. H2-126408, a metal antenna is disposed in a leather band of a wristwatch.

In addition, as disclosed in the Applicant's Japanese Unexamined Utility Model Puplication No. H5-81787, there has been proposed a radio controlled timepiece in which with an antenna formed such that a coil is wound on a core is disposed between a dial plate and a windshield, whereby the antenna is separated from main metal casing that disturbs the radio wave as well as having an unique-designed wristwatch.

Additionally, International Patent Puplication Laid-Open No. WO 95/27928 discloses a wristwatch having a configuration in which an antenna is mounted on a side portion of a casing of the wristwatch.

In addition, European Patent Application Publication No. 0382130 discloses a timepiece in which an antenna is disposed with a form of ring like configuration on the surface of the casing.

However, in the conventional configuration with antenna being disposed over the band, since the antenna is built in the band, it is required to make an electro conduction between the antenna and an electronic device installed inside a main body. As such, sufficient flexibility cannot be imparted to a connection portion between the band and the antenna.

In addition, a metallic band disturbing the radio wave cannot be employed, and thus a connection-dedicated watchband such as a rubber band should be used, consequently arising the problem of material and design limitations.

In the case of the configuration in which the antenna is disposed on an upper surface or a side area thereof, the antenna is separated from the metal portion of the main body of the timepiece. This arises problems in that the timepiece needs to be formed overall to be thick or large, and is therefore subject to design limitations.

In the case of the technique disclosed in European Patent Application Publication No. 0382130, since reception cannot be performed because of the presence of metal in the ring, there arises a problem in that, in practical application, the antenna should be disposed independently of the timepiece.

In addition, Japanese Unexamined Patent Application Publication No. 11-64547 discloses a wristwatch formed such that a coil is provided in a concave portion in a circumferential portion of a circuit board, and a core us disposed in annular arcuate shape extending along the circumferential direction of the circuit board. However, a problem lies in that the manufacturing procedure is complexed, and the operation of assembly in the manufacturing stage is complexed.

In publications such as Japanese Unexamined patent Publication No. 2001-33571 and No. 2001-305244, wristwatches are disclosed in which windshield and bottom cover portions are formed of a non-metallic material such as glass or ceramic material, and a configuration is provided therebetween by using metal materials conventionally used so that radio waves sufficiently reach the antenna.

In summary, according to the conventional examples described above, the configuration thereof was designed based upon the fact that the output of the reception antenna is significantly reduced when it is provided inside the metal outer casing body, and thus in the examples of conventional timepieces, the bottom cover section is formed from the non-metallic material so as to reduce the output reduction and the metal side section is formed from a metal so as to show high level of massive feeling over the timepiece.

Nevertheless, however, in the conventional examples, since the glass or ceramic material is used, the problem arises in that the thickness of the timepiece is increased.

Under these circumstances, conventionally, there exist no way beyond using a high-sensitivity antenna structure with a large size or using the timepiece only in districts in which high radio-wave electric-field intensity is used. As such, usability required for the radio controlled timepiece is impaired, and the manufacturing cost of the antenna structure, including the design cost is resultantly increased.

In these conventional timepiece having the above-mentioned configurations, it is secured that the radio wave can surely arrive at an antenna of the timepiece, while it gives an impression to a user as if the timepiece is made of metal by applying a thin metallic plating on a bottom cover section thereof.

However, there exists a problem in which each timepiece is in lack of heaviness feeling or massive feeling in its appearance, so that an image for a high quality product is impaired.

In addition, since the reception antenna is built in the metal side section, the output of the antenna is lowered, and hence the reception performance is reduced, accordingly.

Thus, in the past, it was common situation in that a high-quality image radio controlled timepiece having a full metal outer casing body is not yet implemented.

That is, the above-described present inventions are developed in the background in accordance with the following concepts. In the case where the antenna is built in the timepiece, since the bottom cover portion is formed of the metal material, the cover portion has electro-conductivity. As such, even when the radio wave has reached the wristwatch, a magnetic flux is absorbed by the bottom cover portion, whereby the radio wave does not reach the antenna portion.

Accordingly, conventionally, there exist no way beyond using a high-sensitivity antenna structure or using the timepiece only in districts with high radio-wave electric-field intensity. As such, usability required for the radio controlled timepiece is impaired, and the manufacturing cost of the antenna structure, including the design cost is resultantly increased.

Further, in a wristwatch having a configuration in that a bottom cover section is made of the non-metallic material, it is secured that the radio wave can surely arrive at an antenna of the timepiece, while it gives an impression to a user as if the timepiece is made of metal by applying a thin metallic plating on a bottom cover section thereof.

However, there exists a problem in which each timepiece is in lack of heaviness feeling or massive feeling in its appearance, so that an image for a high quality product is impaired.

Further, when the antenna is built in the metal outer casing, a Q value (index of characteristics of the antenna) is reduced, the output (gain) of the antenna is lowered, whereby a problem takes place in that good information communication cannot be implemented.

Thus, conventionally, it is a fact that a radio controlled timepiece with a full metal outer casing offering high quality feeling has not been realized.

Accordingly, an object of the present invention is to solve the conventional problems described above, and to provide an antenna structure usable in a metal outer casing having high reception performance and having neither material limitations nor design limitations, and to provide a radio controlled timepiece using the antenna structure and having a complete metal outer casing.

Another object of the present invention is to provide an antenna device of a wristwatch that prevents the wristwatch from being formed with an increased thickness to be bulky and that offers good wrist wearability.

DISCLOSURE OF PRESENT INVENTION

In order to achieve the object described above, basically, the present invention employs technical configurations as described hereunder.

A first aspect of the present invention is an antenna structure which receives a radio wave to be used inside a metal outer casing, the antenna structure being characterized by having a structure wherein a coil is wound about a magnetic core and being able to receive a magnetic flux from outside the metal outer casing.

A second aspect of the present invention is an antenna structure which receives a radio wave to be used inside a metal outer casing, the antenna structure being characterized in that the antenna structure comprising a main magnetic path in which a coil is wound about a magnetic core and a sub-magnetic path in which the coil is not wound about the magnetic core, the magnetic path formed along the magnetic core having a configuration similar to a closed loop like configuration, a gap is provided in a part of the magnetic path of the antenna structure forming the closed loop like configuration, the gap portion of the magnetic path is configured to have magnetic resistance or magnetic permeability being different from tat of other parts of the magnetic path, and the antenna structure has a structure wherein a magnetic flux coming from outside the metal outer casing, can be received but the magnetic flux generated by resonance hardly leaks to an outside of the magnetic path.

A third aspect of the present invention is an antenna structure as defined by the above-mentioned first and second aspects, wherein the magnetic resistance of the sub-magnetic path is configured so as to be larger than that of the magnetic resistance of the main magnetic path.

A fourth aspect of the present invention is an antenna structure as defined by the above-mentioned first to third aspects, wherein, the gap is an air gap.

A fifth aspect of the present invention is an antenna structure which receives a radio wave and comprising at least a magnetic core portion and a coil portion which is provided on at least one portion of the magnetic core portion, wherein, the antenna structure including a main magnetic path wherein a coil is wound about the magnetic core and a sub-magnetic path wherein the coil is not wound about the magnetic core, the magnetic path along the magnetic core forming a configuration having a closed loop like configuration, the antenna structure having a Q value retention ratio Rq defined in the present invention, when this antenna structure is used under circumstances wherein a metal material is present in the vicinity of the antenna structure, is not lower than 10%.

A sixth aspect of the present invention is an antenna structure having a similar configuration as that of the fifth aspect and which being suitable for use under an environment where a metal object is present in the vicinity of the antenna structure, and being characterized by that a maximum gain reduction ratio defined in the present invention in the case where a metal object is present in the vicinity of the antenna structure is not higher than 60%.

A seventh aspect of the present invention is an antenna structure which is configured such that the antenna structure comprising a main magnetic path in which a coil is wound about a magnetic core and a sub-magnetic path in which the coil is not wound about the magnetic core, the magnetic path being formed along the magnetic core to form a closed loop like configuration, and further the antenna structure being able to receive a radio wave which is arranged in a timepiece in which at least one of a side section and a bottom cover section is made of a metal material, the antenna structure being characterized in that an L value of the antenna structure is not more than 1600 mH.

An eighth aspect of the present invention is an antenna structure comprising a main magnetic path in which a coil is wound about a magnetic core and a sub-magnetic path in which the coil is not wound about the magnetic core, the magnetic path being formed along the magnetic core to form a closed loop like configuration, and the antenna structure being able to receive a radio wave which is arranged in a timepiece in which at least one of a side section and a bottom cover section is made of a metal material, the antenna structure further being characterized by that a winding resistance of the antenna structure is not higher than 1 KΩ.

A ninth aspect of the present invention is an antenna structure comprising a main magnetic path in which a coil is wound about a magnetic core and a sub-magnetic path in which the coil is not wound about the magnetic core, the magnetic path being formed along the magnetic core to form a closed loop like configuration, and further the antenna structure being able to receive a radio wave which is provided in a timepiece in which at least one of a side section and a bottom cover section being formed of metal, the antenna structure being characterized by that the number of turns of the antenna is not smaller than 400.

A tenth aspect of the present invention is a radio controlled timepiece which comprises at least one of a side section and a bottom cover section being formed of metal, and further wherein as an antenna which is installed inside of the timepiece, the antenna structure as defined by any one of the above-mentioned aspects is used.

An eleventh aspect of the present invention is a radio controlled timepiece which comprises a reference signal generating means for outputting a reference signal; a time keeping means for outputting time keeping information on the basis of the reference signal; a displaying means for displaying a time information on the basis of the time keeping information; a receiving means for receiving standard radio wave having reference time information and a time information correction means for correcting the output time information output from the time keeping means based on the receiving signal received from a receiving means, and wherein the receiving means including an antenna structure having the structure as defined by any one of the above-mentioned aspects.

The radio controlled timepiece having the antenna structure of the present invention employs the technical configuration as described above whereby to enable easily obtaining the radio controlled timepiece using the antenna structure that has high reception efficiency, and a degree of design freedom enhanced with the size and thickness of the wristwatch per se which are not different from those of the conventional wristwatch and that enables manufacturing costs to be reduced, by using the antenna structure having the simple configuration without greatly changing the structure, design, and/or the like of the conventional radio controlled timepiece.

THE MOST PREFERABLE EMBODIMENTS FOR CARRYING OUT THE PRESENT INVENTION

Figure 1:
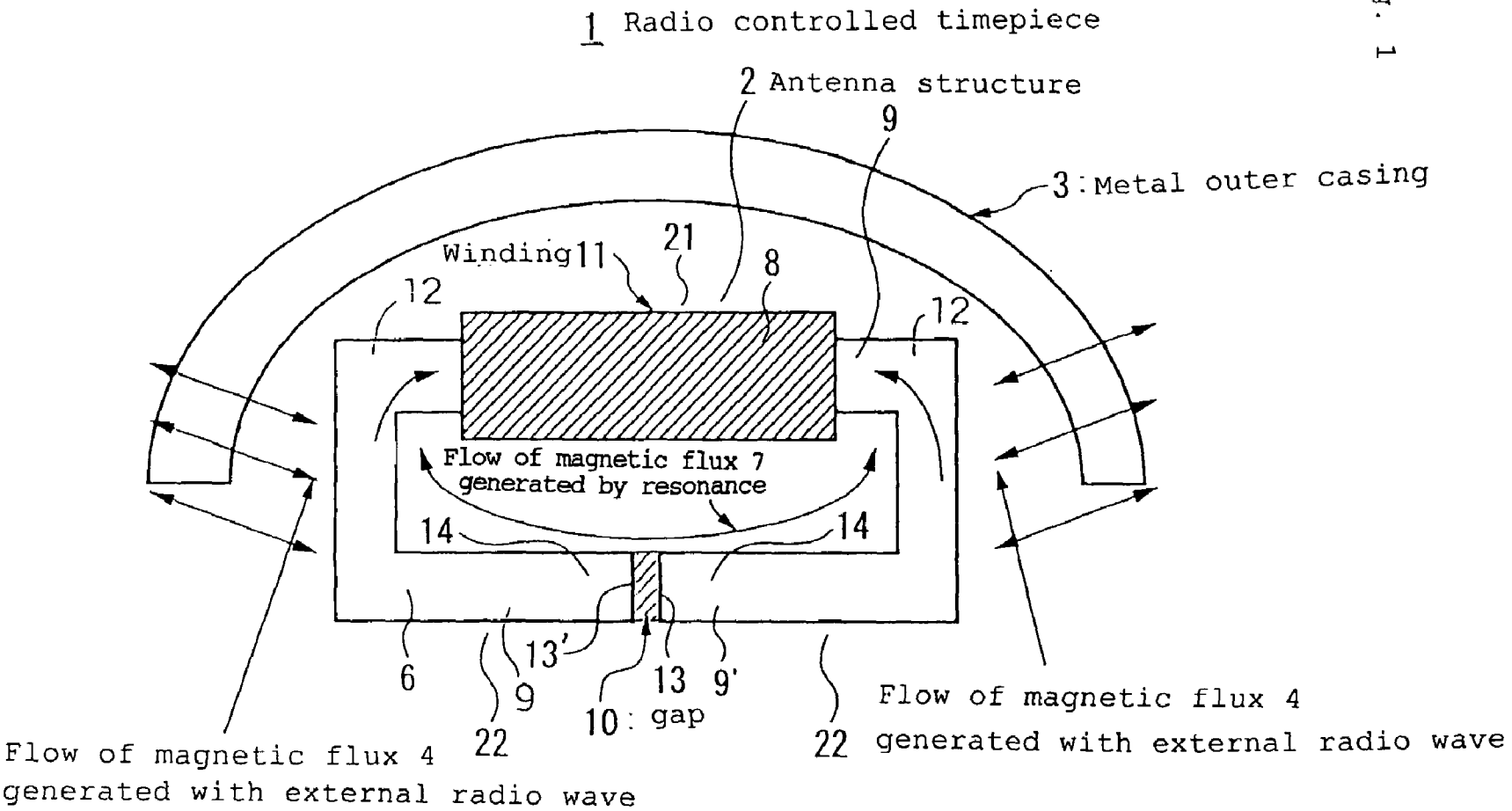
FIG. 1 is a view showing the configuration of a practical example of an antenna structure of the present invention.

Referring to the drawings, embodiments of an antenna structure and a radio controlled timepiece using the antenna structure of the present invention will be described hereinbelow.

First Embodiment

The configuration of a practical example of the antenna structure in a first aspect according to the present invention will be described in detail hereinbelow.

As described above an antenna structure 2 in the practical example according to the first aspect of the present invention receives radio waves to be used inside a metal outer casing 3. The antenna structure 2 is constructed of a main magnetic path 21 in which a coil is wound about a magnetic core 6 and a sub-magnetic path 22 in which the coil is not wound about the magnetic core, which forms a sub-magnetic pass antenna core 9'.

Additionally, a magnetic path 12 formed along the magnetic core 6 forms a closed loop like configuration, a gap 10 is provided in a part of the magnetic path 12 of the antenna structure 2. The portion of the gap 10 is configured so as to have magnetic resistance or magnetic permeability being different from those of other parts of the magnetic path.

In this structure, an external magnetic flux 4 can be received from outside the metal outer casing, and the magnetic flux 7 generated by resonance hardly leaks to the outside.

In addition, in the antenna structure 2 of the present invention, the magnetic resistance of the sub-magnetic path 22 is higher than the magnetic resistance of the main magnetic path 21.

Figure 2:
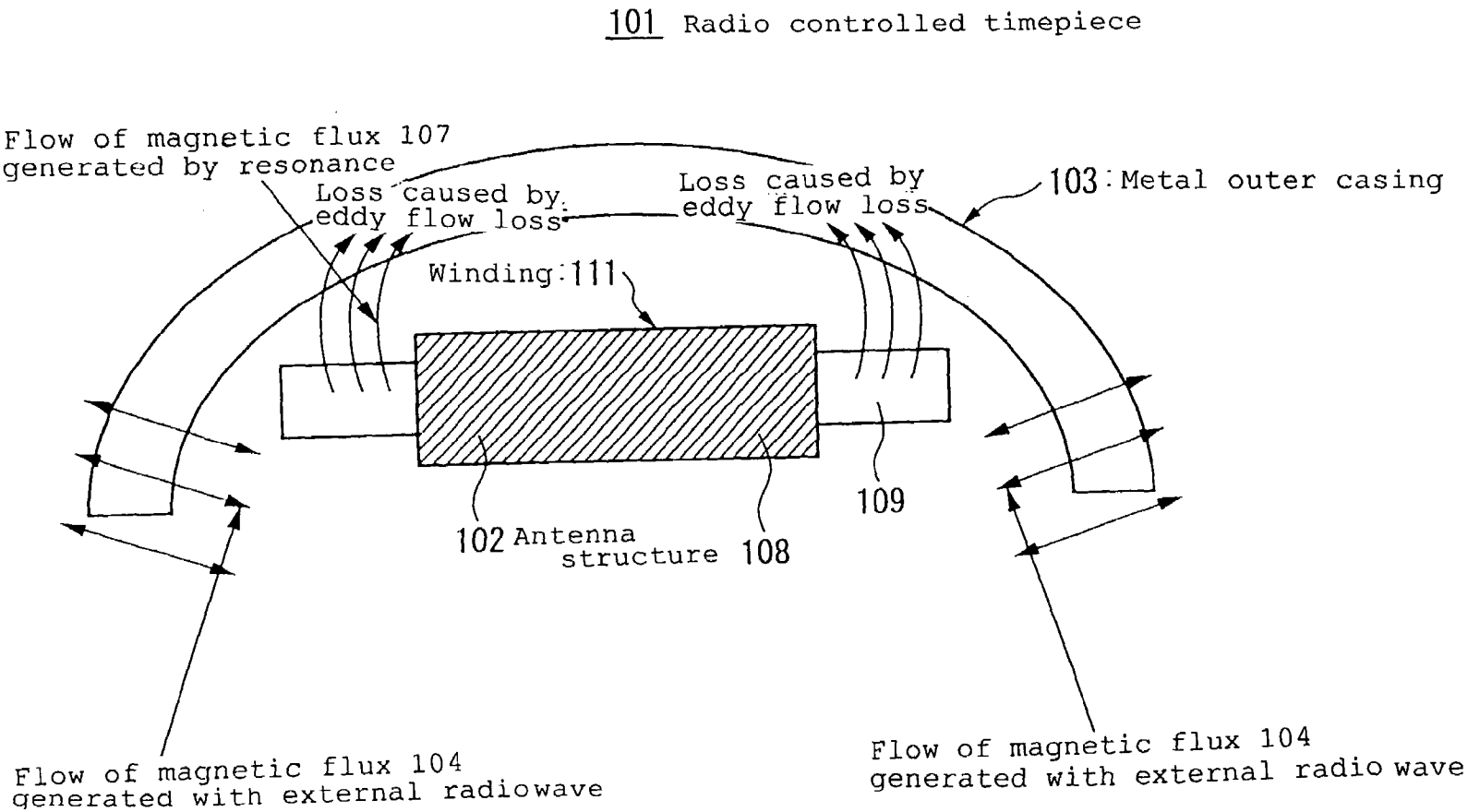
FIG. 2 is a cross-sectional view showing the configuration of a practical example of a conventional antenna structure of the present invention.

To describe a conventional case, suppose that, as shown in FIG. 2, a metal outer casing 103 having electro-conductivity, such as a side section and/or bottom cover section of stainless steel or titanium alloy which is used as an outer casing of a time piece (these sections hereinbelow will be referred to as a "metal outer casing" in the present invention), is disposed either in the vicinity of an antenna structure 102 or in contact with the antenna structure 102, that receives external radio waves.

In this case, it was considered that a magnetic flux 104 caused by the external radio wave is absorbed by the metal outer casing 103, so that the external radio wave does not reach the antenna structure 102, and the output of the antenna is reduced. As such, countermeasures have been taken. For example, to increase the sensitivity of the antenna structure 102, the antenna structure 102 per se has been largely formed, or the antenna structure 102 has been provided outside the outer casing 103, or the outer casing 103 is formed of plastic or ceramic to replace the metal outer casing 103. Concurrently, for example, thin metal plating or metallic coating has been applied onto the surface of the non-metallic substance to improve appearance quality.

However, after extensive research, the present inventors have discovered that the above-described concepts of acquiring the conventional problems are practically incorrect. Note that even in the case where the metal outer casing 103 having electro-conductivity is present in the vicinity of the antenna structure 102 or in contact with the antenna structure 102, the external radio wave substantially reaches the antenna structure 102, and thus problems lie in the following areas. As illustrated in FIG. 2, when the antenna structure 102 resonates, a magnetic force line 107 generated from the magnetic core 109 of the antenna structure 102 (magnetic flux) is attracted to the metal outer casing 103. This causes eddy current and introduces a magnetic energy loss, thereby reducing the antenna Q value and lowering the magnitude of the output from the antenna structure 102 reduces, consequently significantly deteriorating the reception performance.

These problems will be described hereunder in more detail. For example, with reference to FIG. 2, a case is now assumed in which the metal outer casing 103, that is, the side section and the bottom cover section, are formed of a metal material, the antenna structure 102 for receiving the radio wave, is disposed in the metal outer casing 103, and a radio wave is to be received.

In this case, while the flow of the magnetic flux 104 of the external radio wave attempting to enter a timepiece 101 from the outside is somewhat attenuated (about −3 dB, for example), the flow substantially reaches the antenna structure 102 without being disturbed.

However, when the antenna structure 102 is resonated upon reception of the magnetic flux caused by the radio-wave, that is, during alternate energy state transformations between electric energy and magnetic energy, the magnetic flux flow 107 generated by resonance output from an end portion of a magnetic core 109 of the antenna structure 102 is absorbed into the outer casing 103 of the metal material.

Thereby, it is understood that eddy current is generated to absorb the energy of the magnetic flux flow 107 caused by the resonance, consequently lowering the resonant output from the antenna structure 102.

Tables 1 and 2 below respectively show measurement results of the gain of the antenna and of the Q values of the antenna when an antenna is used in separately without accompanied by a metal material and when the same antenna is used inside the metal outer casing existing near the antenna either in a resonant state and in a non-resonant state.

In the experiments described above, titanium (Ti) was used as a material of the metal outer casing, a conventional antenna formed by winding with 400 turns of a conductor on a ferrite core was used for the antenna structure, and the operation of resonance or non-resonance was adjusted by the operation of attaching or detaching a resonant capacitor.

For the resonant frequency in the present practical example, 40 KHz was employed.

In addition, measuring methods in the present experiments will be described below.

TABLE 1

| | Antenna Gain | | |
|---|---|---|---|
| | Antenna Separately used | Metal outer casing | Attenuation Factor(dB) |
| Resonance | −31 dB | −62 dB | −31 dB |
| Non-resonance | −71.5 dB | −74.2 dB | −2.7 dB |

TABLE 2

| | Antenna Q Value | | |
|---|---|---|---|
| | Antenna Separately used | Metal outer casing | Attenuation Factor(dB) |
| Resonance | 114 | 3 | −31 dB |

Figure 12:
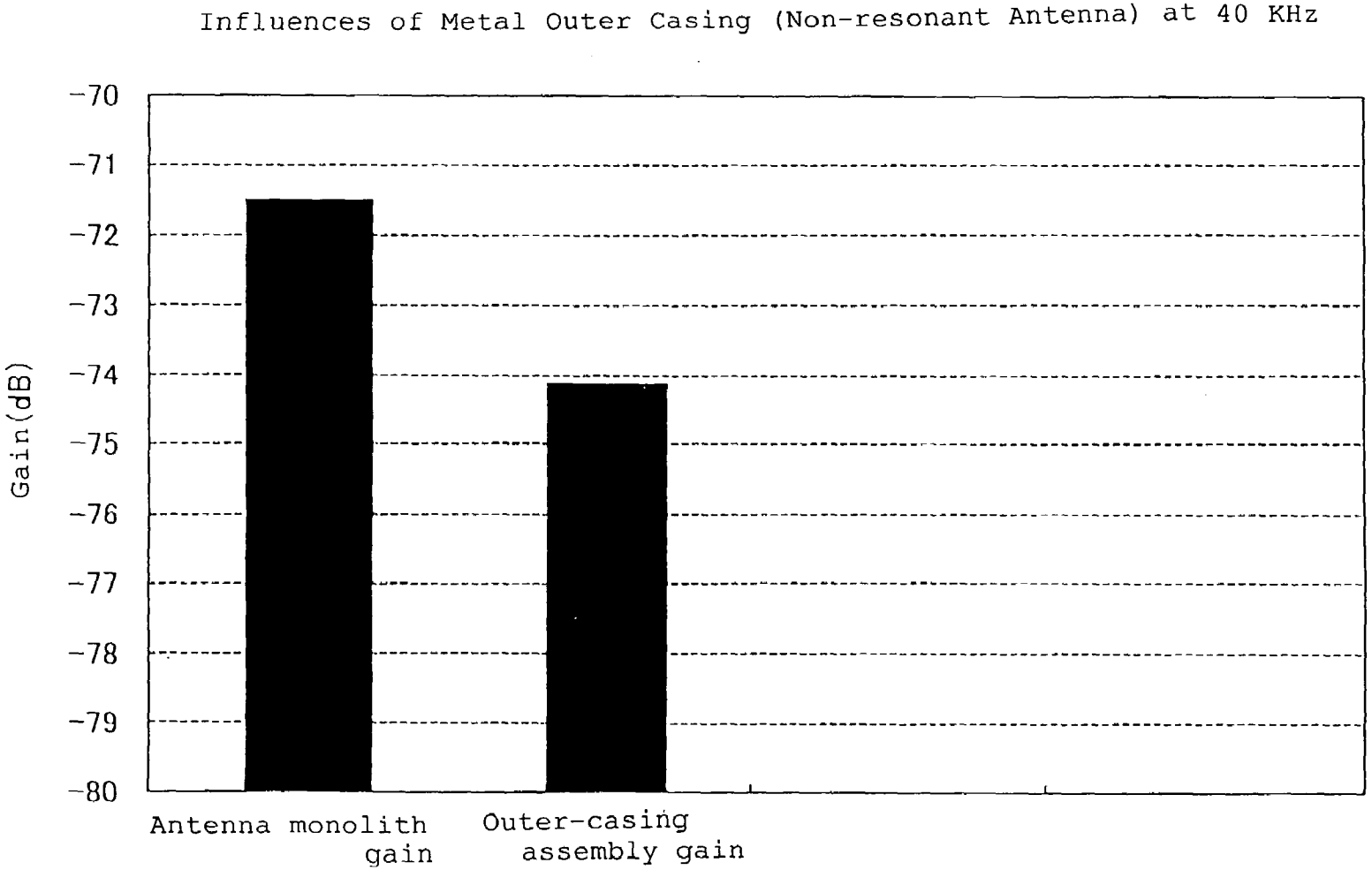
FIG. 12 is a graph showing influences of a metal outer casing of the antenna structure.
Figure 13:
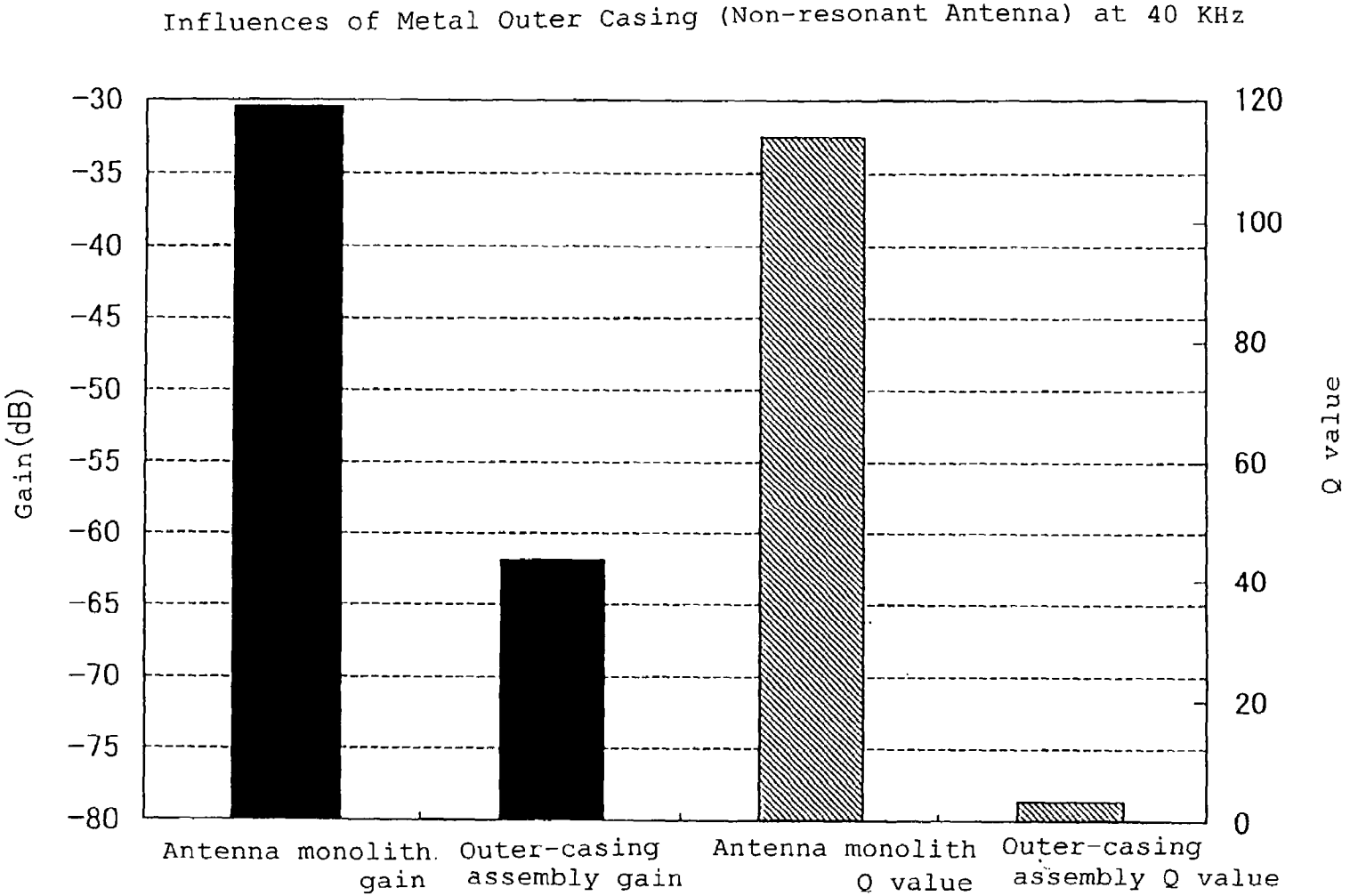
FIG. 13 is a graph showing influences of the metal outer casing of the antenna structure.

FIGS. 12 and 13 shows the experiment results. From the results, it can be known that when the antenna is in the non-resonance state, the antenna receives a magnetic flux caused by the external radio wave and outputs voltage amplitude in accordance with the number of turns.

As such, when gains in the state of the antenna being used independently and in the state of the antenna being provided inside the metal outer casing, are compared with each other, it can be known that at least about 70% (about −3 dB) of the external radio wave is received even in the metal outer casing.

On the other hand, when the antenna is in the resonance state, the gain is reduced by as much as 32 dB in the presence of the metal outer casing. More specifically, the antenna output is lowered to about 1/40. In addition, it can be known that while the Q value of the antenna 114, when it is used independently from the metal material, it is reduced to 3 in the presence of the metal outer casing, in which an attenuation of 31 dB is indicated, i.e., a reduction ratio of is about 1/40.

From the results shown above, it can be understood that in the metal outer casing, the antenna output is significantly reduced due to the Q value being reduced, but it is not true that the external radio wave does not reach the inside of the outer casing.

The Q value representing the resonant antenna characteristics will be described hereunder.

Figure 17:
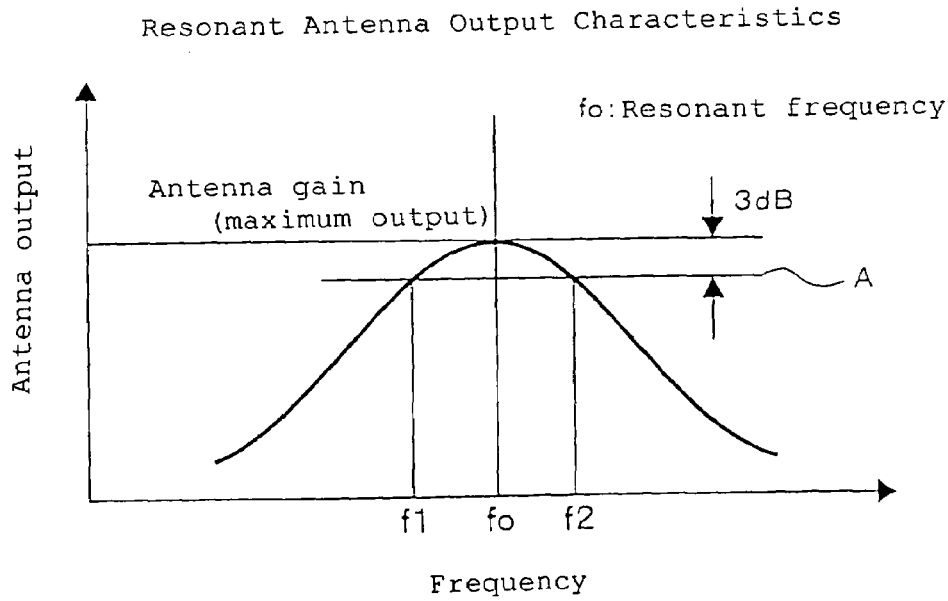
FIG. 17 is an explanatory view of a practical example of a measuring method for antenna gains and Q values according to the present invention.

FIG. 17 is a graph showing the relationship between the frequency and the antenna output. In FIG. 17, the frequency at which the antenna output is highest is indicated as a resonant frequency f0.

In addition, in FIG. 17, when the level indicated by "A" is a level lower by about 3 dB ($1/\sqrt{2}$) from the point of the highest antenna output, and the frequencies imparting the output level are represented by f1 and f2, the Q value is calculated as follows.

$$Q \text{ value} = \text{resonant frequency } f0/(f2-f1)$$

By way of another interpretation, the Q value represents the level of energy loss of the antenna in the resonant state;

when the energy loss is low, the Q value increases, in which the antenna output becomes a value corresponding to a value obtained by multiplying the antenna output substantially in the non-resonant state by the Q value.

When the relationship between the gain of the antenna used independently and the Q value on Tables 1 and 2, with respect to the Q value of 114, the resonance/non-resonance gain ratio is about 40 dB, being 100 times higher when converted.

That is, as the Q value increases, the antenna output is proportionally improved, whereby the performance required for the antenna structure is determined to be sufficient.

Concurrently, the Q value is an index representing the energy loss level.

In the present invention, increasing the Q value enables unnecessary noise to be removed from the input external radio wave. Thereby, the sensitivity to a predetermined frequency can be improved, so that a filter function can be exhibited. In this view also, the Q value is required to be high enough.

According to the above, when the antenna stored in the metal outer casing receives the external radio wave and when it is brought into the resonant state, it is understood that some what energy loss is significantly increased in comparing with the case in which the antenna is used in an independent state without accompanied by a metal material.

As a result, the Q value is reduced, and the antenna output is significantly reduced.

Then, the cause of the energy loss has been investigated in detail. From the result, it can be presumed that the magnetic flux generated by resonance is absorbed into the metal outer casing, and the magnetic-flux energy loss is caused by eddy current loss in interaction with the metal outer casing.

Accordingly, reducing the eddy current loss enables preventing the reduction in the Q value and the antenna output. Reduce the eddy current loss requires provision of the sub-magnetic path to the antenna to prevent leakage of the magnetic flux generated by the resonance to the outside of the antenna structure.

For this reason, the present invention has been made incorporating the result of research made regarding how to prevent the reduction in the Q value to secure sufficient antenna output in the case where the antenna structure 2 is disposed in contact with the metal material or in the vicinity of the metal material, thereby restraining the reduction in the antenna output substantially to non-problematic level. Basically, the results have come in the form of the antenna structure 2 that receives a radio wave. Note that the antenna structure 2 has the structure of the magnetic path 12, in which while a magnetic flux 4 generated by an external radio wave can be received, and the magnetic flux 7 generated by resonance hardly leaks to the outside of the antenna structure 2 during resonance. The magnetic path 12 is configured of a coil wound section 21 (main magnetic path) in which a conductor 11 is wound and a non-coil wound section 22 (sub-magnetic path) in which the conductor 11 is not wound. This enables easily manufacturing of the antenna structure that solves the conventional problems, that is small and thin to an extent not causing practical problems, that reduces manufacturing costs, and that is suitable for use with radio-wave using electronic devices.

The structure of the antenna structure 2 of the present invention will be described hereinbelow. Referring to FIG. 1, the antenna structure 2 has the structure in which when a predetermined radio wave has reached from the outside, while the magnetic flux 4 generated by the external radio wave is received, the magnetic flux 7 generated by resonance flows through the magnetic path 12 having the form of a closed loop like configuration, and as a result, the magnetic flux 7 hardly leaks to the outside of the antenna structure 2.

More specifically, in the antenna structure 2 of the present invention, preferably, the coil wound section 21 (main magnetic path) in the magnetic path 12 and at least a part of the non-coil wound section 22 (sub-magnetic path) therein are formed of material different from each other.

The coil wound section 21 according to the present invention constitutes a part of the magnetic path 12 and defines a portion where the appropriate conductor 11 is wound by a predetermined number of turns about an appropriate core section 9 (an antenna core of the main magnetic path) to form a coil section 8. The non-coil wound section 22 according to the present invention constitutes a part of the magnetic path 12 and defines a portion that is formed of an appropriate core section 9' of the sub-magnetic path where a coil of the conductor 11 is not wound thereabout.

More specifically, the coil wound section 21 according to the present invention has a function that causes, primarily, the magnetic flux 4 generated by the external radio wave to flow when the antenna has received the external radio wave. Additionally, the non-coil wound section 22 has a function that causes the magnetic flux 7 generated during resonance of the coil wound section 21 to primarily flow through the non-coil wound section 22.

Accordingly, for example, even if a coil of an appropriate conductor is wounded on a portion corresponding to the non-coil wound section 22, as long as the above-described function is exhibited, the portion is determined as a non-coil wound section.

For example, suppose that coil is wounded on both the coil wound section 21 and the non-coil wound section 22 and in this case, when both coils are activated to resonate, resonant phases of both coils differ from each other, so that not only the output is lowered, but also it is difficult to adjust the resonant frequencies of both coils.

Additionally, there arises the problem of increasing the volume thereof, number of components, and the like.

On the other hand, in the example described above, when the antenna of the coil wound section 21 on the output side is in the non-resonance state, a coil resistance of the non-coil wound on the section 22 is added. As such, a copper loss in the resonant state is increased causing problems in that the output is lowered, and the volume, the number of components, and the like are increased.

In lieu of only one coil, a plurality of coils may be provided in the coil wound section 21 according to the present invention.

In the present invention, regarding the antenna structure 2, to prevent disturbances in the reception of the external radio wave, the configuration should be such that, for example, an effective magnetic permeability of the non-coil wound section 22 is lower than an effective magnetic permeability of the coil wound section 21, and the effective magnetic permeability of the non-coil wound section 22 is higher that of a magnetic path in the air through which the magnetic flux generated by resonance of the coil wound section 21 in the absence of the non-coil wound section 22.

For this reason, preferably, a material of the coil wound section 21 and a material composing at least a part of the non-coil wound section 22 are different from each other.

In addition, in the present invention, a magnetic flux having entered into the coil wound section 21 and the non-coil wound section 22 flows primarily through the coil wound section 21 having a high effective magnetic permeability. Thereby, an electromotive force is generated in the coil section 8, resonance is therein generated by the electromotive force, and a magnetic flux generated by the resonance flows from the coil wound section 21 primarily to the non-coil wound section 22 having an effective magnetic permeability higher than an effective magnetic permeability of the air rather than flowing through the air. Consequently, leakage of the magnetic flux to the outside of the antenna structure is reduced.

The present embodiment may be configured such that the magnetic path, which forms the closed loop like configuration, of the antenna structure includes a part having magnetic permeability being different from that of other parts. In addition, the configuration thereof may be such that a part of the magnetic path, which forms the closed loop like configuration, of the antenna structure has magnetic resistance being different from that of other parts.

For example, it is also preferable to arrange the configuration such that the magnetic resistance of the sub-magnetic path 22 is higher than the magnetic resistance of the main magnetic path 21.

As shown in FIG. 1, still another practical example according to the present invention is such that a gap section 10 is provided in a part, which corresponds to the non-coil wound section 22 of the antenna structure 2 of the present invention, of the magnetic path 12, in which a effective magnetic permeability of the magnetic gap is smaller than that of the non-coil wound section 22.

On the other hand, as in the case of the conventional example, in a case where, for example, the antenna is placed on an outer portion of the metal outer casing or the outer casing is formed of a plastic or ceramic material to store the antenna inside thereof, the gain and the Q value of the antenna are as shown in Table 3 below.

TABLE 3

| | Antenna Separately used | Antenna mounted on a time piece |
|---|---|---|
| Gain | −31 dB | about −40 dB (about ⅓) |
| Q Value | 114 | about 40 (about ⅓) |

From the results shown in Table 3, it was known that the same problems occur not only in the case where the antenna structure 102 is disposed in contact with an object of a metal material or in the vicinity of the object, but also in the case where the antenna structure 102 is disposed in the vicinity of a metal-material object such as a battery including a solar battery, motor, movement, gear train, microcomputer, heat-sink, or dial plate, for example.

Additionally, from the results shown in Table 3, it is necessary to determine that whether or not the antenna characteristics of the timepiece of the present invention falls within a practical range, when practical antenna characteristics (gain/output) at the conventional level is attenuated in gain, for example, from about −31 dB to about −40 dB, the antenna characteristics of the timepiece of the present invention using various metal materials and used inside the metal outer casing with respect to those antenna characteristics described above.

That is, for the conventional radio controlled timepiece, in the case that the antenna is mounted inside the timepiece, a practical reception performance target of the output of the antenna is not the gain level of −30 dB in the antenna which is used separately, but is −40 dB in the case when the antenna is actually mounted on the timepiece, and that level is set as a reference target.

Figure 3:
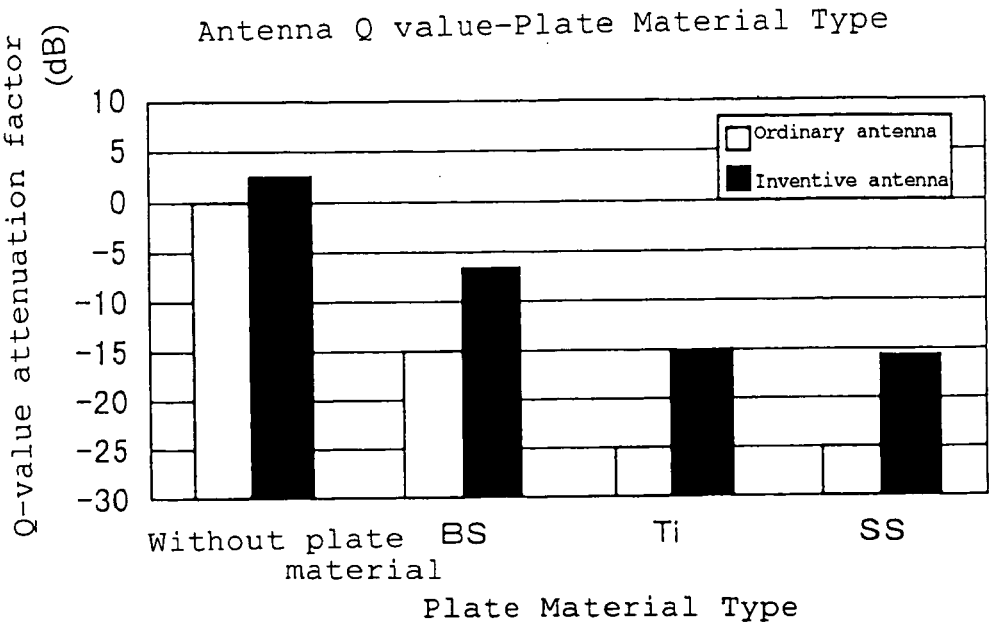
FIG. 3 is a graph showing Q values representing attenuation factors in association with influences of metal plates of the inventive and conventional antenna structures.
Figure 4:
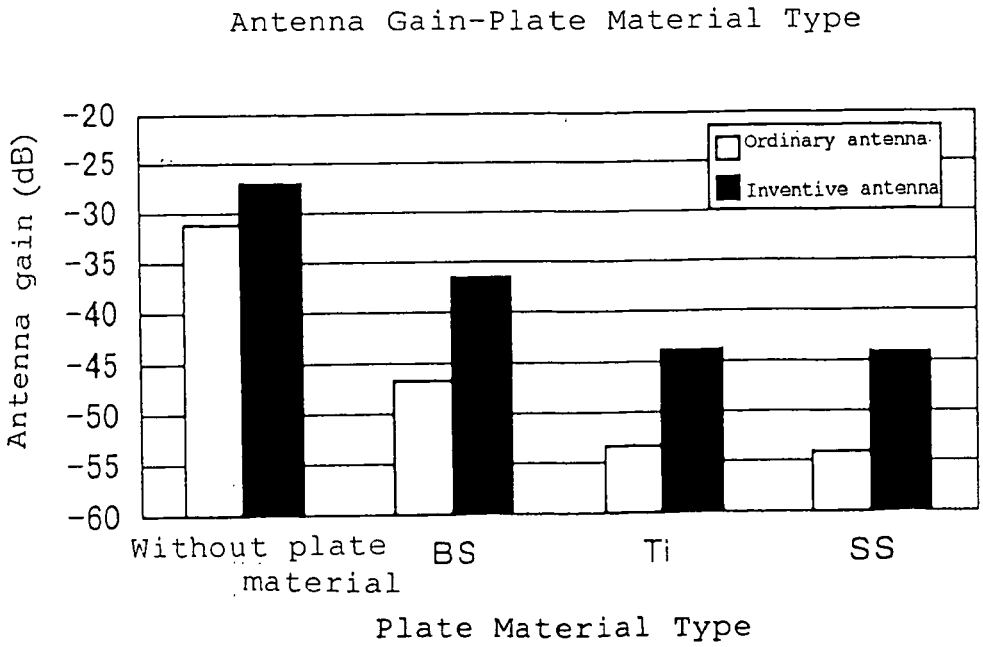
FIG. 4 is a graph showing variations in gains in association with influences of metal plates of the inventive and conventional antenna structures.

FIGS. 3 and 4 show the antenna characteristics of the conventional antennas and the antenna characteristics of the inventive antennas that are measured and compared for various metal materials used for the antennas. In particular, FIG. 3 shows attenuation factors of the Q values in the individual antennas, and FIG. 4 shows gains as antenna characteristics of the individual conventional antennas and the antennas of the present invention those being measured for comparison.

The conventional antennas shown in FIGS. 3 and 4 each have a configuration in which a conductor is wound on a linear ferrite core with 400 turns. The antennas of the present invention each having a configuration as shown in FIG. 1 in which a closed loop like configuration is formed by contacting a sub-magnetic path 22 without a wound coil with a core wound section 21 with 400 turns of a conductor wound on a linear ferrite core, and a gap of 200 μm is formed in a part of the sub-magnetic path 22.

Figure 16:
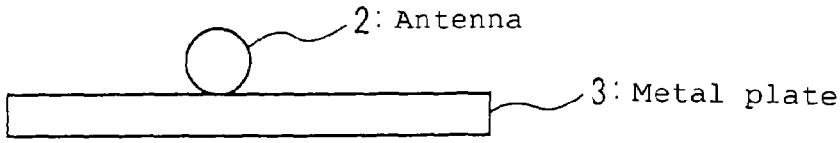
FIG. 16 is an explanatory view of a practical example of a measuring method for antenna gains and Q values according to the present invention.

The attenuation factors of gains and Q values of the antennas are individually measured, as shown in FIG. 16, by placing the antennas over plate members made of various metal materials.

More specifically, FIG. 3 shows measured Q values in cases where no metal plates of the individual antennas are present, and measured Q values in cases where the plate members is made either one of bronze (which hereinbelow will be indicated as "BS"), titanium (which hereinbelow will be indicated as "Ti"), and stainless steel (which hereinbelow will be indicated as "SUS"), and also shows attenuation factors thereof in dB. FIG. 4 shows measured gains in cases using the same samples and shows dB values thereof in the form of a reverse bar graph.

As can be understood from the results shown in FIGS. 3 and 4, it was found that the reductions in the Q values and reductions in the gains (antenna outputs) comply with one another in the cases of using the individual metal materials.

In addition, from comparison with the results shown in Table 1, it can be known that due to a make use of a metal plate, the attenuation factor of this test show about 6 dB lower than that of the case where the metal outer casing is used.

Clearly from FIG. 4, it can be understood that in the evaluation sample of the each individual material, the antenna gain (output) in the present invention is improved by about 10 dB (about three times).

As shown in Table 4, when the antenna are placed in contact with metal plates each being made of BS, SUS, and Ti, respectively, while the individual gain reductions are 1/4, 1/9, and 1/9, respectively, in the cases of the conventional antennas being used, the individual gain reductions of the antennas are 1/1.2, 1/2.8, and 1/2.8 respectively, in the cases of the inventive antennas being used, which indicate significant improvements.

TABLE 4

| Material | Conventional Antenna | Inventive Antenna |
|---|---|---|
| BS | ¼ | 1/1.2 |
| SUS | ⅑ | 1/2.8 |
| Ti | ⅑ | 1/2.8 |

Figure 5:
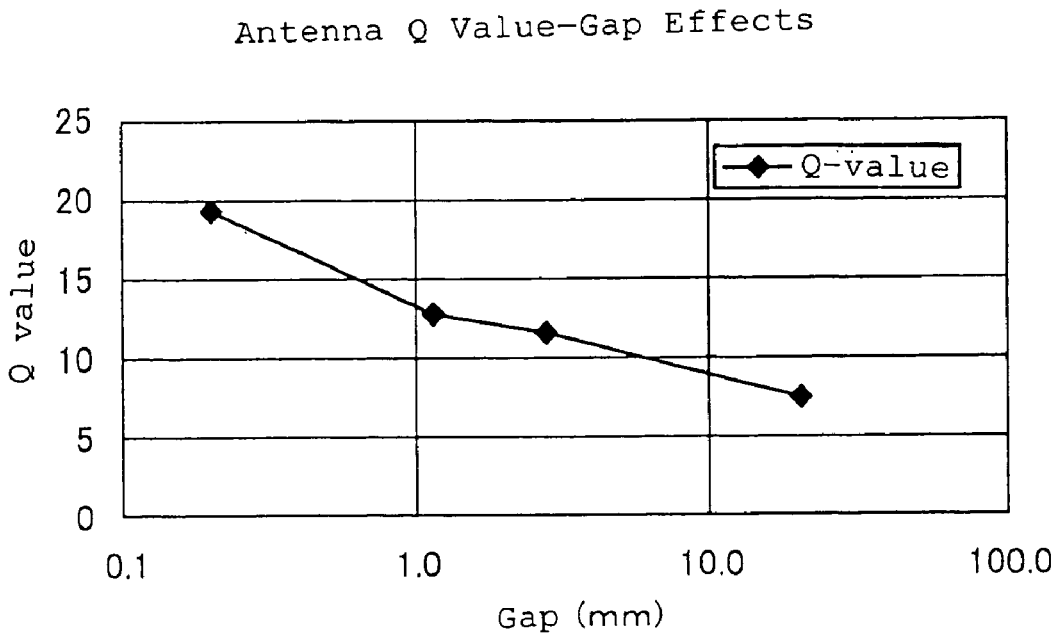
FIG. 5 is a graph showing the state of variations in a gap distance and the Q value in the event of using the practical example of the antenna structure according the present invention.

On the other hand, FIG. 5 is a graph showing the relationship between the distance of the gap and the Q value of the antenna.

As can be understood from the FIG. 5, the Q value of the antenna can be improved by adjusting the gap, so that the figure implies that also the gain of the antenna can be improved.

In addition, according to the present invention, the values can be further improved by optimizing the number of turns of the conductor.

As described above, even in the case where the antenna structure 2 of the present invention is present in contact with the metal material 3 or the metal material 3 is present in the vicinity of the antenna structure, the reduction ratio of the Q value is significantly restrained. In a practical case, the antenna structure 2 capable of exhibiting high reception performance regardless of the presence or absence of the metal material can be obtained easily and at low costs.

More specifically, according to the present invention, in the case where the metal material is present in contact with the antenna structure or the metal material is present in the vicinity of the antenna structure, the gain of the antenna structure can be improved by increasing the Q value, specifically, restraining the reduction ratio of the Q value, and the reception characteristics can be significantly improved by restraining the reduction ratio of the gain value.

More specifically, as shown in the experiment results shown in FIG. 4 and below-described experiment results shown in FIG. 26, according to the conventional antenna structure, in the case where the metal material is present in contact with the antenna structure or the metal material is present in the vicinity of the antenna structure, a reduction ratio of the gain value of the antenna structure (specifically, a reduction ratio of the gain value in a case where the metal material is present in contact with the metal material or the metal material is present in the vicinity of the antenna structure with respect to the gain value in the case where the metal material is not in contact with the metal material or the metal material is absent in the vicinity of the antenna structure) is not lower than 65%.

However, according to the present invention, it is clear that the reduction ratio of the gain value of the antenna structure is restrained to not higher than 60%, so that the antenna structure has significantly superior effects than the conventional antenna structure.

Preferably, another practical example of the antenna structure of the present invention is an antenna structure for receiving a radio wave, in which a maximum gain reduction ratio of a gain value shown by the antenna structure in a case where a metal material is present in the vicinity of the antenna structure with respect to a case where the metal object is absent in the vicinity of the antenna structure is not higher than 60%. In addition to the above-mentioned, it is preferable that, in the case where the antenna structure resonates upon receipt of the radio wave, the metal material is disposed at a distance reachable by the magnetic flux output from the antenna structure, and concurrently the metal object has the function of absorbing the magnetic flux.

More specifically, the antenna structure of the present invention is efficiently used under an environment in which a metal material is present in the vicinity of the antenna structure.

As described above, as a reduction ratio of the gain value of the antenna structure of the present invention, it is preferable that a reduction ratio of the gain value showing the highest value should be selected among the measured reduction ratio which are measured so that a plurality of metal objects composed of different metal materials are disposed in contact with the metal material or in the vicinity of the antenna structure and a gain value reduction ratio is individually measured under conditions identical to one another.

Further, the metal object for use in the present invention is such that metal objects individually composed of at least the metal materials of stainless steel (SUS), bronze (BS), titanium (Ti), and titanium (Ti) alloy are individually used, and the gain values of the antenna structure are individually measured, the maximum gain reduction ratios are calculated from the measurement results.

Alternatively, the present invention may employ a simplified measuring method in which the maximum gain reduction ratio of the gain value of the antenna structure may be a value measured under an environment in which a predetermined metal object composed of, for example, SUS, Ti, or Ti alloy is selected, and only the selected metal object is connected to the antenna structure or is disposed in the vicinity of the antenna structure.

Clearly from above description, in the present invention, a preferable practical example is such that a part of the magnetic path 12 of the antenna structure 2, which forms the closed loop like configuration, includes a part having magnetic permeability being different from that of other parts.

In addition, a preferable practical example is such that a part of the magnetic path 12, which forms the closed loop like configuration, of the antenna structure 2 includes a part having magnetic resistance being different in from that of other parts.

In the present invention, it is also preferable that the effective magnetic permeability of the non-coil wound section 22 is lower than an effective magnetic permeability of the coil wound section 21.

Figure 7:
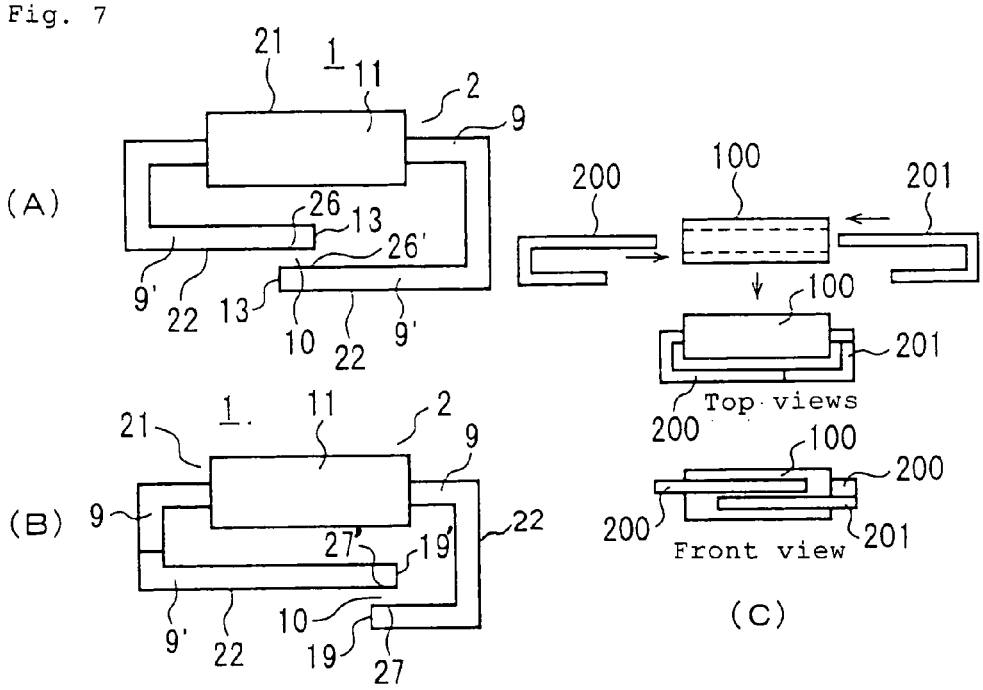
FIG. 7 is an explanatory view of an example configuration of a gap section of the antenna structure of the present invention.
Figure 18:
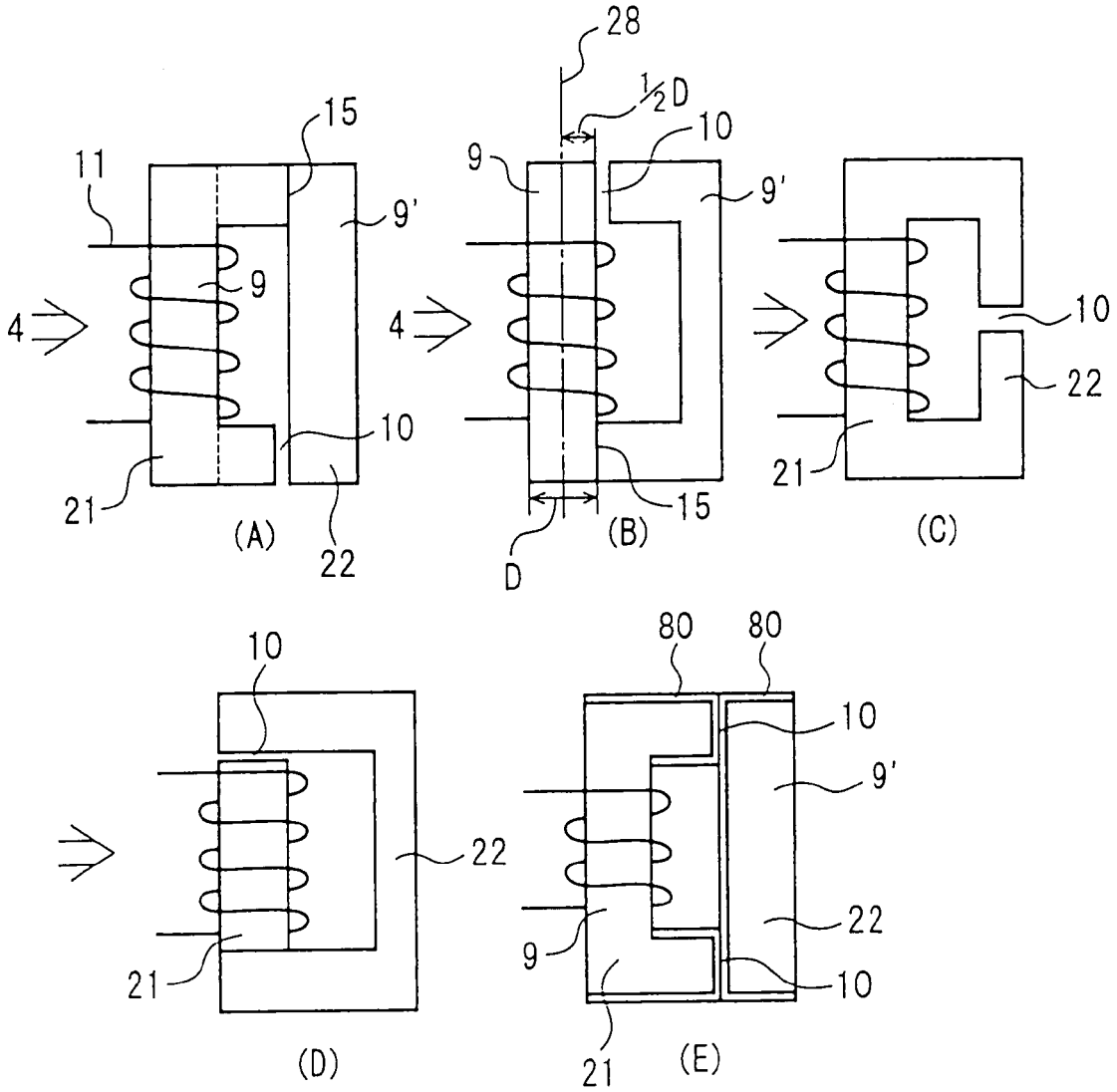
FIG. 18 shows views each showing an example configuration in the antenna structure of the present invention.

As another practical example of the antenna structure 2 of the present invention, it is preferable that, as is clear from FIGS. 1, 7, and 18, the gap 10 is provided at least in one of connection portions of the main magnetic path 21 and the sub-magnetic path 22. Alternatively preferable is that the gap 10 is formed in a part of the sub-magnetic path 22.

Figure 6:
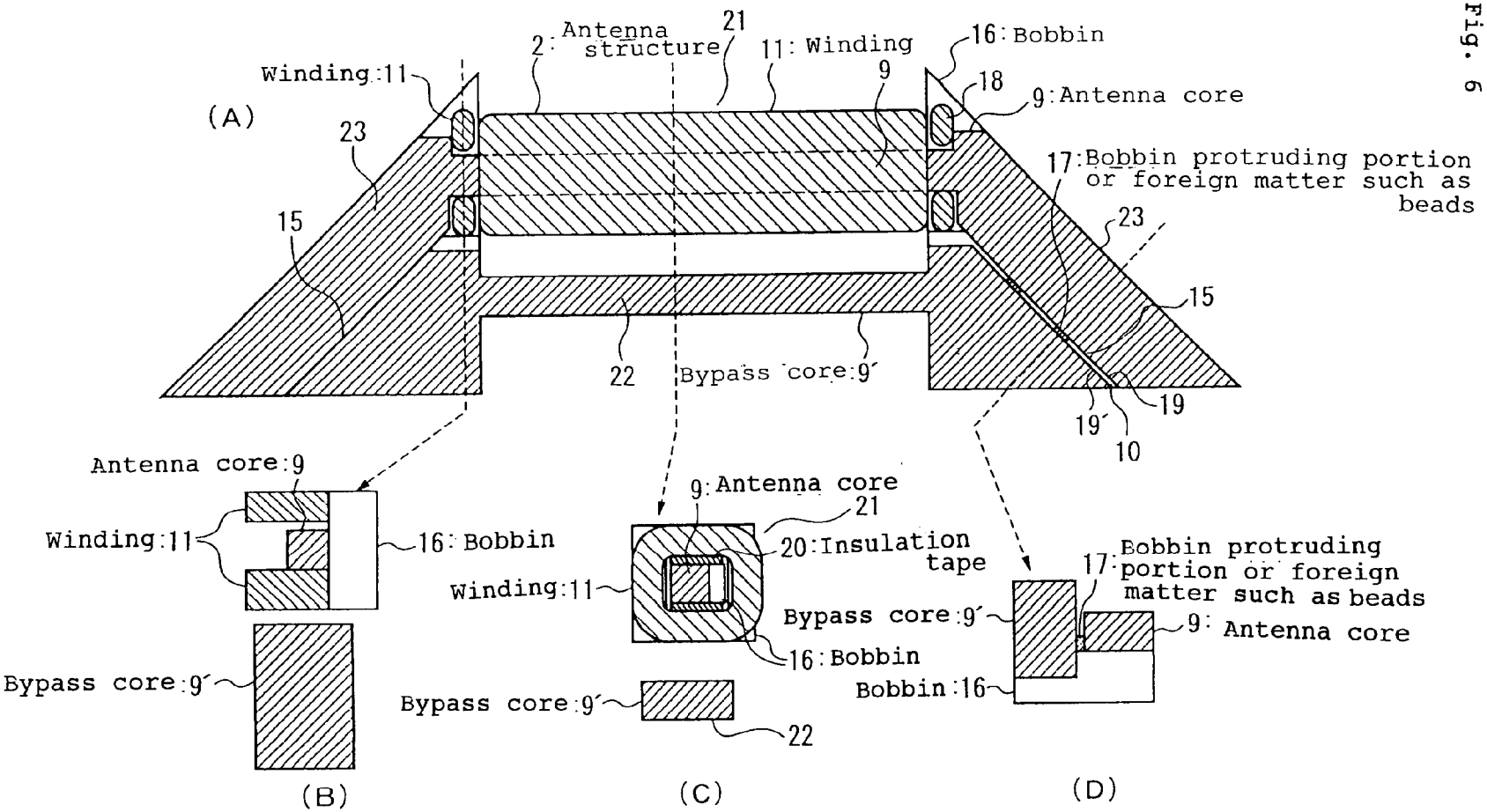
FIG. 6 is a plan view showing a practical example of the configuration of the antenna structure of the present invention.

In the practical example, the gap section 10 formed in a contacting surfaces formed between one end surface of the main magnetic path 21 and one end surface of the sub-magnetic path 22 or in the sub-magnetic path 22 is preferably formed in a tapered shape, as shown in FIG. 6.

In another aspect of the antenna structure 2 of the present invention, the gap 10 may be formed, as shown in FIG. 1, between end faces of the main magnetic path 21 and the sub-magnetic path 22 or between end faces 13 and 13 provided in the sub-magnetic path 22; or as shown in FIG. 7, the gap may be formed in a gap portion formed between opposing surfaces of the magnetic path 12 in a portion 27, which is other than the end faces 13 of the sub-magnetic path 22. Alternatively, the gap 10 may be formed in a portion where at least parts of the main magnetic path 21 and the sub-magnetic path 22 are disposed close proximity to each other and parallel to each other.

As shown in FIG. 6 by way of example, the end faces 13 of the gap 10 provided in the sub-magnetic path 22 or the contacting surfaces formed between the main magnetic path 21 and the sub-magnetic path 22 may be formed in a tapered shape.

Further, in the antenna structure of the present invention, the gap 10 may be formed in a portion of the magnetic path 12 other than the vicinity of a coil wound section 8 of the main magnetic path 21.

A material different from a material used to form the magnetic core 12 is preferably disposed in the gap.

For example, the gap 10 may be filled with the material different from the material used to form the magnetic core 12.

Alternatively, the gap 10 may be an air gap in which it is filled with the air.

Further, in the case where the gap 10 of the antenna structure is the air gap, the air gap may be formed to include an intervening spacer.

A practical example of the gap 10 according to the present invention will be described hereunder. As shown in FIG. 18(C), the gap 10 may be provided in the sub-magnetic path 22. Alternatively, as shown in FIG. 18(A) or 18(B), the gap 10 may be formed on at least one contacting portion 15 of the coil wound section 21 and the non-coil wound section 22.

Further, as shown in FIGS. 18(A) and 18(B), the gap 10 may be provided in a portion of the magnetic path 12 except for a portion in the vicinity of the coil wound section 21.

As shown in FIG. 18(D), it is not preferable that at least a part of the gap 10 is provided on the surface at which the external radio wave arrives in the antenna structure 2. For this reason, as shown in FIGS. 18(A) to 18(C), the gap 10 is preferably formed on a sidewall of the coil wound section 21 opposite to the surface thereof to which the external radio wave can arrive.

More specifically, the gap 10 may preferably be formed in such a way in that, as shown in FIG. 18(B), one end portion of the non-coil wound section 22 is closely opposed to or contacted to a surface of a part of a portion of core section 9 of the coil wound section 21 which is extending outwardly from the coil section 21 along the central axis 28 of the core portion 9 and the surface of which being positioned apart from the central axis 28 of the core portion 9 with a spaced length corresponding to the radius of the core of the antenna, and further the surface thereof being located a side of the core portion opposite to a side thereof at which the external radio wave arrives with respect to the central axis 28 of a core portion 9.

Further, as shown in FIG. 18(E), it is preferable that a film layer 80 composed of a magnetic transmuted layer, a non-magnetic layer, or a layer having a low magnetic permeability be formed on at least a part of a surface of non-coil wound section 22 or the coil wound section 21.

In this case, the gap 10 is configured only of the film layer with no an air layer interposed.

The configuration of the gap according to the present invention will be described hereinbelow in more detail.

By way of defining the gap according to the present invention, the gap portion is configured of a non-metallic material, such as a non-magnetic material, or a magnetic transmuted layer having a low permeability, and at least the main magnetic path thereof is configured of a soft magnetic material.

The soft magnetic material to be used is selected from, for example, ferrite, a stacked composite material of an amorphous metal soft magnetic material, and a composite material formed by mixing cobalt or cobalt-alloy soft magnetic material powder with resin.

As described above, for the gap according to the present invention, the width of the gap is important.

When the width of the gap is either excessively wide or narrow, adverse effects are imposed on the characteristics of the antenna structure, thereby causing the antenna to be inconvenient for use as a commercial product.

When the gap provided in the sub-magnetic path or between the main magnetic path and the sub-magnetic path is excessively wide, the closed magnetic path in a sufficient form cannot be formed by the main magnetic path and the sub-magnetic path.

Suppose that the amount of leakage of the magnetic flux occurring during resonance to the periphery of the antenna is increased, and when the antenna is hence disposed inside the metal outer casing, an energy loss is generated by interaction between the magnetic flux leaked to the periphery of the antenna and the close metal outer casing (considered to be caused mainly by eddy current loss) so as to reduce the Q value, whereby the antenna output voltage is consequently reduced to the extent of disabling sufficient effects of the present invention to be exhibited.

In contrast, in the case the width of the gap is indefinitely small so that the main magnetic path and the sub-magnetic path are integrated together, that is, in the case where the soft magnetic material used to form the main magnetic path and the sub-magnetic path is formed ringular, the main magnetic path and the sub-magnetic path form a magnetically complete closed loop like configuration, whereby leakage of the magnetic flux generated during resonance does not occur.

However, the effective magnetic permeability of the antenna (in an example antenna used for the present invention, the relative magnetic permeability was about 20 to 30, when the sub-magnetic path was not resented) becomes the magnetic permeability of the soft magnetic material used to form the main magnetic path and the sub-magnetic path (in the case of a manganese zinc ferrite used in the present invention, the relative magnetic permeability is about 1000 to 2000).

In this case, since the inductance of the antenna is proportional to the effective magnetic permeability of the antenna, the inductance is significantly increased to be about 10 to 100 times higher. When the inductance is thus significantly increased, parasitic capacitance is formed in the coil section of the antenna, so that the self-resonant frequency is significantly reduced (to a 1/5 to 1/10 frequency). As such, the resonant frequency cannot be adjusted to a desired frequency (reception frequency) by using an external resonant capacitance.

Reducing the number of turns of the coil to increase the self-resonant frequency enables the resonant frequency to be adjusted to a desired frequency. However, the number of turns of the coil should be reduced to about one tenth, whereby the antenna output voltage proportional to the number of turns of the coil is reduced.

In addition, when the complete closed loop like configuration, is formed, a large amount of the magnetic flux of the external radio wave received by the antenna flows to the side of the sub-magnetic path. This consequently reduces the amount of the magnetic flux that contributes to the antenna output voltage. Also in this case, the effects of the present invention cannot be exhibited.

As such, the width of the gap should be controlled to an appropriate value.

To cause sufficient effects of the present invention to be exhibited, the width of the gap of the sub-magnetic path should be adjusted to reduce the amount of leakage of the magnetic flux occurring during resonance to the periphery of the antenna to a level where the reduced antenna output voltage is not problematic (a target level was set so that the reduction in the antenna output voltage in association with the mounting of the antenna in the metal outer casing is restrained to 50% or lower).

Concurrently, the width of the gap should be set so that the self-resonant frequency thereof can be set to have the self-resonant frequency being higher than a desired frequency (reception frequency) by adjusting the resonance frequency to a desired frequency (receiving frequency) by utilizing an external resonance capacitance to direct the magnetic flux inputting to the antenna to largely flow to the main magnetic path having the coil being wound.

In other words, the magnetic resistance of the sub-magnetic path inclusive of the gap is adjusted and set to be high in an appropriate range, relative to the magnetic resistance of the main magnetic path.

From the results of prototype production and evaluation, we learned that the above setting should be made such that, with respect to the effective magnetic permeability of the antenna in the case where the sub-magnetic path is not provided, the effective magnetic permeability of the antenna should be set at 2 to 10 times higher than that in a case in which the sub-magnetic path is not used, and preferably to be 4 to 8 times higher. In other words, with respect to the inductance of the antenna in the case where the sub-magnetic path is not provided, the setting should be made with the sub-magnetic path being provided so that the inductance of the antenna is 2 to 10 times higher, and preferably 4 to 8 times higher.

The setting as described above can be made by adjusting, for example, the shape of the main magnetic path, the shape of the gap provided in the part of the sub-magnetic path or between the sub-magnetic path and the main magnetic path, and/or magnetic characteristics of the material constituting the gap.

The setting will be described hereinbelow in further detail. The setting in the present case is, resultantly, adjusting and setting of the effective magnetic permeability or inductance of the present invention. The adjusting and setting thereof result in moderately increasing the effective magnetic permeability or inductance of the antenna to cause the effects of the present invention to be sufficiently exhibited. Methods of the setting are, for example, increasing the size of the main magnetic path having the coil-wound section or increasing the number of turns of the coil; and enlarging the shape of the gap, that is, the area of the gap, or reducing the width of the gap; and changing the material type to modify the magnetic characteristics of the material used to form the gap, particularly, the relative magnetic permeability thereof within the magnetic permeability of the soft magnetic materials used to form the main magnetic path and the sub-magnetic path from the magnetic resistance point of view. These methods enable the effective magnetic permeability and inductance of the antenna to be adjusted and set to be significantly high.

Nevertheless, however, for such an antenna as that of the present invention for use with the radio controlled timepiece, since the antenna is needed to be stored in the outer casing of the timepiece, limitations of external dimension of the timepiece exists. As such, preferable methods to be employed are decreasing the gap width that is free of the outside-dimension limitations or adjusting the magnetic characteristics of the material used to configure the gap.

In the gap-width adjusting/setting method, when performing setting adjustment to enable sufficient effects of the present invention to be exhibited, the width of the gap with respect to an opposing area of several square millimeters should be adjusted and set to 1 mm or smaller than 1 mm and preferably to 0.2 mm or smaller and should be stably maintained therein. When the adjustment setting to the above-described width of the gap and stable maintenance therein cannot be accomplished, there occurs increased manufacturing non-uniformity and there introduce time dependent variations in the reception characteristics (digital output) of the antenna.

Examples of practical methods for forming the gap discussed in the present invention will now be described in detail hereunder.

According to a first method, appropriate jigs are used to determine the positions of the main magnetic path and the sub-magnetic path, and the width of the gap is determined, and an adhesive is cast into the gap portion in that state, whereby a fixed integral gap portion is obtained.

Figure 29:
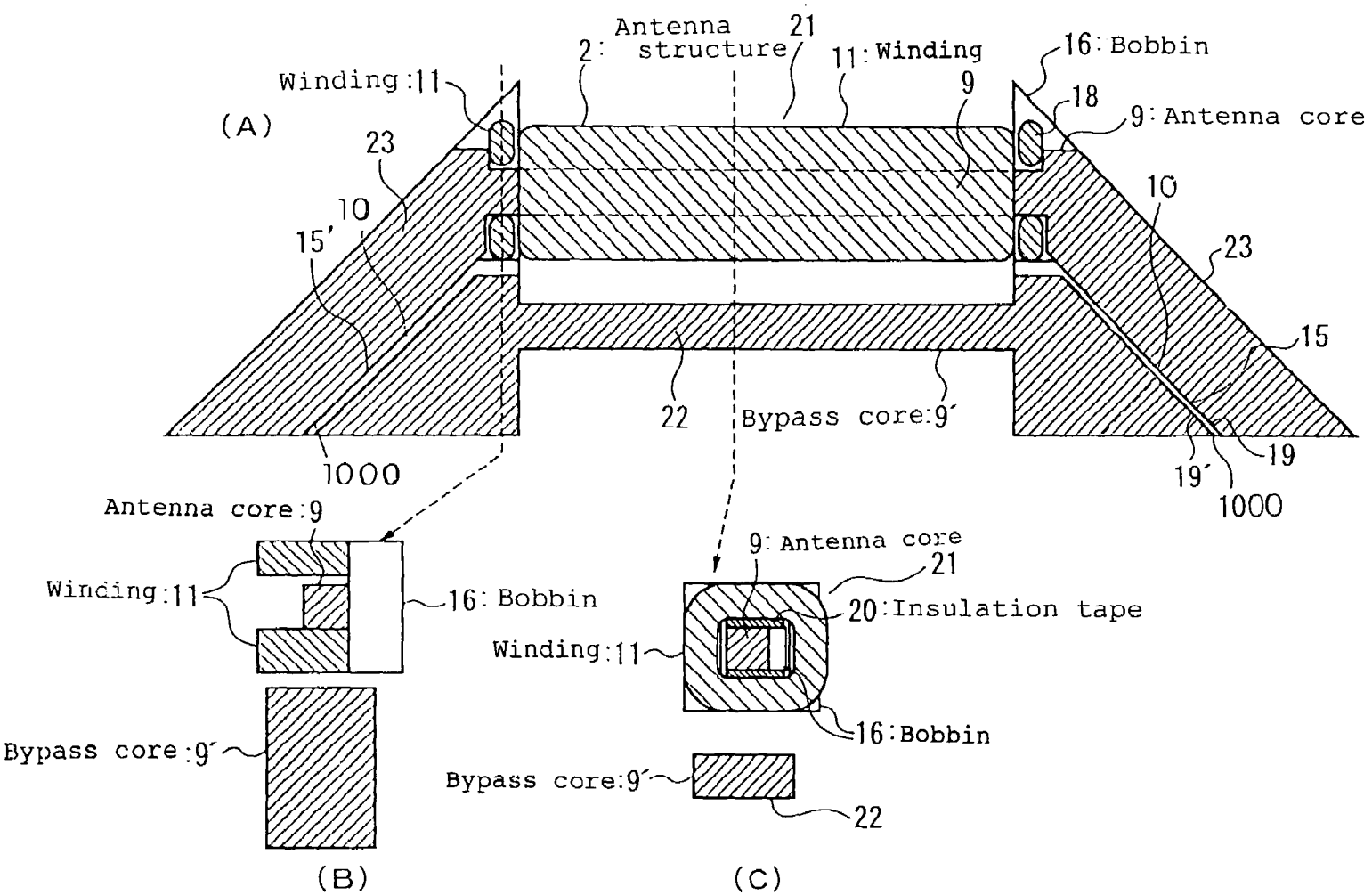
FIG. 29 is a view showing another practical example of the configuration of an antenna structure of the present invention.

For example, as shown in FIG. 29, the gap 10 is formed in the manner that an adhesive material 1000 such as an appropriate adhesive, an adhesive composed with an appropriate fibrous spacer being mixed, or a double-sided adhesive tape is inserted into one or both of a spacing portion or portions formed in the contacting portions 15 and 15'.

In the present invention, usable adhesives are, for example, generally used organic adhesives, such as epoxy based adhesives, urethane based adhesives, silicon based adhesives, acryl based adhesives, nylon based adhesives, cyanoacrylate based adhesives, rubber based adhesives, urea-resin based adhesives, melamine-resin based adhesives, and vinyl based adhesives.

According to a second method for forming the gap, as shown in FIG. 6 an adhesive formed by mixing fillers as used for a spacer such as glass or resin beads having identical diameters or shortly cut fibrous resin fillers is coated on faces forming gaps 15 and/or 15' of the main magnetic path and the sub-magnetic path. Thereafter, the faces are pushed and bonded together, and the gap width is set substantially at the length as the same as the diameter of the used spacer, whereby a fixed integral gap portion is obtained.

According to a third method for forming the gap, a resin film having a uniform thickness is sandwiched inside the gap as a spacer, the main magnetic path and the sub-magnetic path is fixed to each other in an engaged state via the spacer by means of screwing or the like to the antenna mounting position of the radio controlled timepiece.

According to a fourth method for forming the gap, using protruding portions 17 formed as spacers in an antenna-structure supporting bobbin 16, the main magnetic path and the sub-magnetic path are individually brought into contact with the protruding portions 17, and then are fixed in that state, whereby the width of the gap is set.

By way of a fifth method for forming the gap, the method may be such that a double-sided adhesive tape in which an adhesive material or an adhesive is coated on both sides thereof is sandwiched between opposing faces of the main magnetic path and the sub-magnetic path to adherently fix the main magnetic path and the sub-magnetic path together, and concurrently, the width of the gap is set corresponding to the thickness of the double-sided tape.

In addition, as already described above, the gap 10 may be such that the opposing faces of the gap between the main magnetic path and the sub-magnetic path are each formed in a tapered shape. Alternatively, the gap 10 may be provided in each of two contacting portions of the main magnetic path and the sub-magnetic path.

In forming the gap according to the present invention, in the case of a ferrite-based sintered material, such as a manganese-zinc based ferrite, is used as the soft magnetic material forming the main magnetic path and the sub-magnetic path, even when the main magnetic path and the sub-magnetic path are placed in intimate contact with each other, the performance in that case is different from that in the case where a metallic soft magnetic material, such as a magnetic-annealed permalloy is used.

Note that this embodiment does not show variations in the effective magnetic permeability or inductance of the antenna, which is presumed from the relative magnetic permeability of about 1000 to 2000 known from the evaluation result of the ringular evaluation samples, and the result just showed an increase of about several-fold to ten-fold in the effective magnetic permeability or the inductance, although it depends on the shapes of the main magnetic path and the sub-magnetic path. From the results, it is considered that, in the case of the ferrite-based sintered material, for some reasons, such as deviation in composition from the chemical equivalent, the inherent magnetic characteristics do not take place on the material surface at the time of sintering, and a thin magnetic transmuted layer having low magnetic permeability of about several tens of μm is formed thereon. This transmuted layer is considered to have the function of the gap in the present invention.

Generally, many types of soft magnetic materials exhibit structural sensitivity (of a crystal structure).

For example, for the permalloy, when processes such as a rolling or cutting process is applied thereto, the crystal structure on the entirety of the material or a surface near a portion undergone the cutting process becomes inhomogeneous and hence deteriorates in the magnetic characteristics. As such, recovery should be done for the magnetic characteristics by applying magnetic annealing after the above-described process to eliminate distortions in the crystal structure. In the case of a ferrite based material also, phenomena similar to the above are considered to occur from the fact that it is widely known that, for example, the magnetic characteristics is deteriorated on a portion near a surface to a grinding process has been undergone, and/or the magnetic characteristics deteriorate because of deviation from the chemical equivalent of added metal.

Figure 28:
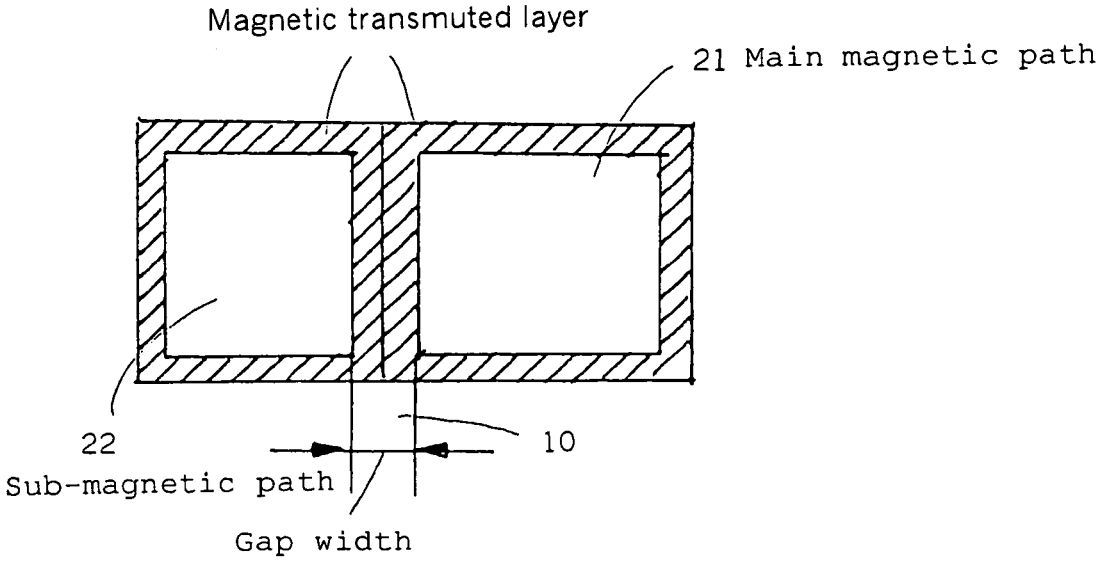
FIG. 28 is a view showing another practical example of the configuration of an antenna structure of the present invention.

Because of the above, in the case where the ferrite-based sintered material is used as the soft magnetic material to form the main magnetic path and the sub-magnetic path, when, as shown in FIG. 28, the main magnetic path 21 and the sub-magnetic path 22 are disposed in intimate contact with each other, the gap is not formed in appearance. However, the main magnetic path 21 and the sub-magnetic path 22 are magnetically connected together via the magnetic transmuted layer 300 disposed on a surface thereof which sets the width of the gap 10. As such, in the case where the ferrite-based sintered material is used to form the main magnetic path and the sub-magnetic path, the effective magnetic permeability or the inductance are enabled to be adjusted and set in the manner that the main magnetic path and the sub-magnetic path are brought into intimate contact with each other without the gap being formed in appearance.

In the above case, the width of the gap is set in the manner in which the main magnetic path and the sub-magnetic path are fixedly contacted with each other, after adhesive coating, or the adhesive is cast with a dispenser or the like for adhesion in the state of the both magnetic paths being fixedly engaged.

Further, according to the present invention, the configuration may be such that cross-sectional areas of the coil wound section 21 and the non-coil wound section 22 are different from each other. In addition, the configuration may be employed in which the coil wound section 21 and the non-coil wound section 22 form configuration units which are independent of each other. In this case, the coil wound section 21 and the non-coil wound section 22 are integrally contacted to each other after the coil 8 is formed by winding the conductor 11 about the coil wound section 21.

As described above, even in the case where the antenna structure 2 of the present invention is present in contact with the metal material or the metal material is present in the vicinity of the metal material, the reduction ratios of the Q value and the gain value are significantly restrained. In a practical case, the antenna structure 2 capable of exhibiting high reception performance can be obtained easily and at low costs, regardless of the presence or absence of the metal material.

In the present invention, the frequency of the objective radio wave that the antenna structure 2 can receive is the radio wave including a long wave having a frequency of 2000 KHz or lower.

Preferably few 10 KHz to few hundreds KHz long wave.

Preferably, the metal outer casing 3 of the present invention, is configured of at least one member selected from a structure that is capable of storing the antenna structure 2 inside the structure and that is formed of a side section and a bottom cover section which are made of a metal material and a structure that is capable of storing the antenna structure inside the structure and that is formed of a side section and a bottom cover section which are integrally made of a metal material.

More specifically, the metal outer casing 3 used in the present invention is formed using a metal outer casing material having electro-conductivity, such as SUS, BS, Ti, or Ti alloy, or gold, silver, platinum, nickel, copper, chromium, aluminum, or alloy thereof.

The metal outer casing material in the present invention is preferably BS, SUS, or Ti.

A practical example of the metal outer casing 3 disposed in the vicinity of the antenna structure 2 of the present invention is, for example, an outer casing section inclusive of a bottom cover section and a side section, a dial plate, a motor, a movement, a battery, a solar battery (particularly, SUS-substrate solar battery), a wristband, or a heat sink of a timepiece.

A practical example of a measuring method of the gain and the Q value in the present invention will be described hereinbelow.

Figure 14:
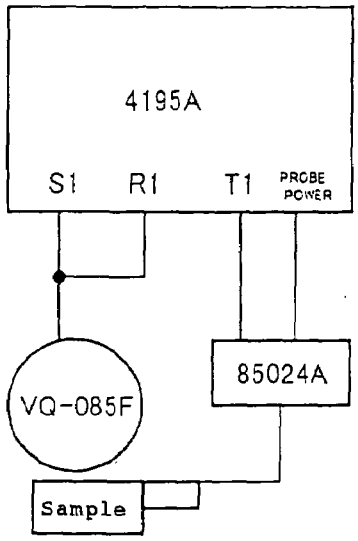
FIG. 14 is an explanatory view of a practical example of a measuring method for antenna gains and Q values according to the present invention.

As shown in FIG. 14, an antenna evaluation circuit is configured by connecting a network analyzer (4195A) supplied by Hewlett-Packard Co. (HP), a high frequency probe (85024A) supplied by Hewlett-Packard Co. (HP), and a transmission antenna (test loop like configuration, 75Q, VQ-085F) supplied by National (Matsushita Electric). The high frequency probe (85024A) for connecting a measurement target antenna and a sample support section are disposed near the transmission antenna (test loop like configuration, 75Q, VQ-085F), and the predetermined measurement target antenna is set on the sample support section. Thereafter, the transmission antenna (test loop like configuration, 75Q, VQ-085F) is used to transmit a predetermined radio wave, the output of the measurement target antenna is detected by the high frequency probe (85024A), and the network analyzer (4195A) is used to perform a predetermined antenna evaluation.

Figure 15:
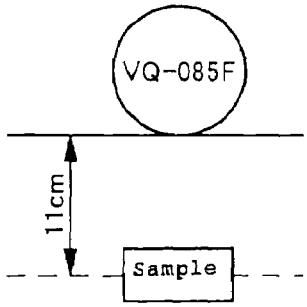
FIG. 15 is an explanatory view of a practical example of a measuring method for antenna gains and Q values according to the present invention.

In the evaluation apparatus, as shown in FIG. 15, the distance between the measurement-target antenna structure 2 and the transmission antenna (test loop like configuration, 75Q, VQ-085F) is set in such a manner that an evaluation reception antenna is disposed in a position spaced apart at 11 cm from a lower end of the transmission loop like configuration and the evaluation of a target antenna structure is performed with this apparatus.

And concurrently as shown in FIG. 16, the measurement is also performed in the apparatus in which the measurement-target antenna structure 2 and the metal outer casing 3 are brought into contact with each other.

As metal materials for the metal outer casing 3 used in the present practical example, 5 mm thick plate materials of SUS, Ti, and a Ti alloy, and BS were use.

In the practical example, when measuring a 40 KHz resonant antenna, the frequency of the radio wave transmitted from the transmission antenna (test loop like configuration, 75Q, VQ-085F) was changed in the range of 20 to 60 KHz.

A method for measuring the gain and the Q value of the 40 KHz resonant antenna by using the measurement apparatus will be described hereunder with reference to FIG. 17.

The frequency is caused to sweep at 20 to 60 KHz from the network analyzer (4195A) to the transmission antenna (test loop like configuration, 75Q, VQ-085F), with a constant output, and then the output of the measurement-target antenna 2 is monitored via the high frequency probe (85024A), and an output result as shown in FIG. 17 is obtained.

In this case, the gain of the antenna is represented by the ratio between the input voltage amplitude to the transmitting antenna and the output voltage amplitude of the measurement target antenna. In FIG. 17, the frequency at which the antenna output is highest is indicated as a resonant frequency (f0), and the value of the above-described ratio at the time when the antenna output is highest is indicated as the antenna gain.

As described above, f1 and f2 were obtained from the measurement result, and Q values were calculated.

The results are shown in FIGS. 3 and 4.

Referring to FIG. 3, with the Q value of the conventional antenna being used as a reference, the measurement results are shown by way of attenuation factors (dB representation).

As is clear from the experiment results described above, it can be understood that the antenna structure 2 of the present invention is the useful antenna that apparently solves the conventional problems.

FIG. 4 shows gains in dB in the case where the antenna structure according to the present invention and the conventional antenna structure as shown in FIG. 2, were measured under the same environment as that in the case of FIG. 3. In the case where any one of the metal materials is used, a good value regarding the gain is shown, compared to the conventional antenna.

In addition, as shown in FIG. 5, the Q-value improvement degree depends on the gap and thus the effective magnetic permeability of the non-coil wound section 22 is higher and the leaked magnetic flux is reduced as the gap is narrower. Accordingly, the narrower the gap, the higher the Q value is.

However, non-uniformity occurs in manufacturing steps, so that managing the gap at a constant narrow interval is important.

A practical example configuration for implementing the antenna structure 2 of the present invention will be described hereunder.

Preferably, the antenna structure 2 of the present invention has the configuration shown in FIG. 1, for example. More specifically, a magnetic core 6 (core section) constituting a magnetic path 12 in which a winding 11, i.e., a coil, is provided is extended from two end portions thereof and is bent, and end faces 13 and 13' thereof are opposed in proximity to each other to form a loop like magnetic path.

In the present practical example, the small gap, that is, the gap 10, is preferably provided in opposing sections 14 of the end portions of the magnetic core 6.

As described above, the gap 10 may be of the type in which the air is interposed, or may be of the type in which an appropriate filler material is interposed, or may be of the type in which, for example, a resin film layer or the like is interposed.

And further it may be a type in which suitable spaces are interposed in the gap.

As such, the gap 10 portion has a magnetic resistance higher than the magnetic path, thereby forming a portion having magnetic resistance being different from that of other portion, in a part of the closed loop like configuration of the magnetic path 12 (core 6).

In the antenna structure 2 of the present invention, since the antenna structure is formed substantially in the loop like configuration with the gap 10 being present, a magnetic flux input from the outside enters into the antenna from both ends of the antenna does not flow to the gap 10 (the magnetic resistance is at an intermediate level), but flows to the winding 11 having a lower magnetic resistance.

As already described above, the winding 11 magnetically influenced converts magnetic variations into voltage, and generates a resonance phenomenon according to the L value of the antenna and a tuning condenser, thereby generating the magnetic flux according to the resonance. In this case, the magnetic flux generated by the resonance phenomenon of the antenna does not leak into the air, but flows to the gap portion having the low magnetic resistance.

The above enables reducing the loss caused in the case where the antenna is contained in the metal outer casing.

In other words, since the magnetic path 12 of the antenna structure 2 forms the closed magnetic path, a flow of the magnetic flux 7 generated by resonance output from the antenna structure 2 while the antenna structure 2 is resonating is directed primarily along the loop like magnetic path 12, as shown in FIG. 1. This prevents leakage of the magnetic flux from the antenna structure 2 to the metal outer casing 3, which is composed of the metal material, consequently avoiding causing eddy current and thereby reducing the energy of the magnetic flux because of leakage of the magnetic flux to the metal outer casing 3.

As shown in FIG. 1, in a case in that the magnetic path 12 (core 6) of the antenna structure 2 is the integral configuration of the main-magnetic-path antenna core section 9 of the coil wound section 21 and the sub-magnetic-path antenna core section 9' of the non-coil wound section 22, when manufacturing the antenna. In this case, the winding wire 11 needs to be wound about the main-magnetic-path antenna core section 9, constituting the coil wound section 21, through the spacing of the gap 10.

Alternatively, the winding wire 11 needs to be wound on the main-magnetic-path antenna core section 9, constituting the coil wound section 21, by using a closed spacing portion formed between the coil wound section 21 and the non-coil wound section 22. Consequently, productivity in this case is reduced.

As such, the main-magnetic-path antenna core section 9 of the coil wound section 21 and the sub-magnetic-path antenna core section 9' of the non-coil wound section 22 are provided independently of each other. In production, at the stage of performing coil winding on the main-magnetic-path antenna core section 9 of the coil wound section 21, the sub-magnetic-path antenna core section 9' of the non-coil wound section 22 is not mounted, but the sub-magnetic-path antenna core section 9' of the non-coil wound section 22 is mounted after completion of the winding operation. This enables the production efficiency of the winding to be significantly improved.

That is, as shown in FIG. 6, according to the present invention, the main-magnetic-path antenna core section 9 of the coil wound section 21 and the sub-magnetic-path antenna core section 9' of the non-coil wound section 22 are provided independently of each other, and the two sections are connected to each other after completion of the winding operation.

The above is one preferable practical example according to the present invention, the configuration is formed such that the magnetic resistance of the non-coil wound section 22 is higher than the magnetic resistance of the coil wound section 21.

In addition, in the present invention, the gap 10 may be formed in the non-coil wound section 22 or, as shown in FIG. 6, between the non-coil wound section 22 and the coil wound section 21, that is, in at least one of the two contacting portions 15 and 15'.

By way of another practical example of the present invention, it is also a preferable practical example in which cross-sectional areas of the coil wound section 21 and the non-coil wound section 22 are different from each other.

That is, as shown in FIG. 6, the configuration is such that the cross-sectional area of the coil wound section 21 is smaller than the cross-sectional area of the corresponding non-coil wound section 22.

As shown in the drawing, for the coil wound section 21, the winding wire 11 should be wound thereabout, so that when the cross-sectional area of the coil wound section 21 is large, the cross-sectional area is proportionally enlarged after the winding operation is completed whereby, for example, to increase the thickness of the timepiece.

Consequently, this arises the problem of disabling a thin timepiece to be manufactured.

As shown in FIG. 6, in the antenna structure 2 of the present invention, the coil wound section 21 and the non-coil wound section 22 are formed as configuration units independent of each other. The coil wound section 21 and the non-coil wound section 22 are integrally connected to each other after the conductor 11 is wound about the coil wound section 21.

As described above, the gap 10 is formed in the at least one contacting portion 15 of the coil wound section 21 and non-coil wound section 22 of the antenna structure 2. For the gap 10 formed between the coil wound section 21 and the non-coil wound section 22, a predetermined spacing can be fixed by inserting appropriate spacers 17 along the contacted surfaces 15 formed of end faces of the main magnetic path 21 and the sub-magnetic path 22.

The spacer 17 may be formed using a foreign material such as beads, or alternatively, protruding portions 17 may be used that are formed on the support bobbin 16 provided to support the antenna structure 2.

More specifically, in the present practical example, the spacing length of the gap 10 formed between the contacted surfaces 15 of the main-magnetic-path antenna core section 9 of the coil wound section 21 and the sub-magnetic-path antenna core section 9' of the non-coil wound section 22 is positionally determined by interposing the protruding portions 17 pre-formed on the support bobbin 16 or separately disposed spacers 17 whereby to improve gap precision of the spacing.

As shown in FIG. 5 discussed above, as is clear from the variations in the gain of the antenna with respect to the spacing distance of the gap 10, there gives rise to a problem in that gain variations take place depending on the gap spacing distance.

Thus, the bobbins and spacers 17, for example, or film layer 80 as shown in FIG. 18(E), are interposed into the spacing formed between the core section 9 of the main-magnetic-path of the coil wound section of the antenna core and the sub-magnetic-path antenna core section 9' of the non-coil wound section 22.

Thereby, an error in the distance precision of the gap 10 is a dimensional precision error of the foreign matters, such as the protruding portions of the bobbin or the spacers, whereby to enable to stabilize the antenna gain.

In addition, in the antenna structure 2 of the present invention, the contacted surface 15 formed by the end faces 19 between the coil wound section 21 and the non-coil wound section 22 is preferably formed in a tapered shape.

More specifically, the contacted surface 15 of end faces 19 forming the gap 10 formed between the coil wound section 21 and the non-coil wound section 22 is thus formed in the orthogonal state with respect to the winding 11. This consequently increases the area of the gap 10.

In the case where the above-described configuration is employed, the adjustment in the spacing distance of the gap 10 is enabled to easily be implemented in the manner that the sub-magnetic-path antenna core section 9' of the non-coil wound section is shifted in a push-in or draw-out direction against the main magnetic path antenna core 9 of the coil wound section.

In addition, according to the configuration, non-uniformity in the antenna gain is caused by influences of variations in the magnetic resistance value between the main-magnetic-path antenna core section 9 of the coil wound section 21 and the sub-magnetic-path antenna core section 9' of the non-coil wound section 22. In this case, as the contact plane in the gap portion is enlarged, the variation rate of the antenna gain to the gap spacing distance is moderated, therefore making it advantageous to increase the area of contact of the gap portion.

More specifically, with the configuration formed as in the present practical example, the area of contact in the gap portion can be increased $\sqrt{2}$ times larger than in the case in which the area of contact is in parallel to the winding 11, so that the non-uniformity of the antenna gain can be reduced.

Referring to FIG. 6, numeral 18 denotes a winding frame used when winding the winding wire 11 about the main-magnetic-path antenna core section 9 of the coil wound section 21. Numeral 20 denotes an insulation material that is inserted between the main-magnetic-path antenna core section 9 and the winding wire 11, when the antenna core of the coil wound portion 21 has conductivity.

The gap 10 according to the present invention may be formed so that the end faces of the coil wound section 21 and the non-coil wound section 22, or the surfaces of the individual magnetic paths in a portion except for the end faces of the non-coil wound section 22 are oppositely faced to each other.

As shown in FIG. 7(A), in the case that the gap 10 is formed in a portion of the sub-magnetic-path antenna core section 9' of the non-coil wound section 22, the gap 10 may be formed in a way such that the mutually opposing end faces 13 of the sub-magnetic-path antenna core section 9' of the non-coil wound section 22 are not directly opposed to each other, but at least parts of each one of the end faces 13 are placed to overlap with each other, and surfaces 26 and 26' of the individual magnetic paths in portions except for the end faces 13 of the non-coil wound section 22 are formed opposite each other, so as to define the gap 10.

On the other hand, as shown in FIG. 7(B), in the case that the gap 10 is formed between an end face 19 of the antenna core section 9 of the coil wound section 21 and an end face 19' of the sub-magnetic-path antenna core section 9' of the non-coil wound section 22, the configuration thereof may be such that the mutually opposing end faces 19 and 19' of the sub-magnetic-path antenna core section 9' of the non-coil wound section 22 and of the antenna core section 9 of the coil wound section 21, respectively, are not placed to oppose to each other, but the end faces 19 and 19' are placed to overlap with each other, and a portion 27' other than the end face 19' of the non-coil wound section 22 and a portion 27 other than the end face 19 of the coil wound section 21 are formed opposite each other, so that the gap 10 is formed between the portions 27 and 27'.

In addition, as shown in FIG. 7(C), the configuration may be such that a coil 100 formed in an air-core coil or a bobbin and two antenna cores 200 and 201 each formed in an "L" shape are rendered to be arranged oppositely, and the antenna cores are separately inserted into central positions of the coil 100 from both end portions thereof so that potions of the two are disposed opposite each other.

On the other hand, in the antenna structure 2 of the present invention two side sections 23 of portions constituting the main-magnetic-path antenna core section 9 of the coil wound portion may be formed tapered or to have a curved face formed of an appropriate curved lines or a line consisting a plurality of short linear lines.

In this case, the configuration can be such that the side sections 23 are matched with the circumference shape of the timepiece and the coil wound section 21 of the antenna structure 2 can be disposed in a circumference portion inside the outer casing of the timepiece within a possible range.

Further, in the present invention, the configuration may be such that the cross-sectional area or the thickness of the sub-magnetic-path antenna core section 9' of the non-coil wound section in the antenna structure is larger than the cross-sectional area or the thickness of the main-magnetic-path antenna core section 9 of the coil wound section.

As already described above, to reduce the magnetic resistance between the main-magnetic-path antenna core section 9 of the coil wound section and the sub-magnetic-path antenna core section 9' of the non-coil wound section, the cross-sectional areas or the thickness of the sub-magnetic-path antenna core section 9' of the non-coil wound section and the main-magnetic-path antenna core section 9 of the coil wound section are preferably large. However, since the winding section 11 is provided in the main-magnetic-path antenna core section 9 of the coil wound section, when the cross-sectional area or the thickness of the main-magnetic-path antenna core section 9 of the coil wound section is large, the thickness of the antenna structure 2 is correspondingly increased thereby.

Nevertheless, however, the sub-magnetic-path antenna core section 9' of the non-coil wound section does not have the winding section 11, so that the cross-sectional area and a thickness of the coil wound section 11 can be formed larger than those of the main-magnetic-path antenna core section 9 of the coil wound section.

According to the configuration thus formed, the magnetic resistance value between the main-magnetic-path antenna core section 9 of the coil wound section and the sub-magnetic-path antenna core section 9' of the non-coil wound section can be reduced, an even larger amount of the magnetic flux generated by resonance can be introduced to the sub-magnetic-path antenna core section 9' of the non-coil wound section, and non-uniformity of the antenna gain can be restrained.

Preferably, the sub-magnetic-path antenna core section 9' of the non-coil wound section is disposed inwardly of the main-magnetic-path antenna core section 9 of the coil wound section with respect to the traveling direction of the radio wave. Thereby, the configuration is formed such that the main-magnetic-path antenna core section 9 of the coil wound section is formed in such a way as to coat the sub-magnetic-path antenna core section 9' whereby not to allow the radio wave to reach the sub-magnetic-path antenna core section 9' of the non-coil wound section.

That is, in the present practical example, it is preferable that the coil wound section of the antenna structure be disposed in the circumference section of the radio controlled timepiece portion, and the non-coil wound section may be disposed inwardly of the coil wound section with respect to the circumference section of the radio controlled timepiece.

Accordingly, when mounting the main-magnetic-path antenna core section 9 of the coil wound section constituting the antenna structure 2 in a wristwatch or the like, it is preferably disposed in a portion having high probability at which the watch can directly receive the radio wave on average. Concurrently, the sub-magnetic-path antenna core section 9' of the non-coil wound section is preferably disposed on the surface side opposite to the surface side of the main-magnetic-path antenna core section 9 of the coil wound section upon which the radio wave hits.

More specifically, while a magnetic flux entered the main-magnetic-path antenna core section 9 of the coil wound section does not flow toward the sub-magnetic-path antenna core section 9' of the non-coil wound section where the gap 10 is present, the magnetic flux flows to the winding 11 having the low magnetic resistance. Conversely, also a magnetic flux entered into the sub-magnetic-path antenna core section 9' of the non-coil wound section does not also flow to the sub-magnetic-path antenna core section 9' of the non-coil wound section where the gap 10 is present.

For this reason, as the structure of the antenna, it is preferably configured to allow the magnetic flux to enter the main-magnetic-path antenna core section 9 of the coil wound section.

According to the configuration thus formed, most of the magnetic flux having entered into the antenna from the outside enters into the main-magnetic-path antenna core section 9 of the coil wound section, so that the gain is improved.

The practical configuration of the antenna structure 2 of the present invention is as shown in FIG. 6. This configuration is designed such that the main-magnetic-path antenna core section 9 of the coil wound section covers the sub-magnetic-path antenna core section 9' of the non-coil wound section, overall.

As is clear from the above description, in the another aspect of the antenna structure of the present invention, an antenna structure for receiving a radio wave is preferably of the type which is suitable for the use under an environment in which a metal material is present in the vicinity of the antenna structure, and has a structure for receiving an external magnetic flux and not allowing easy leakage of the magnetic flux to the outside during resonance, and further, a maximum gain reduction ratio of a gain value exhibited with the antenna structure in a case where a metal material is present in the vicinity of the antenna structure with respect to a case where the metal object is absent in the vicinity of the antenna structure is not higher than 60%.

Figure 8:
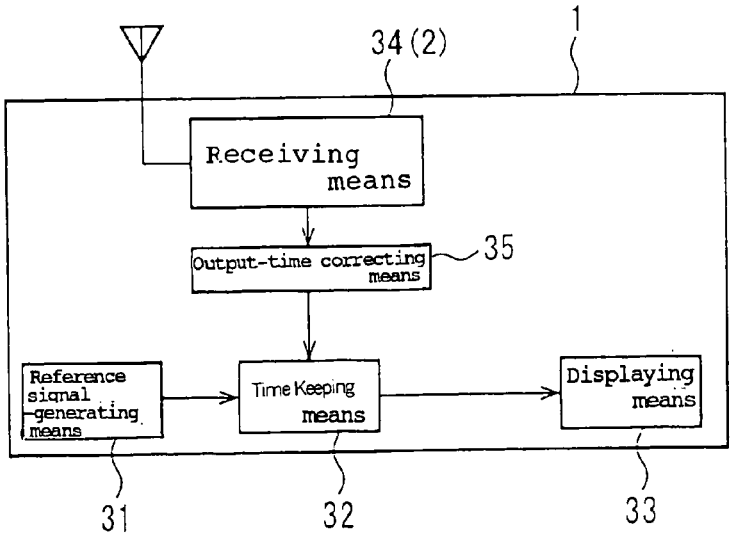
FIG. 8 is a block diagram showing an example configuration of a radio controlled timepiece according to the present invention.

In the another aspect of the present invention, a radio controlled timepiece 1 is configured, as shown in FIG. 8, so that in a radio controlled timepieces comprising a reference signal generating means 31 for outputting a reference signal; a time keeping means 32 for outputting timing information on the basis of the reference signal; a displaying means 33 for displaying time on the basis of the timing information; a receiving means 34 for receiving a standard radio wave containing reference time information; an output-time correcting means 35 for correcting the output time information from the time keeping means on the basis of the received signal from the receiving means 34, in which the receiving means 34 comprising any one of the antenna structures 2 as described in the above mentioned embodiments.

The radio controlled timepiece 1 is inclusive of, for example, a radio controlled timepiece or remote controlled wristwatch that receive a standard radio wave containing a time code to self-adjust the time of the wristwatch to the standard time.

Figure 9:
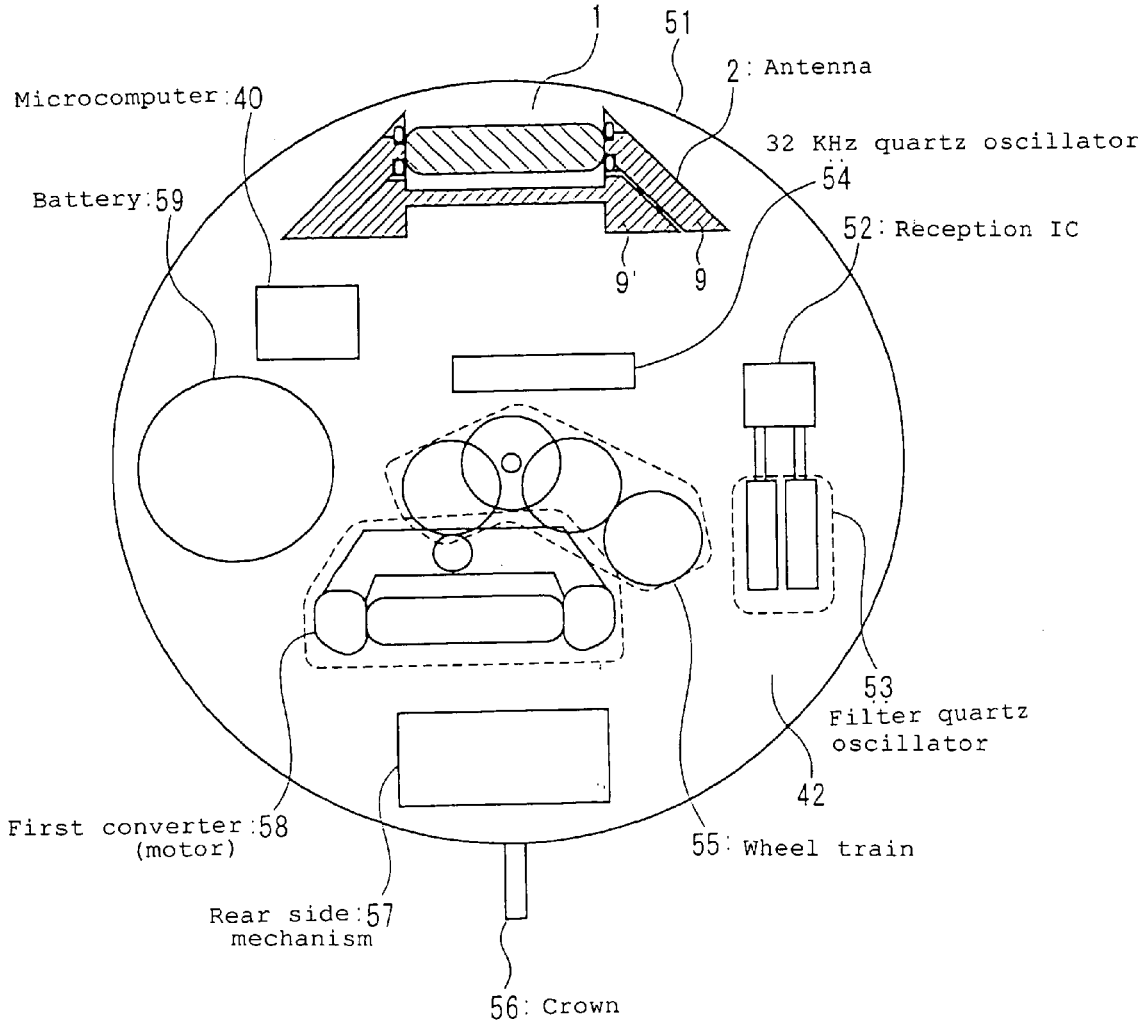
FIG. 9 is a view showing a layout configuration of individual components of the radio controlled timepiece according to the present invention.

A practical example of the radio controlled timepiece 1 of the present invention is shown in FIG. 9 in detail, which is configured as described hereunder. The antenna structure 2 having the configuration shown in FIG. 7 is disposed in a portion near an outer circumferential portion 51 of a timepiece. The main-magnetic-path antenna core section 9 of the coil wound section of the antenna structure 2 is positioned near the outer circumferential portion 51. The sub-magnetic-path antenna core section 9' of the non-coil wound section is disposed at a place opposite the outer circumferential portion 51 of the timepiece with respect to the main-magnetic-path antenna core section 9 of the coil wound section.

In FIG. 9, 52 denotes an reception IC, 53 denotes a filtering quarts oscillator, 54 denotes a 32 KHz quarts oscillator, 55 denotes a gear train, 56 denotes a crown, 57 denotes a rearside mechanism, 58 denotes a first converter (motor), 59 denotes a battery, and 40 denotes a microcomputer configuring an arithmetic operation section including time keeping means, time correcting means, or the like.

Figure 10:
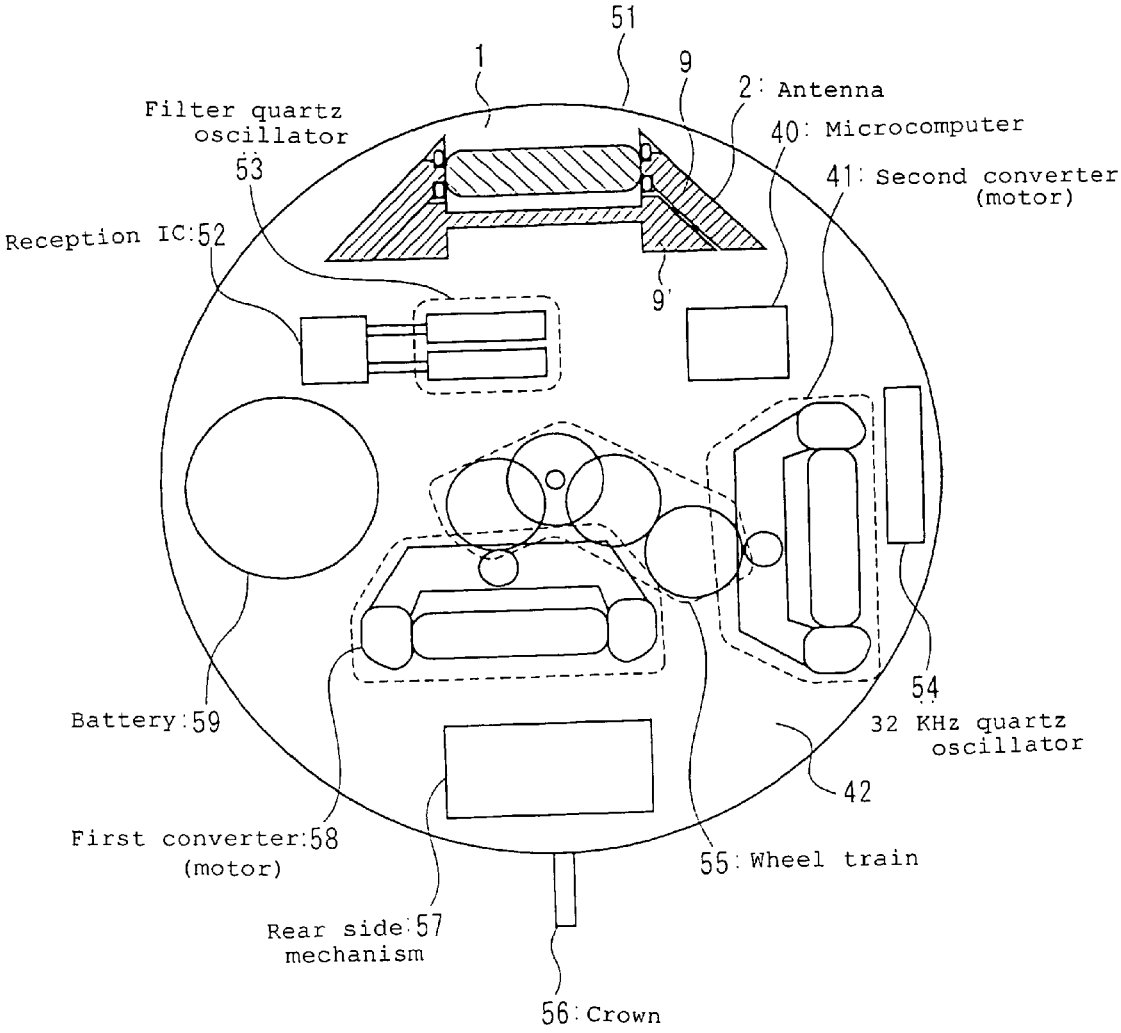
FIG. 10 is a view showing another practical example of a layout configuration of individual components of the radio controlled timepiece according to the present invention.

FIG. 10 shows another practical example of the radio controlled timepiece 1 of the present invention, configured by partly modifying the configuration shown in FIG. 9. A difference from the configuration shown in FIG. 9 is that in addition to the first converter (motor) 58 shown in FIG. 9, a second convertor (motor) 41 is separately provided.

In the radio controlled timepiece 1 of the present invention, the configuration may have a metallic outer casing section 42, in which the antenna structure 2 as well is disposed inside the metallic outer casing section 42, and at least a part of the antenna structure 2 is disposed in contact with the outer casing section 42.

It is to be understood that the layout configuration of each of the radio controlled timepieces 1 shown in FIGS. 9 and 10 is, of course, presented herein just by way of example. As described above, since the antenna structure 2 of the present invention has less influences of the presence of an electro-conductive object of a metal material(s). Consequently, the relationship with the layout configuration of other components is flexible, so that many other modified modes are contemplated.

Figure 11:
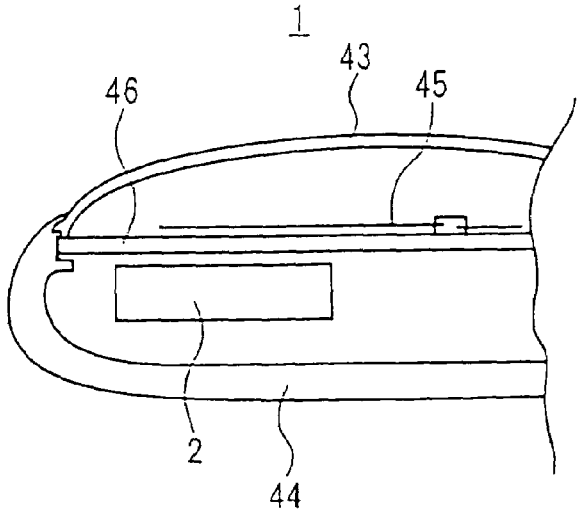
FIG. 11 is a view showing another practical example of a layout configuration of individual components of the radio controlled timepiece according to the present invention.

By way of another practical example of the present invention, it is preferable that, as shown in FIG. 11, the antenna structure 2 is provided in the surface opposite to the surface in which a windshield 43 is provided with respect to a dial plate 46 of a radio controlled timepiece 1.

In the FIG. 11, 44 denotes a conductive outer casing section made of metallic material, and 45 denotes a minute hand constituting displaying means.

According to the first practical example of the present invention, since the configuration described above is employed, the problems with the conventional technique are solved whereby to enable easily obtaining a radio controlled timepiece using the antenna structure that have high reception efficiency without greatly changing the configuration of the radio controlled timepiece, the material of the outer casing thereof as well as design thereof with the size and thickness of the wristwatch per se being not different from those of the conventional wristwatch, and a degree of design freedom, and that enable manufacturing costs to be reduced, by using the simply configured antenna structure without greatly changing the structure, outer casing materials, design, and/or the like of the conventional radio controlled timepiece.

Further, a radio controlled timepiece can easily obtained that has a high commercial value and that does not reduce the gain even in the case where the antenna is stored in the metal outer casing.

(Second Embodiment)

Another embodiment of an antenna structure of the present invention will be described hereinbelow.

According to the above-described practical examples of the first embodiment, the antenna is formed into the specific structure in which the reduction in the Q value and the gain is restrained as much as possible to prevent the reduction in the reception performance of the antenna in order to solve the problems occurring in that when the antenna is disposed in the timepiece casing having the side section and bottom cover section formed of the metal material, the Q value is reduced, and consequently, the output of the antenna structure is significantly reduced, and also the gain thereof also is reduced.

A second embodiment of the present invention is an antenna structure for increasing the L value of the antenna, which is a structure different from that of the first embodiment for preventing the reduction in the antenna reception performance.

In the case of the method of specifically arranging the antenna structure as in the first embodiment, the antenna structure for improving the reception performance thereof is limited. The inventors, therefore, further continued the extensive researches and have discovered that the object for solving the above-described problems can be achieved with further improvement. The improvement can be achieved by imparting a specific performance that increases the L value of the antenna, i.e., the antenna structure of this embodiment, to the antenna structure of the first embodiment that operates with the main magnetic path and the sub-magnetic path.

To achieve the object described above, the second embodiment employs a basic technical configuration as described hereunder. In a first aspect of the second embodiment, an antenna structure is capable of receiving a radio wave and disposed inside a timepiece in which at least one of a side section and a bottom cover section is formed of metal, in which an L value of the antenna is less than 1600 mH. In a second aspect of the embodiment, an antenna structure is capable of receiving a radio wave disposed inside a timepiece at least one of a side section and a bottom cover section is formed of metal, in which a magnetic path formed along a magnetic core forms a closed loop like configuration, and a winding resistance of the antenna is less than 1 KΩ.

In a third aspect of the second embodiment of the present invention, an antenna structure is configured of a main magnetic path in which a coil is wound about a magnetic core and a sub-magnetic path in which the coil is not wound about a magnetic core, a magnetic path formed along the magnetic core forms a closed loop like configuration, and number of turns of the antenna is not lower than 1000. In a fourth aspect of the second embodiment of the present invention, an antenna structure is configured of a main magnetic path in which a coil is wound about a magnetic core and a sub-magnetic path in which the coil is not wound about the magnetic core, a magnetic path formed along the magnetic core forms a closed loop like configuration.

The antenna structure is suitable for use under an environment where a metal object is present in the vicinity of the antenna structure, in which a Q value retention ratio Rq defined below in the case where a metal object is present in the vicinity of the antenna structure is not higher than 10%.

The Q value retention ratio Rq mentioned above is expressed by $$Rq=Q_{NL}/Q_O\times 100,$$

where, the Q value of the antenna structure is set to $Q_O$ in the case where the antenna structure is placed under an environment in which the antenna structure is not disposed in contact with the metal object or the metal object is absent in the vicinity of the antenna structure, and a Q values of the antenna structure are measured and set to $Q_N$ in an environment where the antenna structure is disposed in contact with the metal object or the metal object is disposed in the vicinity of the antenna structure, and then the most lowest $Q_N$ value is selected as $Q_{NL}$.

In the present practical example, the most lowest $Q_{NL}$ value in $Q_N$ values obtained by measuring a plural types of metal objects composed of different metal materials under conditions identical to one another is set to the minimum value $Q_{NL}$.

In order to simplify the measurement of the minimum value $Q_{NL}$ in the Q values of the antenna structure, the value may be represented by a value measured under an environment where a metal object made of, for example, stainless steel (SS), titanium, or titanium alloy is brought into contact with the antenna structure or placed in the vicinity of the antenna structure.

The antenna structure and the radio controlled timepiece using the antenna structure in the second embodiment of the present invention thus employ the technical configurations described above. Accordingly, the antenna structure and the radio controlled timepiece using the antenna structure that have high reception efficiency, can be obtained without greatly changing a conventional timepiece configuration, material as well as design thereof, by adopting the antenna structure having a simple configuration and with the size and thickness thereof also not being different from those of the conventional wristwatch, and with a degree of design freedom as well as having high level of massive feeling.

Practical examples of the antenna structure and the radio controlled timepiece using the antenna structure according to the second embodiment of the present invention will be described hereinbelow with reference to the drawings.

Figure 19:
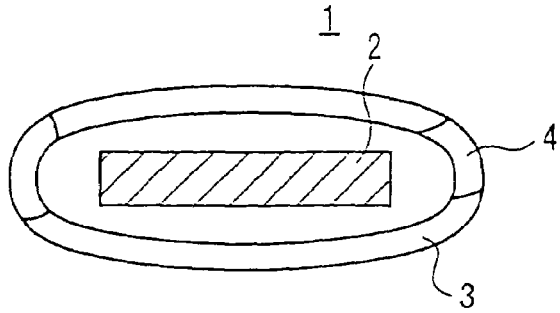
FIG. 19 is a view showing a practical example of the configuration of an antenna structure of a second embodiment according to the present invention.

FIG. 19 is a schematic plan view showing a practical example of an antenna structure 2 according to the present invention. Shown in the drawing is an antenna structure 2 capable of receiving a radio wave deployed in a timepiece in which at least one of a side section 4 and a bottom cover section 3 is formed of metal, in which the L value of the antenna structure 2 is not greater than 1600 mH.

According to the conventional example described above, in the case where the antenna is inserted and disposed in the metal outer casing section such as a metal side section or bottom cover section, energy loss is increased by interaction between the metal outer casing arranged in the vicinity of the coil and the magnetic flux oscillating by resonance when the antenna receives the radio wave, specifically, by eddy current loss.

Thereby, a resonance phenomenon (magnetic force→electric power→magnetic force→ . . . ) caused by the antenna is impaired by the metal outer casing; more specifically, the magnetic force generated by the resonance phenomenon is absorbed by the metal section, and an eddy current phenomenon is thereby caused, whereby the magnetic force is mostly consumed (by the influence of an iron loss). Consequently, the gain and the Q value are significantly reduced whereby arising a problem in putting the radio controlled timepiece in which the antenna is disposed inside of metallic outer casing into practical use.

The gain of the antenna is composed of two gains, one being a gain produced with the magnetic flux of a transmission signal and the other being an output produced with the magnetic flux increased by the resonance phenomenon of the antenna. Generally, a primary component of an antenna output is composed of a gain produced with an increased magnetic flux by an antenna resonance phenomenon.

Upon insertion of the antenna into the metal outer casing, the resonance phenomenon of the antenna is impaired, so that the Q value thereof is significantly reduced, and the also the gain thereof is significantly reduced.

In other words, ordinarily, in the case where the metal object is not present in the vicinity of the antenna, most of the gains of the antenna are gains obtained by the resonance phenomena. As such, increased winding resistance (copper loss) of the antenna disturbs the resonance phenomenon whereby to be the cause of reduction in the gain (Q value). Consequently, for example, the number of turns cannot be significantly increased, and the winding cannot be narrowed.

In the case where the antenna is inserted into the metal outer casing, since the influence of the iron (metal outer casing) loss is increased, the Q value is significantly reduced whereby to reduce the gain also.

As such, changing the conventional concepts, the inventors have conducted extensive researches regarding the method of improving the gain of the antenna structure by contemplating as a prerequisite that the Q value reduction is not avoidable in the case where the antenna structure is used within the metal outer casing.

More specifically, for the present invention, the inventors continually conducted research to pursue how to maximally utilize the gain obtained with a magnetic flux of the transmission signal which is different from the conventional method for obtaining the gain at the amplification factor associated with the Q value (resonance phenomenon), in the case where the antenna is inserted and disposed in the metal outer casing section. The present invention is made based on technical concepts obtained from the research results.

Figure 20:
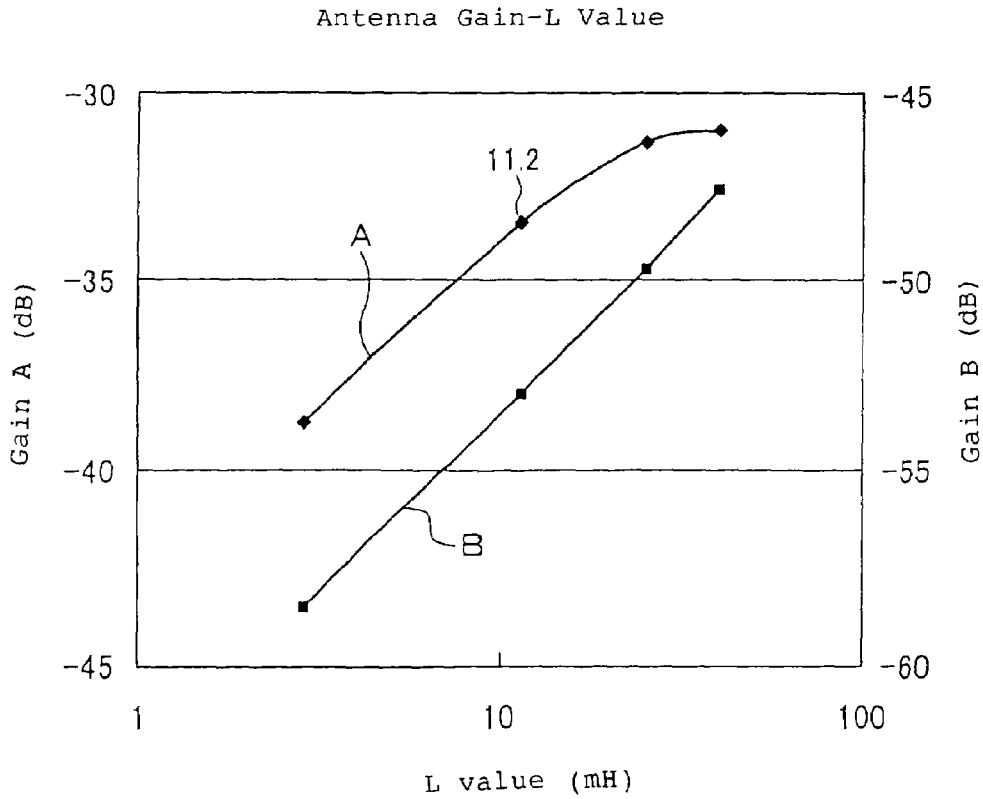
FIG. 20 is a graph showing the relationship between an L value and gain in the antenna structure of the second embodiment according to the present invention.

To verify the technical concepts, the inventors performed experiments to measure the relationship between the L value (mH) of a predetermined antenna structure and the gain (dB) of the antenna structure, as shown in FIG. 20.

In FIG. 20, a graph A shows the relationship between the L value and the gain (dB) at the event that a radio wave of 77.5 KHz is received in the state where the predetermined antenna structure is not inserted into the metal outer casing section. A graph B shows the relationship between the L value and the gain (dB) at the event that a radio wave of 77.5

KHz is received in the state where a predetermined antenna structure having same structure is inserted into the metal outer casing section.

In the experiments, the used antenna is formed by winding a winding about an ordinary linear core section, and variations in the L value was adjusted by changing the number of turns.

As can be seen from FIG. 20, in the antenna structure not inserted into the metal outer casing, the gain increases as the L value increases, and the L value is gradually saturated upon exceeding about 10 mH. However, it can be learned that when the antenna structure inserted into the metal outer casing, no saturated phenomenon takes place, and the gain increases proportionally in linear configuration to the increase in the L value.

The inventors continued the research and determined from the results shown in FIG. 20 that, for the antenna structure 2 to be used in the metal outer casing section, the number of turns of the winding is preferably increased to increase the L value since the gain linearly increases along with the increase in the L value.

However, since the capacitance is present between wires of the winding used in the coil of the antenna, limitations are imposed regarding the resonance point of the antenna, so that the upper limit is inevitably determined.

An inter-wire capacitance of the antenna is determined depending on the number of turns and the type of the winding. Assuming a practical case in which, in consideration of the spacing for storage in a timepiece having a thickness of 10 mm and a diameter of 30 mm, the winding width of the antenna core is 12 mm, the thickness of the antenna is the same as the thickness of the outer casing, and the thickness of a movement base plate is 5.5 mm. In this case, when the winding core thickness enabling obtaining a sufficient strength of a cheap ferrite core is 3 mm, a conductor diameter of 10 μm and a conductor wire diameter 110 μm enable the resistance value to be minimized in order to provide winding of 1400 T as the number of turns with which sufficient performance of a radio controlled timepiece can be secured.

In accordance with these conditions, the antenna was prepared in such a manner that a ferrite core having a 3 mmϕ and a length of 50 mm was used to be wound with a wire material having a conductor diameter of 100 μm and a conductor wire diameter of 110 μm in a winding width of 12 mm, and experiments were performed therewith to obtain the inter-wire capacitance of the antenna.

Figure 30:
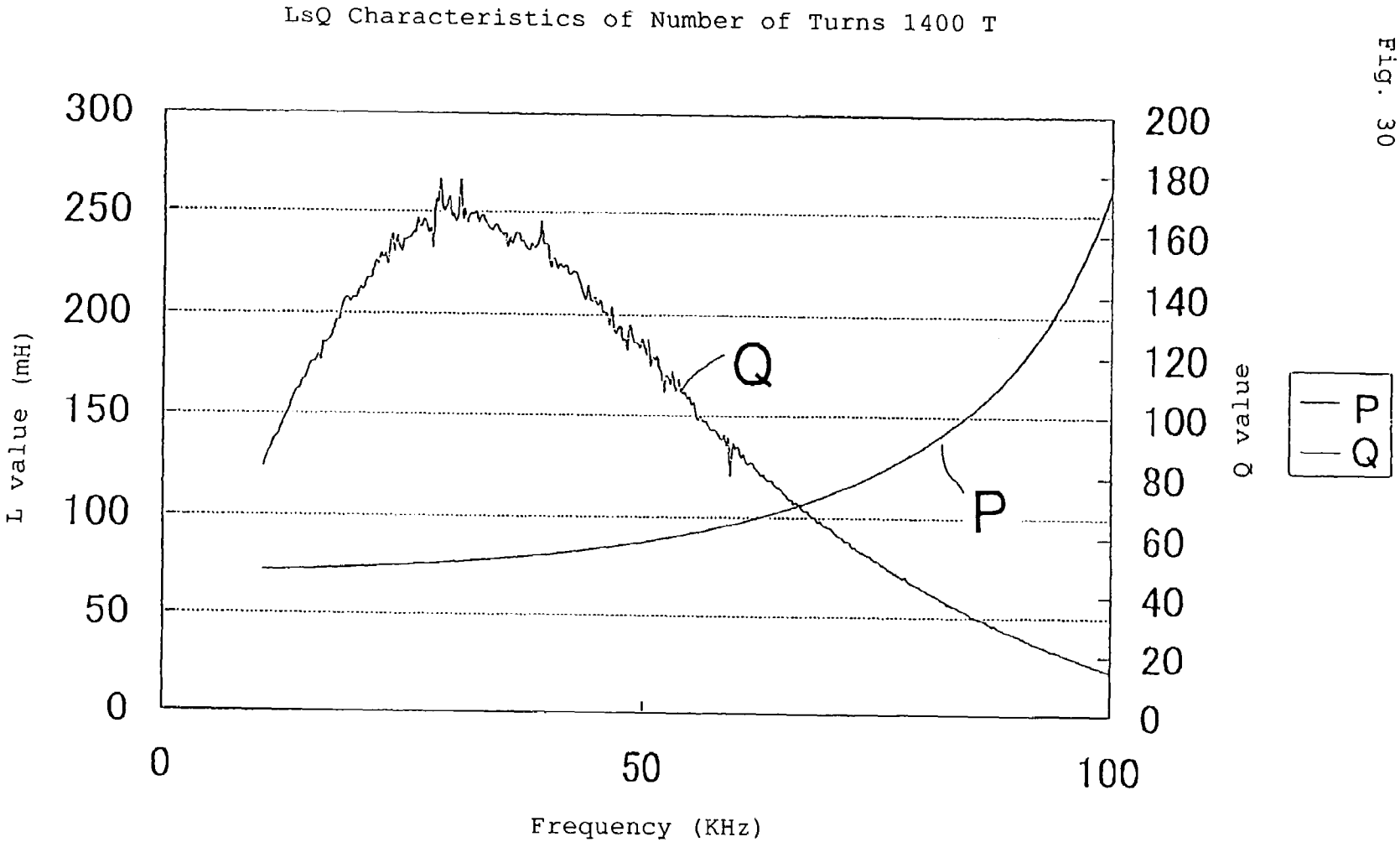
FIG. 30 is a frequency-L value characteristic diagram in the second embodiment of the present invention.

As a consequence, the characteristics of the frequency and the L value were as shown in FIG. 30, in which the variation of the L value with respect to the variation of the frequency is shown by a graph P, and the variation of the Q value with respect to the variation of the frequency are shown in a graph Q.

As can be known from FIG. 30, when capacitors of 264.9 pF were parallel connected to the antenna to tune the L value of the antenna to about 35 KHz, which is in stable and tuning was thereby performed, the resonant frequency was 34.4 KHz; and when the L value at this resonant frequency is obtained from the FIG. 30, it is 78.27205 mH.

When the inter-wire capacitance of the antenna is obtain from these values, it is 8.852 pF, whereby at least an inter-wire capacitance of about 10 pF is considered to inevitably take place.

In addition, from the fact that the frequency band to be used is 40 KHz at lowest, when the L value of the antenna structure 2 is obtained from the equation $f=\frac{1}{2\pi\sqrt{LC}}$ on the basis of the above-described capacitance and frequency, it is about 1584 to 1600 mH. Accordingly, the antenna structure is preferably used at an L value of not greater than 1600.

Additionally, in a practical case, when the parasitic capacitance of the reception IC is included in addition to the winding capacitance of the antenna, the parasitic capacitance is considered about 20 pF. As such, in the above-described state, the L value is determined to be ranged from 792 to 800. Consequently, an antenna structure 2 having an L value not greater than 800 mH, is preferably used.

Practically, a presently existing highest frequency band among frequency bands to be used is 77.5 KHz (Germany). When making determination with premise of using the aforementioned frequency band, the L value of the antenna structure 2 obtained under these circumstances based on the above-described capacitance and frequency is ranged from about 211 to 220 mH. As such, it is preferable that the antenna structure 2 exhibiting the L value not higher than 220 mH be used.

A lower limit value of the L value of the antenna structure 2 of the present invention is preferably about 20 mH.

According to the results of field researches regarding the electrofield intensity in Japan and Germany, for example, where standard radio waves are transmitted, it is necessary for an antenna structure 2 can receive the waves with an electric-field intensity of 50 dB μV/m at minimum to enable the radio controlled timepiece to sufficiently receive the waves in all districts across a transmitting nation.

A minimum gain requited for the antenna is different depending on the capability of the reception IC. The required gain is not lower than −51 dB in the case the capability of a present reception IC is taken into consideration. The required gain is not lower than −50 dB in the case non-uniformity of the antenna performance is taken into consideration. The required gain is not lower than −49 dB in the case non-uniformity of resonant frequency due to non-uniformity of the L value and C value is taken into consideration; and more preferably, the required gain is not lower than −47 dB in the case non-uniformity of performance of the reception IC is taken into consideration.

Accordingly, as shown in FIG. 20, it is considered that also the lower limit value of the L value should be not lower than 20 mH corresponding to −51 dB of the antenna gain, preferably not lower than 25 mH corresponding to −50 dB of the antenna gain, more preferably not lower than 33 mH corresponding to −49 dB of the antenna gain, most preferably not lower than 40 mH corresponding to −47 dB of the antenna gain.

Compared with the fact that the L values of the antenna structure 2 of the conventional radio controlled timepiece 1 are at most in the range from 2 to 13 mH, it can be known that the above-described L values determined to be preferable in the present invention are very peculiar.

The inventors then conducted research regarding the relationship between the number of turns (T) of the winding in the antenna structure and the gain (dB) therein. The results are shown in FIG. 21.

Figure 21:
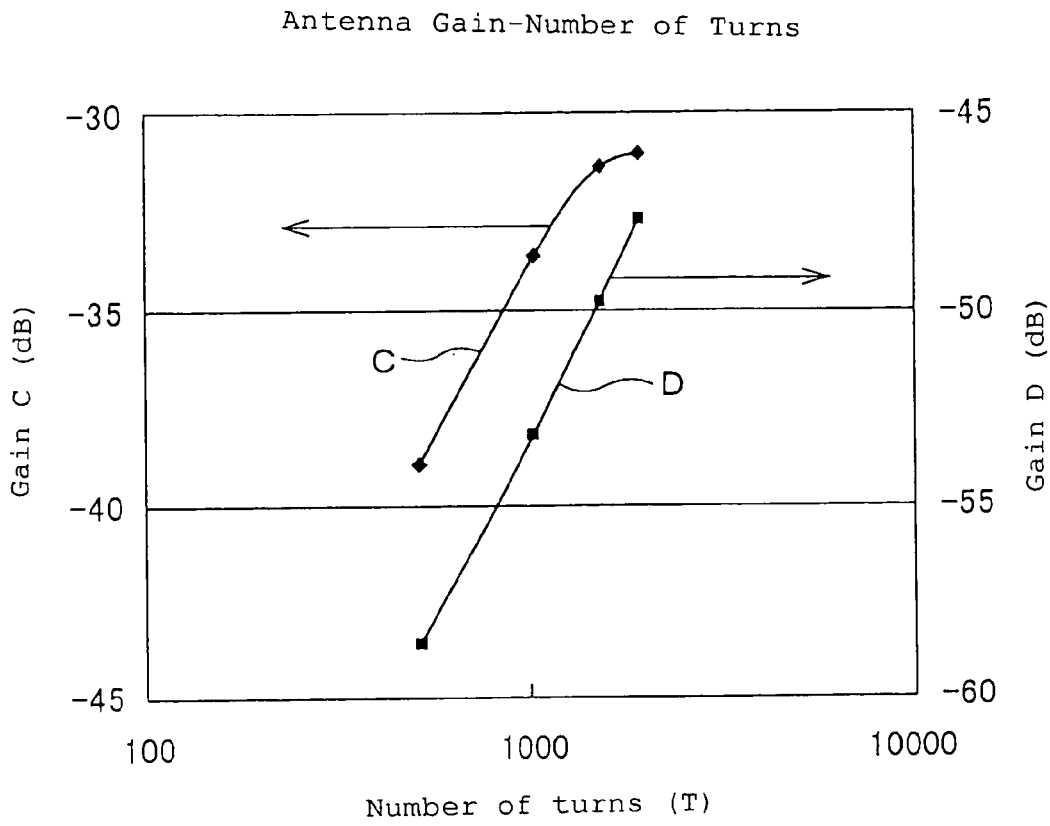
FIG. 21 is a graph showing the relationship between a number of turns (T) and the gain the antenna structure of the second embodiment according to the present invention.

More specifically, referring to FIG. 21, as in the experiments shown in FIG. 20, a graph C shows the relationship between the number of turns (T) and the gain (dB) of the antenna structure 2 at the event that a radio wave of 77.5 KHz is received in the state where a predetermined antenna structure is not inserted into the metal outer casing section. A graph D shows the relationship between the number of turns (T) and the gain (dB) of the antenna structure 2 at the event that a radio wave of 77.5 KHz is received in the state where a predetermined antenna structure having the same structure is inserted into the metal outer casing section.

As can be seen from the FIG. 21, in the antenna structure not inserted into the metal outer casing, the gain increases as the number of turns (T) increases, and the number of turns (T) is gradually saturated upon exceeding about 1000. However, it can be learned that in a case in which the antenna structure is inserted into the metal outer casing, no saturated phenomenon takes place, and the gain increases proportionally to the increase in the number of turns (T).

Accordingly, in the present invention, for the radio controlled timepiece in which at least one of the side section and the bottom cover section of the outer casing section is formed of metal or both are formed of metal, the number of turns (T) of the antenna structure 2 is preferably set to 1000 T or larger.

For employment to the antenna structure of the first embodiment configured of the main magnetic path and the sub-magnetic path, 400 T is preferable.

The antenna gain is required to be −51 dB at minimum. In the case of FIG. 21, 1400 T corresponds to −51 dB, so that for the radio controlled timepiece in which at least one of the side section and the bottom cover section of the outer casing section is formed of metal, an effective number of turns (T) in the antenna structure 2 is determined to be 1400 or larger.

Further, as can be seen from FIG. 21, in the case that the antenna structure 2 is not inserted into the outer casing but is monolithically used, the increasing ratio of the gain is saturated when the number of turns (T) is 1500 or larger. However, in the case that the antenna structure 2 is disposed in the metal outer casing, even when the number of turns (T) is 1500 or larger, the gain linearly increases. As such, for the radio controlled timepiece in which at least one of the side section and the bottom cover section of the outer casing section is formed of metal, it is understood that effective number of turns (T) of the antenna structure 2 is preferably determined to be 1500 or larger.

As the number of turns (T) of the antenna is increased, since the winding resistance of the antenna also is increased, the upper limit of the number of turns (T) is limited.

Figure 22:
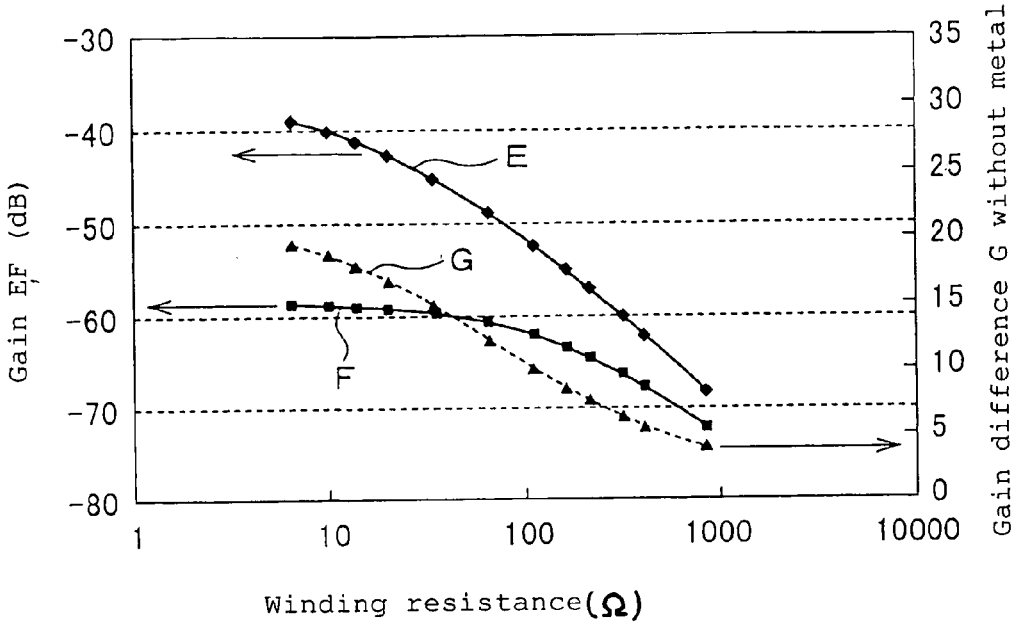
FIG. 22 is a graph showing the relationship between a winding resistance (Ω) and the gain in the antenna structure of the second embodiment according to the present invention.
Figure 22:
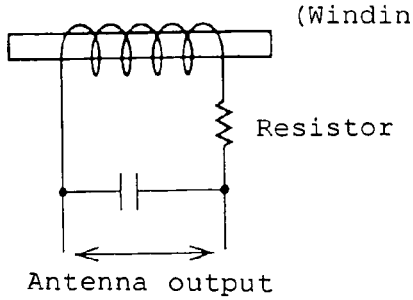

As shown in FIG. 22, the inventors conducted experiments for research concerning the relationships among the winding resistance (Ω) of the antenna structure 2 and the gain and the relationship between the winding resistance (Ω) of the antenna and a gain difference between the case where the antenna structure is closed to the metal outer casing section and the case where the metal outer casing section is not closed to the metal outer casing section.

More specifically, referring to FIG. 22, as in the experiments shown in FIG. 20, a graph E shows the relationship between the winding resistance (Ω) of the antenna structure and the gain (dB) of the antenna structure 2 at the event that a radio wave of 77.5 KHz is received in the state where a predetermined antenna structure is not inserted into the metal outer casing section. A graph F shows the relationship between the number of turns (T) and the gain (dB) of the antenna structure 2 at the event that a radio wave of 77.5 KHz is received in the state where a predetermined antenna structure having the same structure is inserted into the metal outer casing section.

In addition, a graph G shows the relationships among the winding resistance (Ω) of the antenna structure 2 and the gain and the winding resistance (Ω) of the antenna and a gain difference between the case where the antenna structure is closed to the metal outer casing section and the case where the metal outer casing section is not closed to the metal outer casing section.

In the experiments shown in FIG. 22, as shown in FIG. 22(B), the value of the winding resistance (Ω) of the antenna was adjusted by appropriately changing the resistance value.

As can be seen from FIG. 22A, either in the case that the antenna structure 2 without the metal outer casing is monolithically used or in the case that the antenna structure 2 is disposed in the metal outer casing, as the winding resistance of the antenna increases, the gain decreases.

From a graph G showing the gain difference between the graphs E and F, it can be known that when the value of the winding resistance (Ω) of the antenna becomes 1 KΩ or higher, there disappear variations in the difference between the gains in the case where the antenna structure 2 is used in the metal outer casing and in the case where the antenna structure 2 is not used in the metal outer casing, and the gain difference becomes constant near the range of about 3 to about 4 dB.

Conventionally, it has been considered that in the case where the metal object having electro-conductivity is disposed in the vicinity of the antenna for receiving the radio wave or in contact with the antenna structure, the radio wave is absorbed by the metal object, and hence the radio wave does not reach the antenna, so that the resonant output of the antenna is lowered whereby to reduce the Q value.

However, as a consequent of extensive research, the inventors found that an understanding about problems as mentioned above, in the conventional technical field was incorrect, and discovered that even in the case where the metal object having electro-conductivity is present in the vicinity of the antenna or in contact with the antenna structure, the radio wave substantially reaches the antenna structure.

Additionally, verification could be done that in the event of non-resonance, the flow of the magnetic flux generated with the external radio wave attempting to enter the timepiece from the outside is somewhat attenuated (about 3 dB, for example), but substantially reaches the antenna without being disturbed. The verification results conform to these facts.

Figure 31:
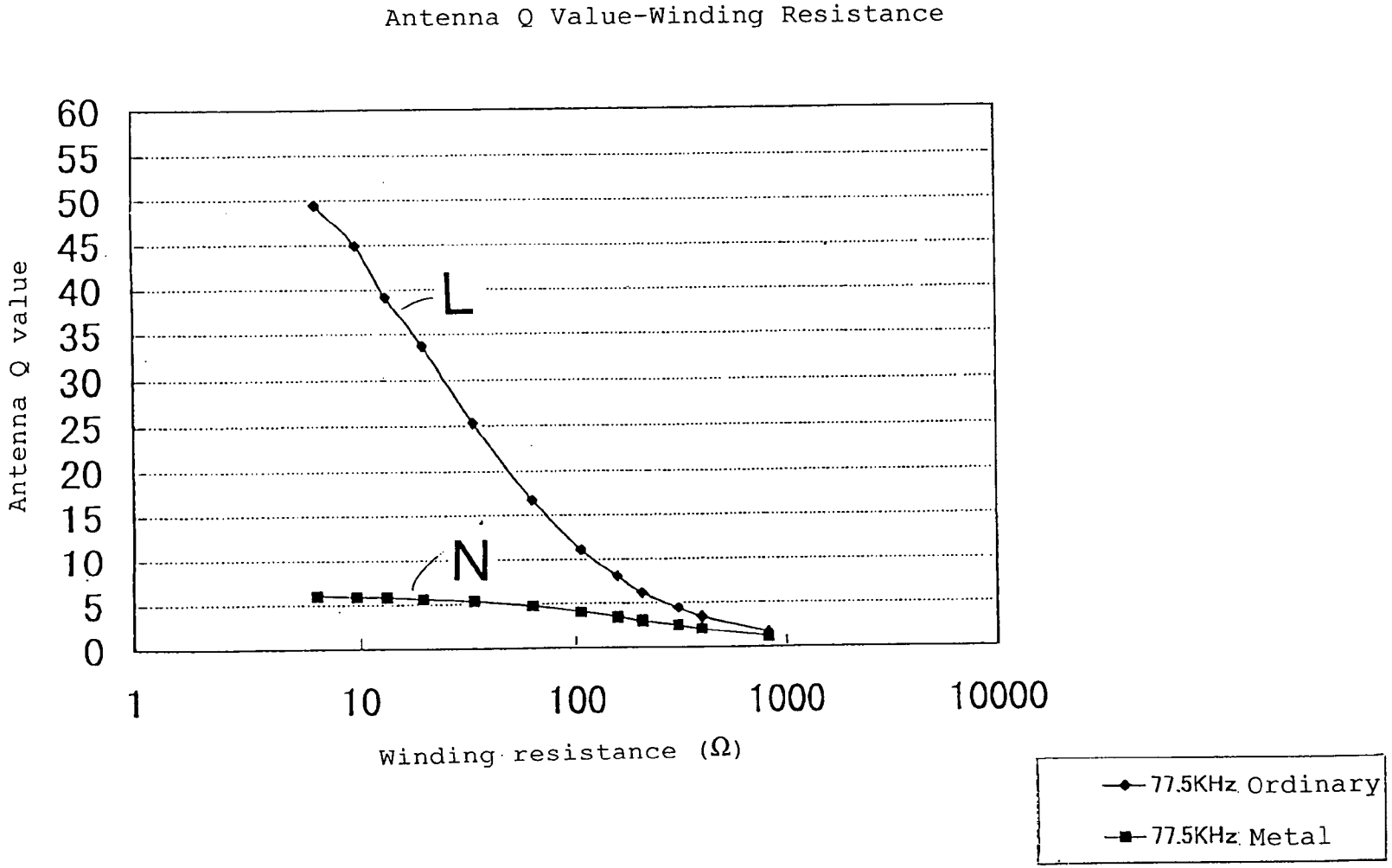
FIG. 31 is a winding resistance-antenna Q value characteristic diagram in the second embodiment of the present invention.

In addition, in FIG. 31, as in the same experiments as shown in FIG. 22, a graph L shows the relationships between the winding resistance (Ω) and the Q value of the antenna structure 2 at the event that a radio wave of 77.5 KHz is received in the state where a predetermined antenna structure is not inserted into the metal outer casing section. A graph N shows the relationship between the winding resistance (Ω) and the Q value of the antenna structure 2 at the event that a radio wave of 77.5 KHz is received in the state where a predetermined antenna structure having the same structure as mentioned above, is inserted into the metal outer casing section.

In the experiments shown in FIG. 31, the value of the winding resistance (Ω) of the antenna was adjusted by appropriately changing the resistance value, similar to the case shown in FIG. 22.

As can be seen from FIG. 31, in the case that the antenna structure 2 without the metal outer casing is monolithically used, as the winding resistance (Ω) of the antenna increases, the Q value significantly decreases. However, in the case where the antenna structure 2 is disposed in the metal outer casing, the Q value is stabilized at about 5 up to the antenna winding resistance of 100 Ω. As such, it is considered that the winding is thinned and the number of turns is increased whereby to increase the L value and to improve the antenna gain in a case in that the antenna structure is disposed inside the metallic outer casing section.

From these results, when the value of the winding resistance (Ω) of the antenna is 1 KΩ or lower, a contribution in effectiveness to the gain of the antenna structure 2 used in the metal outer casing is considered greater than a contribution in effectiveness to the gain of the antenna structure 2 not used in the metal outer casing. Accordingly, the winding resistance (Ω) of the antenna structure 2 of the present invention is preferably 1 KΩ or lower.

Generally, the timepiece thickness is considered to be about 10 mm, and a case is now considered in which the width of the winding of the antenna is 20 mm, the winding core thickness is 1 mm, the size of the winding is 60 μm in conductor diameter, the conductor wire diameter is 65 μm, and the winding resistance of the antenna is 1 KΩ. In this case, the number of windable turns of the winding is limited to 25,000.

When a practical case is assumed, in consideration of the spacing for storage of the antenna structure in a timepiece having a thickness of 10 mm and a diameter of 30 mm, the winding width of the antenna core is 12 mm, the thickness of the antenna is the same as the thickness of the outer casing, and the thickness of a movement base plate is assumed to be 5.5 mm, and therefore, the winding core thickness is 1 mm. In order to make the winding resistance of the antenna to be about 1 KΩ at this spacing, a largest number of wind-able turns with the conductor diameter of 45 μm and the conductor wire diameter of 50 μm is 12,000 T.

More preferably, in consideration of the strength of the antenna made of a cheap ferrite core, the winding core thickness is ideally 2 mm. In order to make the winding resistance of the antenna to be about 1 KΩ at this spacing, a largest number of wind-able turns with the conductor diameter of 45 μm and the conductor wire diameter of 50 μm is 9,000 T.

Even more preferably, in consideration of a sufficient strength of the antenna made of a cheap ferrite core for the timepiece, the winding core thickness is ideally 3 mm. In order to make the winding resistance of the antenna to be about 1 KΩ at this spacing, a largest number of wind-able turns with the conductor diameter of 45 μm and the conductor wire diameter of 50 μm is 7,000 T.

Note that, FIG. 22 shows graphs reformed by replacing the data of winding number as shown in FIG. 21 with the data of winding resistance of the same sample.

Figure 23:
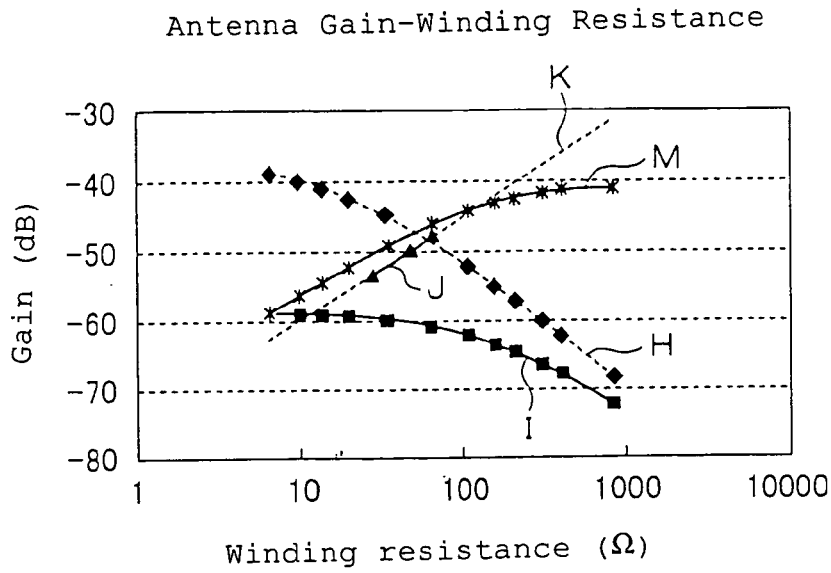
FIG. 23 is a graph showing the relationship between the winding resistance (Ω) and the gain in the antenna structure of the second embodiment according to the present invention.

And FIG. 23 shows graphs formed by combining the FIGS. 21 and 22.

As shown in FIG. 23, a graph H shows the relationship between the winding resistance (Ω) and the gain (dB) of the antenna structure 2 at the event that a radio wave of 77.5 KHz is received in the state where a predetermined antenna structure is not inserted into the metal outer casing section. A graph I shows the relationship between the winding resistance (Ω) and the gain (dB) of the antenna structure 2 at the event that a radio wave of 77.5 KHz is received in the state where an antenna structure having the same structure as mentioned above, is inserted into the metal outer casing section.

The graphs H and I are substantially the same as the graphs E and F of FIG. 22.

A graph J in FIG. 22 shows the relationship between the winding resistance (Ω) and the gain (dB) of the antenna at the event that a radio wave of 77.5 KHz is received by an antenna structure having the same structure as that described above in the state where the number of turns (T) thereof is varied from 1000 to 2000 T, and the antenna structure is inserted into the metal outer casing section. This graph shows that as the winding resistance (number of turns) of the antenna is increased, the gain is improved.

A graph K is an approximation curve of the graph J.

A graph M shows the balance between the gain ratio that is reduced as the winding resistance (Ω) of the antenna structure 2, which is shown in the graph I, is increased and the gain that is increased as a winding resistance J is increased in association with the increase of the number of turns (T) of winding.

Apparently from the graph M of FIG. 23, it can be known that the balance between the increase and reduction of the gain is saturated as the winding resistance (Ω) of the antenna is increased from around 396 Ω. This teaches that desired effects cannot be obtained even when executing such a winding as that causes the winding resistance (Ω) of the antenna to become 400 Ω or higher.

Accordingly, the winding resistance (Ω) of the antenna structure 2 of the present invention is preferably 400 Ω or lower.

In addition, according to the present invention, in the case 2 where the metal outer casing is used, suppose usage of the antenna structure in a region where the gain thereof is the highest and less varies is considered to be a most effective manner, as can be seen from the graph F of FIG. 22, it is considered preferable to use it in the state where the winding resistance (Ω) of the antenna structure 2 is 100 Ω or lower.

The lower limit value of the winding resistance (Ω) of the antenna structure 2 is preferably 180 Ω.

That is, according to FIG. 21, when the minimum gain required for the antenna is assumed to be −51 dB, the number of turns of winding is 1400 T. When a practical case is assumed, in consideration of the spacing for storage of the antenna structure in a timepiece having a thickness of 10 mm and a diameter of 30 mm, the winding width of the antenna core is 12 mm, the thickness of the antenna is the same as the thickness of the outer casing, and the thickness of a movement base plate is assumed to be 5.5 mm, and therefore, the winding core thickness is 1 mm.

In order to secure 1400 T as the number of turns at this spacing, the conductor diameter of 130 μm and the conductor wire diameter of 140 μm are most effective to enable the resistance value to be minimized, in which the resistance value is 18 Ω.

More preferably, in consideration of the strength of the antenna made of a cheap ferrite core, the winding core thickness is 2 mm. In order to secure 1400 T as the number of turns of winding at this spacing, the conductor diameter of 110 μm and the conductor wire diameter of 120 μm are most effective to enable the resistance value to be minimized, in which the resistance value is 27.6 Ω.

Even more preferably, when the minimum gain required for the antenna is considered to be −50 dB, the number of turns of winding is 1500 T, and the conductor diameter of 110 μm and the conductor wire diameter of 120 μm are most effective to enable the resistance value to be minimized, in which the resistance value is 30 Ω.

Even more preferably, when the minimum gain required for the antenna is considered to be −49 dB, the number of turns of winding is 1650 T, and the conductor diameter of 100 μm and the conductor wire diameter of 110 μm are most effective to enable the resistance value to be minimized, in which the resistance value is 38 Ω.

Most preferably, when the minimum gain required for the antenna is considered to be −47 dB, the number of turns of winding is 1900 T, and the conductor diameter of 95 μm and the conductor wire diameter of 105 μm are most effective to enable the resistance value to be minimized, in which the resistance value is 53 Ω.

Most preferably, in consideration of the strength of the timepiece made of a cheap ferrite core and the strength of the antenna, the winding core thickness is ideally 3 mm. In order to secure 1400 T as the number of turns of winding for obtaining a minimum antenna gain at this spacing, the conductor diameter of 100 μm and the conductor wire diameter of 110 μm are most effective to enable the resistance value to be minimized, in which the resistance value is 41.6 Ω.

The winding resistance (Ω) of the antenna structure in the conventional radio controlled timepiece is at most 3 to 20 Q. For the antenna winding resistance (Ω) of the antenna structure of the present invention, the antenna winding resistance (Ω) significantly higher than the conventional level is used.

In the present invention, according to the results of the experiments, in the case where the antenna structure 2 is disposed in the metal outer casing, even when the winding resistance (copper loss) of the antenna of the antenna structure is increased, reduction in the Q value is low. In other words, as long as the number of turns is the same even when the wire diameter is small, the variation in the Q value and a gain G are less.

The gain of the antenna of the antenna structure 2 is improved by an increase in the number of turns of winding.

As a result, in the case where the antenna structure is disposed in the metal outer casing, when design is carried out to thin or fine the winding and to increase the number of turns of winding, the gain can be improved.

In the conventional mode in which the antenna structure 2 is not inserted into the metal outer casing section, a case where a winding having a large diameter, for example, a diameter thereof is 0.1 mmϕ and exhibiting a low resistance value is used exhibits higher gain characteristics than the case where the winding has a small winding diameter, for example, a winding having a diameter of 0.06 mmϕ and exhibiting a high resistance value is used. However, such a difference in the gain characteristics is not observed in the case as in the present invention where the antenna structure 2 is disposed in the metal outer casing section.

As such, in the present invention, the antenna structure 2 is preferably configured using a thin or fine winding wire whereby to enable forming the antenna structure 2 having a smaller size.

Accordingly, in another aspect of the antenna structure of the present invention, the winding has, preferably, a diameter of 0.1 mmϕ or less, more preferably 0.06 mmϕ, most preferably 0.045 mmϕ.

The antenna structure 2 of the present invention has a basic configuration in which a predetermined number of turns (T) of the winding are wound on an ordinary linear-shaped antenna core section. However, the configuration of the antenna structure 2 is not limited thereto, and any kind of antenna structure of the radio controlled timepiece having any configuration may be adapted. Particularly, the configuration is preferably formed adaptable to the configuration of the antenna structure disclosed in the first embodiment.

That is, the antenna structure 2 is of the type shown in FIG. 1 for receiving a radio wave and has the magnetic path structure in which a magnetic flux of an external radio wave can be received and the magnetic flux generated by resonance hardly leaks to the outside, in which the magnetic path 12 is configured to include the coil wound section 21 in which the conductor is wound to form the coil and the non-coil wound section 22 in which the conductor is not wound.

By way of a practical example of the antenna structure 2 of the second embodiment according to the present invention, the antenna structure 2 is designed by combining various antenna characteristics of the antenna structure 2 as shown in FIG. 1 to have the above-described characteristics.

Note that, as the antenna structure according to the present practical example, it is an antenna structure which is disposed within a timepiece, at least one of the side section and the bottom cover section thereof being formed of metal and being capable of receiving the radio wave, and the L value of the antenna structure is not more than 1600 mH, wherein the L value is preferably not more than 800 mH, and the L value is more preferably not more than 220 mH.

In the another aspect of the antenna structure according to the present practical example, it is an antenna structure which is disposed within a timepiece, at least one of the side section and the bottom cover section thereof being formed of metal and being capable of receiving the radio wave, and the winding resistance of the antenna structure is not higher than 1 KΩ, wherein the winding resistance of the antenna is preferably not higher than 400 Ω, and the winding resistance of the antenna is more preferably not higher than 100 Ω.

In the still another aspect of the antenna structure according to the present practical example, it is an antenna structure which is disposed within a timepiece, at least one of the side section and the bottom cover section thereof being formed of metal and being capable of receiving the radio wave, and the number of turns of winding of the antenna is not less than 1000, wherein the number of turns of the antenna is preferably not less than 1500.

In the still another aspect of the antenna structure according to the present practical example, it is an antenna structure which is disposed within a timepiece, at least one of the side section and the bottom cover section thereof being formed of metal and being capable of receiving the radio wave, and the winding has a wire diameter of not more than 0.1 mmϕ.

The antenna structure for receiving a radio wave according to the first embodiment, wherein, preferably, the antenna structure satisfies at least one of the conditions of the individual characteristic values described above, and the structure thereof has the magnetic path structure in which a magnetic flux of an external radio wave can be received and the magnetic flux generated by resonance hardly leaks to the outside, in which the magnetic path is configured to include the coil wound section in which the conductor is wound to form the coil and the non-coil wound section in which the conductor is not wound.

The practical example may be such that, in the configuration portion of the antenna structure, the coil wound section in the magnetic path and at least one part of the non-coil wound section are configured of materials different from each other, or the magnetic path through which the magnetic flux generated by resonance travels through forms the closed loop like configuration,.

In addition, the antenna structure may be configured such that a part of the magnetic path configuring the closed loop like configuration, in the antenna structure includes a part having a magnetic permeability different from magnetic permeability of other parts, or a part of the magnetic path configuring the closed loop like configuration, in the antenna structure includes a part having a magnetic resistance different from magnetic resistances of other parts, and further, the effective magnetic permeability of the non-coil wound section is lower than the effective magnetic permeability of the coil wound section.

Similarly, the antenna structure according to the present embodiment satisfies at least one of the conditions of the individual characteristic values described above, wherein the structure thereof may be such that the gap is provided in the non-coil wound section, or the gap is provided at least one of the contacting portions of the coil wound section and the non-coil wound section.

Further, the non-coil wound section may be formed of a magnetic material having a magnetic permeability lower than a magnetic material forming the coil wound section, or a film layer formed of a magnetic transmuted layer, a non-magnetic layer, or a layer having a low magnetic permeability is formed on at least a part of a surface of the non-coil wound section or the coil wound section.

Further, the antenna structure for receiving a radio wave according to the first embodiment satisfies at least one of the conditions of the individual characteristic values described above, wherein the structure thereof may be such that the coil wound section and the non-coil wound section may be configured so that the cross-sectional areas of the coil wound section and the non-coil wound section are different from each other, or the coil wound section and the non-coil wound section are formed as independent element to each other and are integrated together after the conductor is wound about the non-coil wound section and the coil is thereby formed, and further, the gap to be formed in the non-coil wound section or between the coil wound section and the non-coil wound section is formed by inserting an appropriate spacer along the contacting surface between the end faces of the coil wound section and the non-coil wound section.

Similarly, the antenna structure according to the present practical example may be such that the contacting surface of the gap or the contacting surface between the end faces that is formed between the coil wound section and the non-coil wound section is formed in a tapered shape, and the gap is formed such that the end faces of the coil wound section and the non-coil wound section or the end faces of the coil wound section and the non-coil wound section or the surfaces of the coil wound section and the non-coil wound section in a portion except the end faces of the sub-magnetic path are opposite to each other.

Further, the gap may be formed in a portion of the magnetic path except the portion in the vicinity of a coil winding unit of the coil wound section.

In another aspect of the present invention, a radio controlled timepiece 1 is configured of, as shown in FIG. 8, a reference signal generating means 31 for outputting a reference signal; a time keeping means 32 for outputting timing information on the basis of the reference signal; a displaying means 33 for displaying time on the basis of the timing information; a receiving means 34 for receiving a standard radio wave containing reference time information; an output-time correcting means 35 for correcting the output time information from the time keeping means on the basis of the received signal from the receiving means 34, in which the receiving means 34 is configured of any one of the antenna structures 2 individually having the configurations.

The radio controlled timepiece 1 is inclusive of, for example, a radio controlled timepiece or remote controlled wristwatch that receive a standard radio wave containing a time code to self-adjust the time of the wristwatch in use to standard time.

In the radio controlled timepiece 1 according to the second embodiment of the present invention that has the configuration as shown in FIGS. 9 and 10 with which the specific practical example of the radio controlled timepiece 1 has been described, when the antenna structure 2 having any one of the configurations shown in FIG. 7 is used, the characteristics of the antenna structure 2 is configured to be set to any one of the characteristics described above.

As shown in FIG. 11, in the another practical example of the second embodiment according to the present invention, the antenna structure 2 may be provided in the surface opposite to the surface in which the windshield 43 is provided with respect to the dial plate 46 of a radio controlled timepiece 1.

In a still another aspect of the second embodiment according to the present invention, a radio controlled timepiece is configured of a reference signal generating means for outputting a reference signal; a time keeping means for outputting timing information on the basis of the reference signal; a displaying means for displaying time on the basis of the timing information; a receiving means for receiving a standard radio wave containing reference time information; an output-time correcting means for correcting the output time information from the time keeping means on the basis of the received signal from the receiving means, wherein the radio controlled timepiece has a side section and a bottom cover section, at least of which is configured of metal, and includes the antenna structure having at least one of the antenna characteristic values.

In still another aspect of the second embodiment according to the present invention, the coil wound section of the antenna structure is disposed in an outer circumferential portion of the radio controlled timepiece; the non-coil wound section of the antenna structure is disposed in an internal side of the coil wound section with respect to the circumference section of the radio controlled timepiece; and the receiving means includes the antenna structure having at least one of the antenna characteristic values described above.

In still another aspect of the second embodiment according to the present invention, a radio controlled timepiece is such that an antenna structure is provided in the radio controlled timepiece, the antenna structure having at least one of the configurations and the antenna characteristics as mentioned above, and at least a part of the non-coil wound section of the antenna structure is covered by a part of the coil wound section, which opposes the side portion of the radio controlled timepiece.

Figure 24:
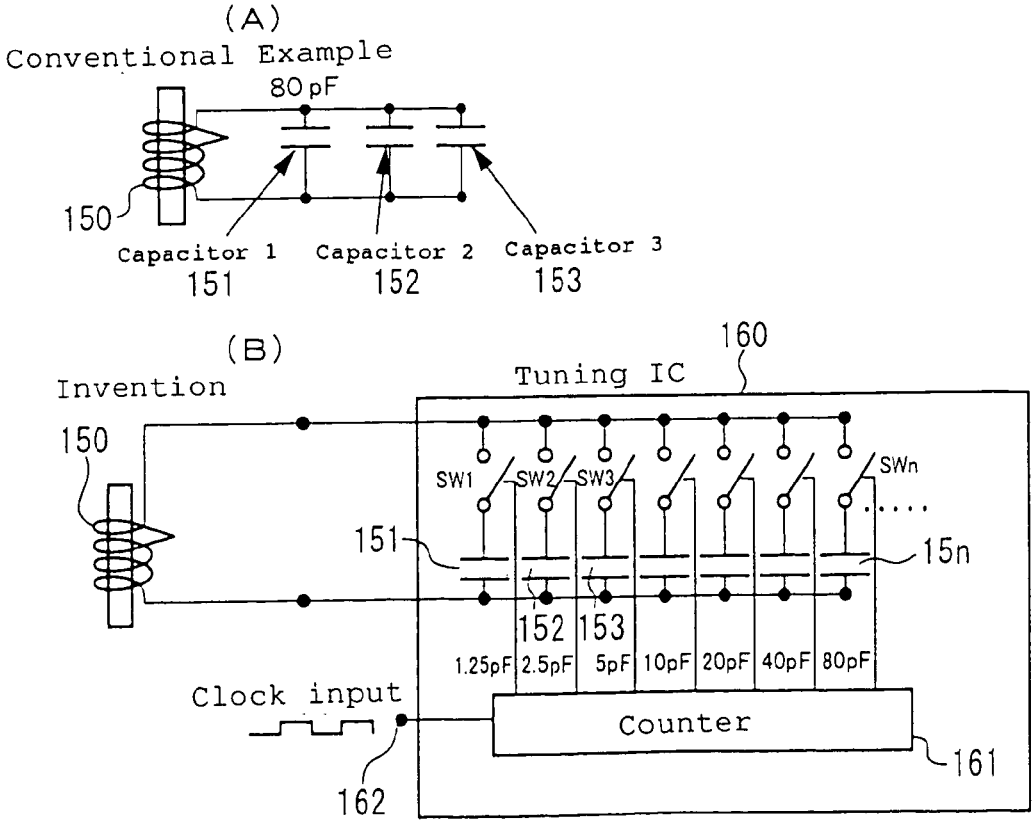
FIG. 24 shows a block diagram of a circuit configuration used to change an antenna-structure resonant frequency of the antenna structure of the second embodiment according to the present invention.

FIG. 24 shows views showing an example of an adjusting method for the resonant frequency in the antenna structure used in the present invention. FIG. 24(A) shows a conventional adjusting method, in which a plurality of capacitors 151 to 153 are parallely provided at both end portions of a winding 150, and each of the capacitors has a capacitance of 80 pF. In this case, when the resonant frequency of the antenna structure 2 is changed, the capacitance of the capacitor needs to be changed to an appropriate value, or the number of the connected capacitors needs to be changed, so that the measuring operation is intricate.

In comparison, in the present invention, as shown in FIG. 24(B), a tuning IC circuit 160 is connected to both end terminals of the winding wire 150, the circuit 160 comprising a plurality of adjusting means each being parallely connected to each other, wherein each one of the adjusting means consisting one of the plurality of capacitors 151 to **15*n* and one of the plurality of switches SW1 to SWn, each being serially connected to each other, and further the arrangement of the plurality of capacitors 151 to 15*n*** being established in such a way that a capacitance of the respective capacitor is increased by double of that of a capacitor previously and immediately adjacent to the capacitor and this capacitance increment rule being continued along the line of these capacitors starting from 1.25 pF of a first capacitor in this series.

Each one of the control terminals of the switch circuits SW1 to SWn is connected to an appropriate control counter means 161 and by controlling to drive the control terminal of the switch circuits SW1 to SWn, so as to optionally select one or a plurality of desired capacitor(s) in response to an input signal input to the input terminal of the control counter means, thereby enabling the desired resonant frequency to easily be set.

According to the second embodiment of the present invention, since the configuration described above is employed, the problems with the conventional technique are solved whereby to enable easily obtaining the antenna structure and the radio controlled timepiece using the antenna structure that have high reception efficiency, the size and thickness of the wristwatch per se which are not different from those of the conventional wristwatch, and a degree of design freedom, and that enable manufacturing costs to be reduced, by using the simply configured antenna structure without greatly changing the structure, outer casing materials, design, and/or the like of the conventional radio controlled timepiece.

Further, the radio controlled timepiece can easily obtained that has a high commercial value and that does not reduce the gain even in the case where the antenna is stored in the metal outer casing.

(Third Embodiment)

Another embodiment of an antenna structure of the present invention will be described hereinbelow.

According to the above-described practical examples of the first embodiment, attention has been drawn to the gain value as a characteristic value of the antenna structure to prevent the reduction in the reception performance of the antenna structure in the state where the antenna structure is disposed in contact with the metal object or metal object is disposed in the vicinity of the antenna structure. Thereby, it has been clarified that the reduction ratio of the gain value exhibited with the antenna structure in the case where the metal object is disposed in contact with the antenna structure or the metal object is disposed in the vicinity of the antenna structure with respect to the case where the metal object is absent in the vicinity of the antenna structure should be restrained to not higher than 60%.

Then, the antenna structure is provided in which the reduction ratio is restrained to not higher than 60%, and there are proposed new structures of the antenna structures in the above-described case. In the third embodiment of the present invention, the inventors conducted researches regarding limitation conditions on a value which relates to the reception characteristics of the antenna structure, and have succeeded in designating optimal values thereof.

More specifically, in a basic aspect of the antenna structure of the third embodiment according to the present invention, an antenna structure for receiving a radio wave is characterized in that a Q value retention ratio Rq defined below in the case where a metal object is present in the vicinity is not higher than 10%.

The Q value retention ratio Rq mentioned above is expressed by $$Rq=Q_{NL}/Q_O\times 100,$$

where, the Q value of the antenna structure is set to $Q_O$ in the case where the antenna structure is placed under an environment in which the antenna structure is not disposed in contact with the metal object or the metal object is absent in the vicinity of the antenna structure, and a Q values of the antenna structure are measured and set to $Q_N$ in an environment where the antenna structure is disposed in contact with the metal object or the metal object is disposed in the vicinity of the antenna structure, and then the most lowest $Q_N$ value is selected as $Q_{NL}$.

In a second aspect of the third embodiment according to the present invention, similar to the case described in the first embodiment, the antenna structure has a structure in which an external magnetic flux can be effectively received, and the magnetic flux hardly leaks to the outside during resonance. A practical example thereof is configured to include a magnetic path forming a closed loop like configuration, and satisfies the above-described Q-value characteristic condition.

Further, in a third aspect of the third embodiment according to the present invention, a radio controlled timepiece is constructed of a reference signal generating means for outputting a reference signal; a time keeping means for outputting time information on the basis of the reference signal; a displaying means for displaying time on the basis of the timing information; a receiving means for receiving a standard radio wave containing reference time information; and the receiving means has a structure includes the antenna structure having a structure that satisfies the above-described Q-value characteristic conditions.

The antenna structure and radio controlled timepiece having the antenna structure of the present invention employs the technical configuration as described above whereby to enable easily obtaining the radio controlled timepiece using the antenna structure that has high reception efficiency, and a degree of design freedom enhanced with the size and thickness of the wristwatch per se which are not different from those of the conventional wristwatch and that enables manufacturing costs to be reduced, by using the antenna structure having the simple configuration without greatly changing the structure, design, and/or the like of the conventional radio controlled timepiece.

Similar to the analysis regarding the gain value, the inventors performed analysis in detail regarding the Q value, and arrived at a conclusion that the Q value retention ratio is preferably set to not lower than 10%.

Referring to the drawings, a detailed description will be given hereunder regarding the configuration of practical examples of the antenna structure and the radio controlled timepiece using the antenna structure of the third embodiment according to the present invention.

As already described above, FIG. 1 is a schematic plan view showing a practical example of a configuration that can suitably be adapted as the antenna structure 2 of the present invention and that can of course be employed in the present embodiment also. Shown in the drawing is the antenna structure 2 for receiving a radio wave, in which the Q value retention ratio Rq defined below in the case where a metal object is present in the vicinity is not higher than 10%.

The Q value retention ratio Rq mentioned above is expressed by $$Rq=Q_{NL}/Q_O\times 100,$$

where, the Q value of the antenna structure is set to $Q_O$ in the case where the antenna structure is placed under an environment in which the antenna structure is not disposed in contact with the metal object or the metal object is absent in the vicinity of the antenna structure, and a Q values of the antenna structure are measured and set to $Q_N$ in an environment where the antenna structure is disposed in contact with the metal object or the metal object is disposed in the vicinity of the antenna structure, and then the most lowest $Q_N$ value is selected as $Q_{NL}$.

By way of a more detailed description of the structure of the antenna structure 2, with reference to FIG. 1, the antenna structure 2 has the structure that receives the external magnetic flux 3 and that minimizes leakage of the magnetic flux hardly to the outside of the antenna structure during resonance.

Conventionally, as shown in FIG. 2, it has been considered as described hereunder. In the case where at least a metal object having electro-conductivity is disposed in the vicinity of the antenna structure that receives the radio wave or in contact with the antenna structure, the radio wave is absorbed by the metal object, and hence the radio wave does not reach the antenna, so that the resonant output of the antenna is lowered, wherein the metal object in this case refers to at least one of, for example, a side section or bottom cover section formed of materials such as SUS, Ti, or Ti alloy, timepiece dial plate, motor, battery, solar battery, wristband, heatsink, microcomputer, and gear train. Then, to improve the sensitivity of the antenna structure, for example, the antenna structure per se is largely formed, or the antenna structure is provided outside the metal object of the antenna structure alternatively, the outer casing section is formed from plastic or ceramic instead of metal object, and concurrently, metal plating is applied to the surface of the non-metallic substance made of plastic. However, as already described above in detail in the first embodiment, the understanding of conventional problems was practically incorrect, and the technical concept of the present invention has been verified to be correct.

When the output characteristic value of the antenna structure 2 is defined by the Q value, the Q value represents the level of energy loss of the antenna in the resonant state. As the energy loss is lower, the Q value increases, and the antenna output becomes an output value obtained from the antenna output at the time of substantially non-resonance by multiplied it by the Q value.

That is, as the Q value increases, the antenna output is proportionally improved, whereby the performance required for the antenna structure is determined to be sufficient.

According to the relationship between the gain and Q value of the antenna monolith shown in Tables 1 and 2, the resonance/non-resonance gain ratio is about 40 dB with respect to the Q value of 114, a converted value of which is 100 times higher.

Nevertheless, however, suppose that the conventional antenna structure is disposed in contact with or in the vicinity of a metal material object as in the case where, for example, the antenna structure is disposed in the outer casing section 3 formed of a SUS material. In this case, the magnetic-flux energy loss described above is caused whereby to significantly reduce the Q value of the antenna structure 2, consequently reducing the antenna output.

The problems thus occur in the case where the conventional antenna structure is disposed in the outer casing section formed of the metal material. In addition, the same problems occurs also in the case where the antenna structure is disposed in the vicinity of a metal-material object, such as a battery including a solar battery, motor, movement, gear train, microcomputer, heatsink, or dial plate, for example.

The inventors conducted the experiments and verified that the Q values $Q_N$ in the case where the antenna structure is disposed in contact with the metal-material object or in the vicinity thereof is reduced as much as 70 to 95% with respect to the Q value in $Q_O$ in the case where the antenna structure is neither in contact with the metal-material object nor in the vicinity thereof.

For the present invention, the inventors conducted studies and researches to learn how to prevent and restrain reduction in the Q value to a Q value level not causing a problem in practical application in the situation where the antenna structure is disposed either in contact with the metal material or in the vicinity thereof. As a result, we have arrived at the present invention. Basically, the technique of the present invention is designed such that a Q value retention ratio Rq in the case where the antenna structure 2 used as the present invention is not higher than 10%, the Q value retention ratio Rq being expressed by $$Rq=Q_{NL}/Q_O\times 100,$$

where, the Q value of the antenna structure is set to $Q_O$ in the case where the antenna structure is placed under an environment where the antenna structure 2 is not disposed in contact with the metal object 3 or the metal object 3 is absent in the vicinity of the antenna structure, and a Q values of the antenna structure are measured and set to $Q_N$ in an environment where the antenna structure is disposed in contact with the metal object or the metal object is disposed in the vicinity of the antenna structure, and then the most lowest $Q_N$ value is selected as $Q_{NL}$.

This enables easily manufacturing of the antenna structure that solves the conventional problems, that is small and thin to an extent not causing practical problems, that reduces manufacturing costs, and that is suitable for use with radio-wave using electronic devices.

The structure of the antenna structure of the present invention will be describe in more detail. Referring to FIG. 1, the antenna structure 2 has a configuration in which when a predetermined radio wave has arrived from the outside, the external magnetic flux section 4 is received, and the resonant magnetic flux 7 flows through the closed loop type magnetic path 12 during resonance, the magnetic flux 7 consequently hardly leaks to the outside of the antenna structure.

From the experiments performed by the inventors, it was known that while the Q value retention ratio Rq in the conventional antenna structure is 5 to 30%, the Q value retention ratio Rq in the antenna structure having the configuration of the present invention is maintained to at least not lower than 10% or higher; and under a good environment, the Q value retention ratio Rq can be maintained to not lower than 50%. In other words, even in the configuration where the antenna structure 2 is disposed in contact with the metal-material object or the metal material is present in the vicinity of the antenna structure, the reduction ratio of the Q value is significantly restrained. In a practical case, the antenna structure 2 capable of exhibiting high reception performance regardless of the presence or absence of the metal material can be obtained easily and at low costs.

In the present invention, the frequency of the objective radio wave that the antenna structure 2 can receive is the radio wave having a frequency of 2000 KHz or lower and preferably a frequency band of several tens of kilohertz (KHz) to several hundreds of kilohertz.

The metal object 3 used in the present invention is disposed at a distance reachable by the magnetic flux 7 generated by resonance in the state where the sub-magnetic path is not provided in the antenna structure 2 in the event that the antenna structure 2 resonates upon receipt of the radio wave. Practically, the metal object is formed using a metal material having electro-conductivity, such as SUS, BS, Ti, or Ti alloy, or gold, silver, platinum, nickel, copper, chromium, aluminum, or alloy thereof.

In the present invention, a practical example of the metal object 3 disposed in the vicinity of the antenna structure 2 is, for example, a dial plate, a side section, a motor, a movement, a battery, a solar battery (particularly, SUS-substrate solar battery), a wristband, and a heat sink of a timepiece.

A practical third example of the measuring method for the Q value used in the third embodiment of the present invention is the same as that described in the first embodiment.

Specifically, using a similar device, and the output value Q of the antenna structure 2 without the metal plate was measured, and among the Q value, $Q_{NL}$ of the minimum Q value was selected from the Q values represented by $Q_N$, whereby Q value retention ratio Rq was obtained according "$Rq=Q_{NL}/Q_O\times100$."

A plurality of metal plates of other materials different from one another were prepared, and Q value retention ratios Rq thereof were each measured in the same manner as that described above.

Figure 25:
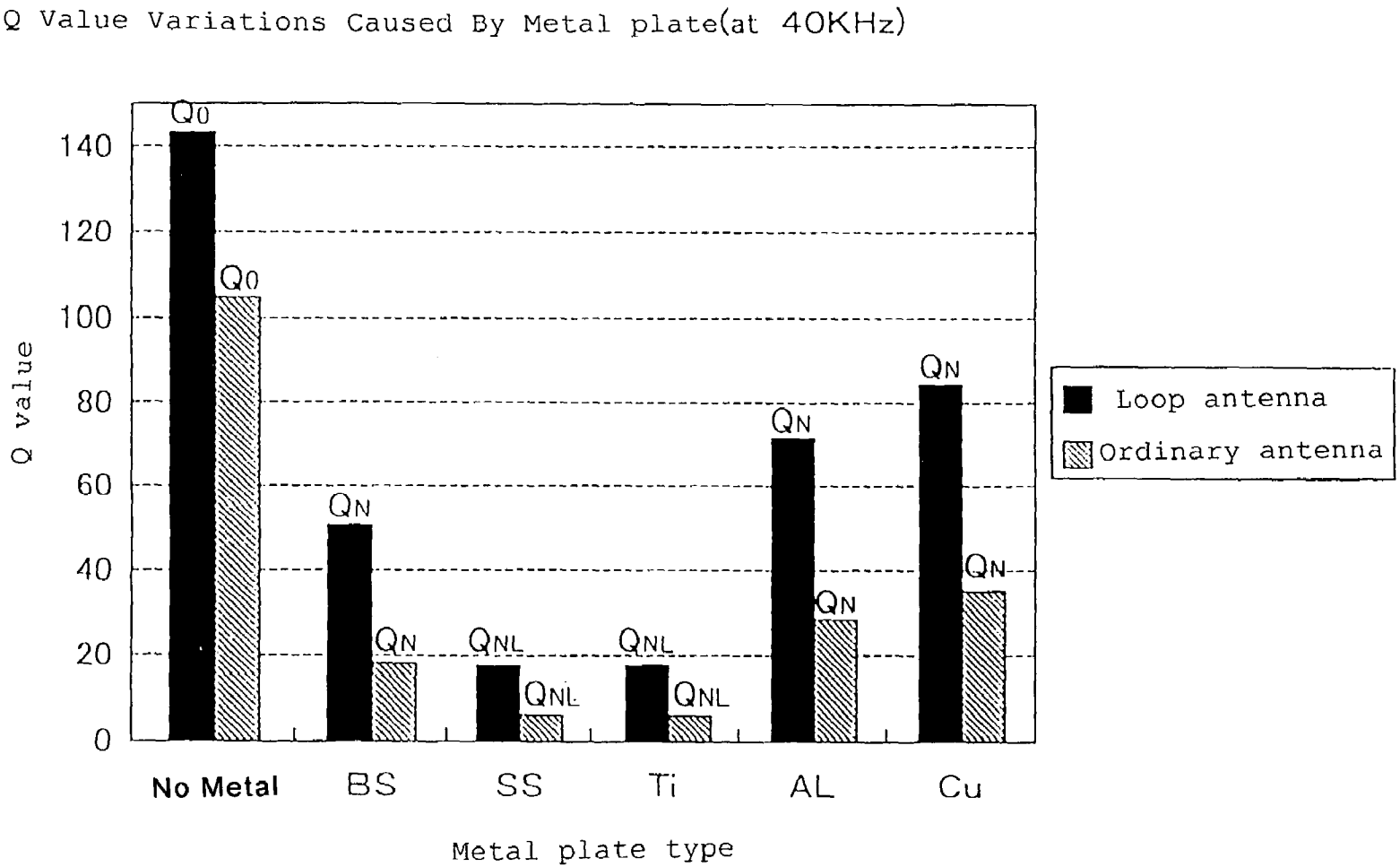
FIG. 25 is a graph showing variations in the Q values in association with influences of a metal plate of an antenna structure of a third embodiment of the present invention and the conventional antenna structure.

The results are shown in FIG. 25.

FIG. 25 shows resultant Q values individually measured in the above-described manner. Used in the measurement are an antenna structure having a loop like configuration, core used in the present invention, as shown in FIG. 1, and an antenna structure having a conventionally used ordinary linear core, and five different types of materials, namely BS, SUS, aluminum, copper, etc, as an object.

Clearly from FIG. 25, the Q value or $Q_O$ of the antenna structure 2 of the present invention is about 140 in the state without being influenced by the metal material. In addition, the Q value or $Q_O$ of the conventional antenna structure as shown in FIG. 2 is about 103 in the same state as the above.

In comparison, as shown in FIG. 25, under the environment being influenced by the metal material, any one of the Q values that is $Q_N$ value of the both antenna structures 2 with each of all the metal materials being used is significantly lower than $Q_O$. Also it can be known that minimum Q values, that are minimum values $Q_{NL}$ are exhibited in the case of SUS or Ti.

Nevertheless, however, it can be known that, with the antenna structure 2 having the configuration of the present invention, even in the case of the minimum Q value, $Q_{NL}$ is maintained to about 18. This value is about 3 times as high with respect to 5 that is the corresponding Q value or the minimum value $Q_{NL}$ exhibited by the conventional antenna structure 2.

When this state is represented by the Q value retention ratio Rq, the ratio is as low as 4% in the case of the conventional antenna structure 2. However, in the case of the antenna structure 2 of the present invention, the Q value retention ratio Rq is 10% or higher, and more particularly, about 12.5%.

In general, it is determined that the higher the Q value, the higher the antenna characteristics are. In the case where the metal is present in the vicinity of the antenna structure or in contact with the antenna structure, the Q value significantly reduces to the extent of disabling the antenna to exhibit its inherent functionality.

When the Q value retention ratio Rq becomes 10% or lower, the antenna substantially becomes unusable.

As is clear from the experiment results described above, it is understood that the antenna structure 2 of the present invention is an effective invention for solving the conventional problems for improvement.

When measuring the Q value retention ratio Rq in the present invention, the method can be simplified. Instead of using the plurality of metal materials, the Q value is measured under an environment where a metal object made of SUS, Ti, or Ti alloy is brought into connection with the antenna structure or placed in the vicinity of the antenna structure, and the Q value is set to the minimum value $Q_{NL}$ of the Q value.

Figure 26:
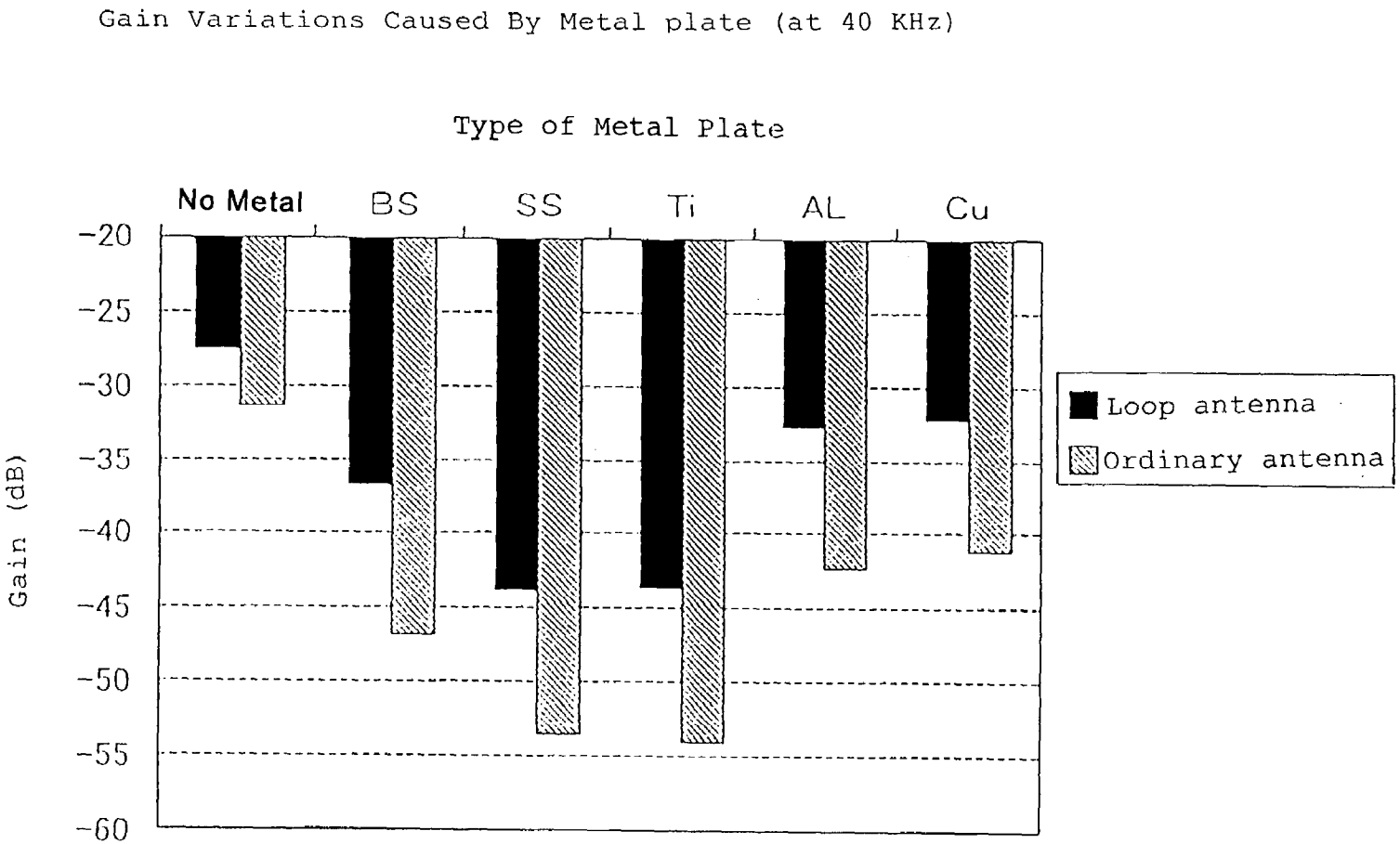
FIG. 26 is a graph showing variations in the gains in association with influences of the metal plate of the antenna structure of the third embodiment of the present invention and the conventional antenna structure.

FIG. 26 shows dB representations of gains in the case where the antenna structure of the present invention and the conventional antenna structure are measured under the same conditions in the case shown in FIG. 25. In the drawing, there are shown the gain values higher than those of the conventional antenna structure.

Figure 27:
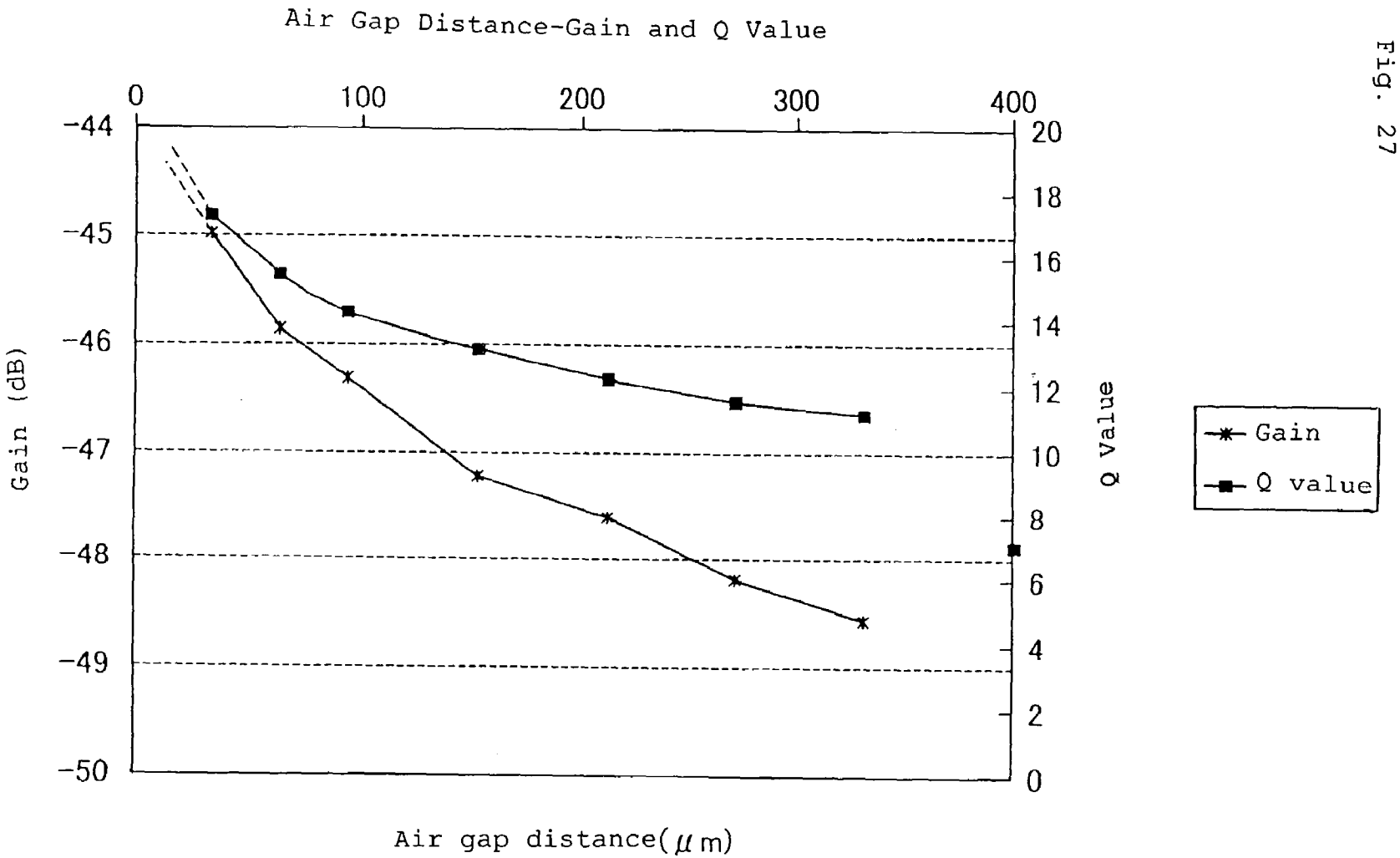
FIG. 27 is graph showing the state of variations in the air gap distance, the gain, and the Q value in the event of using of a practical example of the antenna structure of the third embodiment according to the present invention.

Further, as shown in FIG. 27, the Q-value improvement level had air gap dependency, so that as the air gap is narrowed, the Q value is improved higher.

However, non-uniformity takes place in manufacturing steps, so that managing the gap at a constant narrow interval is important.

As described above, in the third embodiment of the present invention, the minimum value $Q_{NL}$ of the Q value of the antenna structure is preferably the minimum Q selected from Q values of multiple types of metal objects formed of different materials, which Q values are measured under the conditions identical one another. Alternatively, the minimum value $Q_{NL}$ that is the Q value of the antenna structure is preferably a value measured under an environment where a metal object formed of SUS, titanium Ti, or Ti alloy is designated and the metal object is brought into connection with the antenna structure or disposed in the vicinity of the antenna structure.

Further, a practical example of the third embodiment according to the present invention may also be an antenna structure having the configuration used in the first embodiment according to the present invention is used in combination with the above-described Q-value characteristic conditions.

Accordingly, it is preferable that the antenna structure of the third embodiment according to the present invention be the type having a structure in which an external magnetic flux can be received, the magnetic flux hardly leaks to the outside during resonance, and the Q value retention ratio Rq is not lower than 10%.

Similarly, it is preferable that the antenna structure of the third embodiment according to the present invention is preferably of the type having a structure in which a magnetic path forms a closed loop like configuration, and the Q value retention ratio Rq is not lower than 10%.

The antenna structure of the third embodiment according to the present invention is preferably configured such that a part of the magnetic path, which forms the closed loop like configuration of the antenna structure includes a part different in magnetic resistance from other parts, and the Q value retention ratio Rq is not lower than 10%.

Further, the antenna structure of the third embodiment according to the present invention is preferably configured such that, in addition to the configuration described above, the magnetic path is configured of a main magnetic path in which a coil is wound about a magnetic core and a sub-magnetic path in which the coil is not wound about the magnetic core, and the Q value retention ratio Rq is not lower than 10%.

Further, the antenna structure of the third embodiment according to the present invention is preferably configured such that, in addition to the individual configurations described above, the magnetic resistance of the sub-magnetic path is higher than the magnetic resistance of the main magnetic path, and an air gap is provided in the sub-magnetic path or between the sub-magnetic path and the main magnetic path.

Further, the antenna structure of the third embodiment according to the present invention is preferably configured such that, in addition to the configuration described above, the cross-sectional areas of the main magnetic path and the sub-magnetic path are different from each other, and the main magnetic path and the sub-magnetic path are configured of materials different from each other.

In another aspect of the third embodiment according to the present invention, a radio controlled timepiece 1 is configured of, as shown in FIG. 8, a reference signal generating means 31 for outputting a reference signal; a time keeping means 32 for outputting timing information on the basis of the reference signal; a displaying means 33 for displaying time on the basis of the timing information; a receiving means 34 for receiving a standard radio wave containing reference time information; an output-time correcting means 35 for correcting the output time information from the time keeping means on the basis of the received signal from the receiving means 34, in which the receiving means 34 is configured of any one of the antenna structures 2 individually having the configurations.

The radio controlled timepiece 1 is inclusive of, for example, a radio controlled timepiece or remote controlled wristwatch that receive a standard radio wave containing a time code to self-adjust the time of the wristwatch in use to standard time.

A specific practical example of the radio controlled timepiece 1 of the present invention is preferably be of the type having the already-described configuration shown in FIG. 9 or FIG. 10, in which the antenna structure 2 used in the radio controlled timepiece 1 having also already described configuration shown in FIG. 6, and the Q value retention ratio Rq is not lower than 10%.

In the present invention, since the configuration described above is employed, the problems with the conventional technique are solved whereby to enable easily obtaining the antenna structure and the radio controlled timepiece using the antenna structure that have high reception efficiency, the size and thickness of the wristwatch per se which are not different from those of the conventional wristwatch, and a degree of design freedom, and that enable manufacturing costs to be reduced, by using the simply configured antenna structure without greatly changing the structure, outer casing materials, design, and/or the like of the conventional radio controlled timepiece.

What is claimed is:

1. An antenna structure which receives a radio wave and is arranged at a position in the vicinity of a metal object, comprising a main magnetic path in which a coil is wound about a magnetic core and a sub-magnetic path, a magnetic path being formed with said main magnetic path and said sub-magnetic path to have a closed loop-like configuration so that a magnetic flux generated by resonance of said antenna structure caused by a radio wave reaching to said antenna structure, hardly leaks to said metal object.

2. An antenna structure according to claim 1, wherein said sub-magnetic path comprises a magnetic core about which said coil is not wound.

3. An antenna structure according to claim 1, wherein said sub-magnetic path is made of a soft magnetic material.

4. An antenna structure according to claim 1, wherein said main magnetic path and said sub-magnetic path are separately formed from each other.

5. An antenna structure according to claim 1, wherein said metal object serves as an outer casing which houses said antenna structure therewithin.

6. An antenna structure according to claim 1, wherein a gap portion which forms a part of said magnetic path having said closed loop like configuration, is provided between a part of said main magnetic path and a part of said sub-magnetic path, and further wherein said gap portion has magnetic resistance thereof which is set at a value different from that of other parts of said magnetic path having a closed loop like configuration or having magnetic permeability thereof which is set at a value different from that of other parts of said magnetic path.

7. An antenna structure according to claim 5, wherein said magnetic resistance being set at a value larger than that of other part of said magnetic path or said magnetic permeability being set at a value smaller than that of other part of said magnetic path.

8. An antenna structure which receives a radio wave to be used inside a metal outer casing, comprising a main magnetic path in which a coil is wound about a magnetic core and a sub-magnetic path in which said coil is not wound about a magnetic core, a magnetic path being formed to have a closed loop like configuration along said magnetic core, a gap portion being provided in a part of said magnetic path of said antenna structure forming said closed loop like configuration, said gap portion of said magnetic path being configured to have magnetic resistance or magnetic permeability different from that of other parts of said magnetic path, and said antenna structure having a structure wherein a magnetic flux coming from outside said metal outer casing, can be received but magnetic flux generated by resonance hardly leaks outside of said magnetic path.

9. An antenna structure according to claims 1 or 8, wherein said magnetic resistance of said sub-magnetic path is configured so as to be larger than that of said magnetic resistance of said main magnetic path.

10. An antenna structure according to claim 8, wherein a material different from said material forming said magnetic core is configured to be arranged inside of said gap portion.

11. An antenna structure according to claim 8, wherein said gap portion is filled with a material different from said material forming said magnetic core.

12. An antenna structure according to claim 8, wherein said gap portion is an air gap.

13. An antenna structure according to claim 12, wherein said air gap is formed by inserting an intervening spacer within said gap portion.

14. An antenna structure according to claim 1 or 8, wherein said antenna structure receives said radio wave including a long wave whose frequency is not more than 2000 KHz.

15. An antenna structure according to claim 1 or 8, wherein said metal outer casing is formed by at least one member which is selected from a structure which is capable of storing said antenna structure inside thereof and comprising a side section and a bottom cover section each of which is made of a metal material respectively and a structure capable of storing said antenna structure inside thereof and comprising a piece of metal member in which a side section and a bottom cover section are integrally formed into a one piece member.

16. An antenna structure according to claim 8, wherein a cross section of said main magnetic path is different from that of said sub-magnetic path.

17. An antenna structure according to claim 8, wherein a material of said main magnetic path is different from that of said sub-magnetic path.

18. An antenna structure according to claim 8, wherein effective permeability of said sub-magnetic path is configured so as to be smaller than that of said main magnetic path.

19. An antenna structure according to claim 8, wherein a film layer selected from a group consisting of a magnetic transmuted film layer, a non-magnetic film layer, and a film layer having low magnetic permeability, is formed on at least a part of a surface of said sub-magnetic path or of said main magnetic path.

20. An antenna structure according to claim 8, wherein said main magnetic path and said sub-magnetic path form unit members, respectively each being independent from each other, and said main magnetic path and said sub-magnetic path are integrally connected with each other, after said coil is wound about said main magnetic path.

21. An antenna structure according to claim 8, wherein said gap portion is formed in at least one of connected portions formed between said main magnetic path and said sub-magnetic path.

22. An antenna structure according to claim 8, Wherein said gap portion is formed in a part of said sub-magnetic path.

23. An antenna structure according to claim 8, wherein a connected surface of said gap portion, which is provided in said sub-magnetic path, or a connected surface formed between an end face of said main magnetic path and an end face of said sub-magnetic path, is formed with a tapered configuration.

24. An antenna structure according to claim 8, wherein said gap portion is formed by either one of two ways in which (a) the end faces of said main magnetic path and said sub-magnetic path are oppositely arranged to each other or (b) a part of a surface of a portion of said sub-magnetic path and a part of a surface of another portion thereof, each of said surfaces being ones other than said end surfaces of said sub-magnetic path, are oppositely arranged to each other.

25. An antenna structure according to claim 8, wherein said gap portion is formed in a portion where at least a part of said main magnetic path and at least a part of said sub-magnetic path are adjacently arranged to each other while in parallelism with each other.

26. An antenna structure according to claim 8, wherein said gap portion is formed in a portion of said magnetic path except for a portion in the vicinity of a portion of said main magnetic path on which a coil is wound.

27. An antenna structure according to claim 8, wherein said gap portion includes a member whose magnetic resistance differs from said magnetic resistance of a material forming said magnetic path.

28. An antenna structure according to claim 8, wherein said gap portion is filled with a member which is one selected from a group consisting of a non-metallic and a non-magnetic material, and a non-metallic and magnetic transmuted material.

29. An antenna structure according to claim 8, wherein said main magnetic path or said sub-magnetic path is made of a soft magnetic material.

30. An antenna structure according to claim 8, wherein said main magnetic path is arranged so that said main magnetic path takes a position at which said main magnetic path directly faces to a direction from which said radio wave would come, with respect to said sub-magnetic path, so that said main magnetic path mainly can receive said radio wave rather than said sub-magnetic path.

31. An antenna structure according to claim 30, wherein a length of said main magnetic path is configured to be longer than a length of said sub-magnetic path, whereby said main magnetic path is arranged so as to cover said sub-magnetic path so that said sub-magnetic path is not directly opposed to said direction from which said radio wave is coming.

32. An antenna structure according to claim 1 or 8, wherein an L value of said antenna structure is not more than 1600 mH.

33. An antenna structure according to claim 32, wherein a number of winding turns of said antenna is not lower than 1000.

34. An antenna structure according to claim 32, wherein a diameter of a winding wire is not more than 0.11 mm Φ.

35. An antenna structure according to claim 1 or 8, wherein an L value of said antenna structure is not more than 800.

36. An antenna structure according to claim 1 or 8, wherein an L value of said antenna structure is not more than 220.

37. An antenna structure for receiving a radio wave which includes at least a magnetic core and a coil unit provided in at least a part of said magnetic core, said antenna structure including a main magnetic path wherein a coil is wound about said magnetic core and a sub-magnetic path wherein said coil is not wound about a magnetic core, a magnetic path formed along said magnetic core forming a configuration having a closed loop like configuration, wherein a maximum gain reduction ratio of a gain value shown by said antenna structure in a case where a metal object is present in the vicinity of said antenna structure to a gain value shown by said antenna structure in a case where said metal object is absent in the vicinity of said antenna structure, is not more than 60%.

38. An antenna structure according to claim 37, wherein said metal object includes at least one of a dial plate of a timepiece, an outer casing, a motor, a movement, a battery, a solar battery, a wrist band, a heat sink, a microcomputer, a gear train, and the like.

39. An antenna structure according to claim 37, wherein said metal object is located within a certain distance from said antenna structure to which a magnetic flux output therefrom in a state wherein said sub-magnetic path is not added to said antenna structure can reach when said antenna structure receives said radio wave to produce resonance, and said metal object has a function of absorbing said magnetic flux.

40. An antenna structure able to receive a radio wave, said antenna structure being arranged in a timepiece wherein at least one of a side section and a bottom cover section thereof is made of a metal material, wherein an external size of said timepiece is not more than 10 mm in a thickness thereof and not more than 30 mm in a diameter thereof, and further wherein said antenna structure is characterized in that an L value of said antenna structure is not more than 1600 mH and a winding resistance of said antenna structure is not more than 1 KΩ.

41. An antenna structure according to claim 40, wherein said L value is not more than 800 mH and said winding resistance of said antenna is not more than 1 KΩ.

42. An antenna structure according to claim 40, wherein said L value is not more than 220 mH and said winding resistance of said antenna is not more than 1 KΩ.

43. An antenna structure according to anyone of claims 40 to 42, wherein said antenna structure is able to receive a radio wave and is arranged in a timepiece wherein at least one of a side section and a bottom cover section is made of a metal material, and a number of winding turns of said antenna is not lower than 400.

44. An antenna structure according to anyone of claims 40 to 42, wherein a number of winding turns is not lower than 1000.

45. An antenna structure according to anyone of claims 40 to 42, wherein a diameter of a winding wire is not more than 0.11 mmΦ.

46. An antenna structure according to anyone of claims 40 to 42, wherein said antenna structure for receiving said radio wave is to be used inside a metal outer casing, said antenna structure comprising a main magnetic path wherein a coil is wound about a magnetic core and a sub-magnetic path wherein said coil is not wound about a magnetic core, a magnetic path formed along said magnetic core having a configuration of a closed loop like configuration, a gap portion being provided in a part of said magnetic path of said antenna structure, said gap portion being configured so as to have magnetic resistance or magnetic permeability different from magnetic resistance or magnetic permeability of said magnetic path other than said gap portion, and said antenna structure having a structure wherein a magnetic flux caused by an external radio wave coming into said metallic outer casing can be received but magnetic flux generated by resonance hardly leaks to an outside of said magnetic path.

47. An antenna structure according to anyone of claims 40 to 42, wherein a number of winding turns of said antenna is not lower than 400.

48. An antenna structure which receives a radio wave and comprising at least a magnetic core portion and a coil portion which is provided on at least one portion of said magnetic core portion, wherein, said antenna structure includes a main magnetic path wherein a coil is wound about said magnetic core and a sub-magnetic path wherein said coil is not wound about a magnetic core, a magnetic path along said magnetic core forming a configuration having a closed loop like configuration, said antenna structure being suitable to be used under circumstances wherein a metal material is present in the vicinity of said antenna structure, and a Q value retention ratio Rq defined below, in a case where said metal object is present in the vicinity of said antenna structure, is not lower than 10%, wherein said Q value retention ratio Rq is expressed by the following equation:

$$Rq=Q_{NL}/Q_O\times 100,$$

where the Q value of the antenna structure is set to $Q_O$ in the case where the antenna structure is placed under an environment in which the antenna structure is not disposed in contact with the metal object or the metal object is absent in the vicinity of the antenna structure, and Q values of the antenna structure are measured and set to $Q_N$ in an environment where the antenna structure is disposed in contact with the metal object or the metal object is disposed in the vicinity of the antenna structure, and then the most lowest $Q_N$ value is selected as $Q_{NL}$.

49. An antenna structure according to claim 48, wherein said Q value showing said minimum value in said Q values, wherein a plurality of kinds of metal objects made of different metal materials are measured under said same condition, is selected as said minimum value $Q_{NL}$ of said Q value of said antenna structure.

50. An antenna structure according to claim 49, wherein said minimum value $Q_{NL}$ of said Q value of said antenna structure is a value which is measured under circumstances, wherein a metal object made of stainless steel (SUS), titanium, or a titanium alloy is connected to said antenna structure, or said metal object is arranged in said vicinity of said antenna structure.

51. An antenna structure according to anyone of claims 48 to 50, wherein said magnetic path forming said closed loop like configuration, is a path through which magnetic flux generated by resonance passes.

52. A radio control timepiece which comprises a reference signal generating means for outputting a reference signal; a time keeping means for outputting time keeping information on the basis of said reference signal; a displaying means for displaying a time information on the basis of said time keeping information; a receiving means for receiving a standard radio wave having reference time information and a time information correction means for correcting the output time information output from said time keeping means based on the receiving signal received from a receiving means, said receiving means including an antenna structure having the structure defined by any one of claims 1, 8, 37, 40 or 48.

53. A radio control timepiece according to claim 52, wherein said radio control timepiece has an outer casing unit which is made of metal material.

54. A radio control timepiece according to claim 53, wherein at least one of a side section and a bottom cover section of said outer casing is made of said metal material.

55. A radio control timepiece according to claim 54, wherein said antenna structure is provided on a surface of a dial plate of said radio control timepiece, said surface being opposite to another surface thereof which is facing to a windshield.

56. A radio control timepiece according to claim 54, wherein said antenna structure is provided in said radio control timepiece, and further wherein at least a part of the portion of said sub-magnetic path of said antenna structure which opposes said outer casing unit of said radio control timepiece is covered with said main magnetic path.

57. A radio control timepiece according to claim 52, wherein said main magnetic path of said antenna structure is arranged in an outer periphery of said radio control timepiece and said sub-magnetic path is arranged inside said main magnetic path relative to said outer periphery of said radio control timepiece.

* * * * *